US011643856B2

(12) United States Patent
Jeong

(10) Patent No.: US 11,643,856 B2
(45) Date of Patent: May 9, 2023

(54) FLUSH HANDLE FOR VEHICLE DOOR ACTUATED BY A SLIDER

(71) Applicant: WOOBO TECH CO., LTD., Pyeongtaek-si (KR)

(72) Inventor: Hae Il Jeong, Incheon (KR)

(73) Assignee: WOOBO TECH CO., LTD., Pyeongtaek-si (KR)

( * ) Notice: Subject to any disclaimer, the term of this patent is extended or adjusted under 35 U.S.C. 154(b) by 279 days.

(21) Appl. No.: 16/971,467

(22) PCT Filed: Jan. 21, 2020

(86) PCT No.: PCT/KR2020/000980
§ 371 (c)(1),
(2) Date: Aug. 20, 2020

(87) PCT Pub. No.: WO2020/153695
PCT Pub. Date: Jul. 30, 2020

(65) Prior Publication Data

US 2020/0386019 A1 Dec. 10, 2020

(30) Foreign Application Priority Data

Jan. 22, 2019 (KR) ..... 10-2019-0007865
Nov. 11, 2019 (KR) ..... 10-2019-0143506

(51) Int. Cl.
*E05B 85/10* (2014.01)
*E05B 77/04* (2014.01)
(Continued)

(52) U.S. Cl.
CPC ..... *E05B 85/107* (2013.01); *E05B 77/04* (2013.01); *E05B 81/40* (2013.01); *E05B 81/76* (2013.01);
(Continued)

(58) Field of Classification Search
CPC ..... E05B 79/10; E05B 79/12; E05B 79/14; E05B 79/16; E05B 85/103; E05B 85/107;
(Continued)

(56) References Cited

U.S. PATENT DOCUMENTS 6,094,952 A * 8/2000 Clark ..... E05B 17/2092 70/333 R
6,575,508 B2 * 6/2003 Stuart ..... E05B 77/06 292/336.3
(Continued)

FOREIGN PATENT DOCUMENTS

CN 1253606 A 5/2000
CN 107939186 A 4/2018
(Continued)

OTHER PUBLICATIONS

International Searching Authority/KR, International Search Report and Written Opinion of the International Searching Authority, Application No. PCT/KR2020/000980, dated May 12, 2020, with English translation of the International Search Report, 8 pages.

*Primary Examiner* — Christine M Mills
*Assistant Examiner* — Emily G. Brown
(74) *Attorney, Agent, or Firm* — Sunstein LLP

(57) ABSTRACT

A flush handle for a vehicle door having a slider, a handle unit and a linear motion conversion mechanism. The linear motion conversion mechanism includes a linear motion conversion unit and a driving unit. The linear motion conversion unit includes at least first and second inclined long holes, and at least one pin, configured to couple to the handle unit, and slide along the inclined long holes. The pin includes a first pin configured to slide in the first inclined long hole and a second pin configured to slide in the second inclined long hole. The handle unit includes an extension portion, configured to couple to the first pin, and adjust a
(Continued)

distance between the first pin and an outer surface of the handle unit.

26 Claims, 61 Drawing Sheets

(51) Int. Cl.
*E05B 85/06* (2014.01)
*E05B 85/16* (2014.01)
*E05B 81/40* (2014.01)
*E05B 81/76* (2014.01)
*E05B 81/90* (2014.01)

(52) U.S. Cl.
CPC ..... *E05B 81/90* (2013.01); *E05B 85/06* (2013.01); *E05B 85/103* (2013.01); *E05B 85/16* (2013.01); *E05Y 2900/531* (2013.01)

(58) Field of Classification Search
CPC ..... E05B 85/10; E05B 85/06; E05B 85/16; E05B 81/40; E05B 81/76; E05B 81/90; G01B 7/30; B65H 2553/51
See application file for complete search history.

(56) References Cited

U.S. PATENT DOCUMENTS 10,961,753 B2 * 3/2021 Han ..... E05B 85/107
2010/0301844 A1 * 12/2010 Schmidt ..... G01D 5/24447 324/207.25
2013/0313036 A1 * 11/2013 Kovie ..... E05B 77/06 180/274
2015/0039180 A9 * 2/2015 Aerts ..... E05B 85/103 292/336.3
2015/0233153 A1 8/2015 Smart et al.
2015/0240536 A1 * 8/2015 Cumbo ..... E05B 85/20 292/200
2016/0298366 A1 * 10/2016 Och ..... E05B 85/103
2017/0260780 A1 * 9/2017 Christensen ..... E05B 85/103
2018/0148957 A1 * 5/2018 Och ..... E05B 81/76
2018/0171686 A1 * 6/2018 Couto Maquieira . E05B 85/107
2018/0274271 A1 * 9/2018 Och ..... E05B 77/06
2019/0186180 A1 * 6/2019 Iwata ..... E05B 85/06
2019/0234122 A1 * 8/2019 Löw ..... E05B 85/103
2020/0080351 A1 3/2020 Guerin et al.
2020/0102773 A1 * 4/2020 Sobecki ..... E05B 85/103
2021/0087862 A1 * 3/2021 Guerin ..... E05B 85/103
2021/0156178 A1 * 5/2021 Heyduck ..... E05B 81/42
2021/0172218 A1 * 6/2021 Velicanin ..... E05B 85/107
2021/0189778 A1 * 6/2021 Sha ..... E05B 81/76

FOREIGN PATENT DOCUMENTS

CN 108193961 A 6/2018
CN 108374615 A * 8/2018 ..... E05B 85/107
CN 108843162 A * 11/2018 ..... E05B 79/22
EP 3396088 A1 * 10/2018 ..... E05B 77/06
EP 3 404 176 A1 11/2018
KR 10-1997-0075186 12/1997
KR 20-03599130 8/2004
KR 10-2013-0097514 11/2013
KR 10-1637820 7/2016
KR 10-2017-001458 1/2017
KR 10-2018-0071313 6/2018
KR 101875658 B 7/2018
WO 2018/010939 A1 1/2018
WO WO-2020094270 A1 * 5/2020

* cited by examiner

FLUSH HANDLE FOR VEHICLE DOOR ACTUATED BY A SLIDER

This application is the national phase entry of international patent application no. PCT/KR2020/000980 filed Jan. 21, 2020 and claims the benefit of Korean patent application No. 10-2019-0007865, filed Jan. 22, 2019, and Korean patent application No. 10-2019-0143506, filed Nov. 11, 2019, the disclosures of which are incorporated herein by reference in their entirety.

TECHNICAL FIELD

The present invention relates to a flush handle that is withdrawn from or entered into a vehicle door.

BACKGROUND

A flush handle for a vehicle door is a handle that is withdrawn from or entered into the outer side of the vehicle door panel in the width direction of the vehicle.

A conventional flush handle for a vehicle door is presented in Korean Patent Publication No. 10-2018-0071313.

The vehicle door handle of 'Korean Patent Publication No. 10-2018-0071313' is connected to the handle support through two links and rotating joints, so that the door lock or door lock function can be mechanically driven.

In addition, when an electrical signal is generated by the movement of the vehicle door handle, the door lock or door lock function may be electronically driven.

The vehicle door handle of 'Korean Patent Publication No. 10-2018-0071313' uses links and a rotating joint, and thus has a problem that the overall volume is large and assembly is difficult to secure a turning radius.

Patent Document 1: Korean Patent Publication No. 10-2018-0071313

DETAILED DESCRIPTION OF INVENTION

Technical Problems

The present invention has been made to solve the above-described problems, and an objective thereof is to provide a flush handle for a vehicle door capable of enhancing the assemblability while minimizing the volume of the flush handle for a vehicle door.

Technical Solution

It is characterized in that a flush handle for a vehicle door of the present invention for achieving the above object comprises: a slider; a handle unit accommodated in the slider; and a linear motion conversion mechanism, sliding the handle unit in an y direction in accordance with a sliding of the slider in an x direction, or sliding the slider in the x direction in accordance with a sliding of the handle unit in the y direction, wherein a lengthwise direction of the vehicle is the x direction, and a widthwise direction of the vehicle is the y direction.

It may be characterized in that the linear motion conversion mechanism comprises: a linear motion conversion unit, sliding the slider and the handle unit relatively; and a driving unit, sliding the slider.

It may be characterized in that the linear motion conversion unit comprises: an inclined long hole, inclined with respect to the y direction, formed at the slider; and a pin, coupled to the handle unit, and sliding along the inclined long hole.

It may be characterized in that the driving unit comprises: a moving nut disposed non-rotatably in the slider; a lead screw fastened to the moving nut; and a power delivery unit delivering a rotational force to the lead screw.

It may further comprise a slider return spring returning the slider.

It may be characterized in that the slider return spring is installed between the power delivery unit and the slider.

It may be characterized in that: the inclined long hole includes a first inclined long hole and a second inclined long hole disposed in the x direction, wherein an inclined direction of the first inclined long hole is parallel to the inclined direction of the second inclined long hole, wherein the pin includes: a first pin sliding in the first inclined long hole, and a second pin sliding in the second inclined long hole, and wherein the handle unit includes: an extension portion, coupled to the first pin, and adjusting a distance between the first pin and an outer surface of the handle unit.

It may be characterized by further comprising: an extension portion return spring, returning the extension portion, and wherein a slot positioned in the first pin orthogonal to an direction between the first pin and the outer surface of the handle unit.

It may be characterized in that the handle unit is rotatable centered around the second pin, and a pivot unit changing a rotation axis of the handle unit is further installed in the handle unit.

It may be characterized—by further comprising: a housing in which the slider is installed, wherein the pivot unit is provided with a pivot pin connected to the handle unit, wherein a distance between the pivot pin and an outer side of the vehicle is smaller than a distance between the second pin and the outer side of the vehicle, and wherein the pivot unit is fixed to the housing by a frictional force with the housing when the handle unit is pressed from the outer side of the vehicle.

It may be characterized in that the second inclined long hole includes an entry portion formed in the inner side of the vehicle and a withdrawal portion formed in the outer side of the vehicle, wherein the entry portion of the second inclined long hole has a shape in which the second pin is rotatable with respect to the pivot pin.

It may be characterized in that a second pin installation groove into which the second pin is inserted is formed in the handle unit, wherein the second pin installation groove has a shape of an arc centered around the pivot pin.

It may be characterized by further comprising: a housing in which the slider is installed is further included, wherein a guide portion in contact with the slider is formed in the housing, the guide portion is elongated in the x direction, and wherein a groove into which the guide portion is inserted is formed in the slider and the moving nut.

It may be characterized in that a sensor detecting the moving nut is further installed in the housing, wherein a protrusion that can press the sensor is formed in the moving nut, and wherein the protrusion is disposed outside the slider.

It may be characterized by further comprising: a first housing in which the handle unit is installed; and a second housing in which the power delivery unit is installed, wherein the second housing is separated from the first housing.

It may be characterized in that the handle unit further includes a button pushing the handle unit into a vehicle door, wherein the button is exposed outside only when the handle unit is withdrawn.

It may be characterized by further comprising: a housing in which the slider is installed, wherein the handle unit further includes a button withdrawing the handle unit from the vehicle door, and wherein the button is pressed by the housing when the handle unit is pressed in the y direction.

It may be characterized in that the power delivery unit includes: a motor; and an encoder capable of measuring the number of revolutions of the motor.

It may be characterized by comprising: a housing in which the slider is installed, wherein a bumper protruded outward from the slide is installed on the slider, and wherein a gap is formed between an outer surface of the slider and an inner surface of the housing due to the bumper.

It may be characterized in that the handle unit includes: a rear side handle unit slided by the linear motion conversion mechanism; and a front side handle unit coupled to the rear side handle unit by a pivot pin, wherein the front side handle unit is rotatable centered around the pivot pin.

It may be characterized in that the inclined long hole includes a first section and a second section in which the pin passes, the pin moves from the first section to the second section when the handle unit is withdrawn, wherein a slope of the first section is more gradual than a slope of the second section.

It may be characterized by further comprising: a plate spring coupled to an outer side of the button, wherein the plate spring is pressed by the housing.

It may be characterized by further comprising: a housing in which the slider is installed, wherein a step adjustment bolt is installed in the housing, wherein the step adjustment bolt is disposed in contact with the handle unit, and wherein the handle unit is moved in the y direction when the step adjustment bolt is tightened or loosened.

It may be characterized in that a guide groove is formed on an upper surface of the slider and elongated in the x direction, wherein a locking groove is formed on the upper surface of the slider, and connected to an end of the guide groove, wherein a weight balance includes a first arm, wherein the first arm moves between a first position located at the end of the guide groove and a second position located at the locking groove to prevent sliding of the slider in the x direction, and wherein when an impact is applied to the vehicle door, the first arm moves to the second position.

It may be characterized by further comprising: a motorized latch unit that is locked or unlocked by the sliding of the slider.

It may be characterized by further comprising: a key cylinder manually driving the motorized latch unit.

It may be characterized by further comprising: a gear provided with a rotational force of the key cylinder, a gear rod connected to the gear and rotated by the gear, and an insert portion formed at an end of the gear rod and coupled to the motorized latch unit, wherein the insert portion has a shape of a plate, and wherein the motorized latch unit is manually opened when the insert portion rotates.

It may be characterized by further comprising a manual latch unit opened by the rotation of the handle unit.

It may be characterized characterized by further comprising: a lever delivering the rotational force of the handle unit to the manual latch unit, and a weight balance including a second spring installation portion that can be moved between a first position in an initial state and a second position that can block the operation of the lever, wherein when an impact is applied to the vehicle door, the second spring installation portion is moved from the first postion to the second position.

Advantageous Effects of Invention

According to a flush handle for a vehicle door of the present invention as described above, it has the following effects.

The slider is installed to accommodate the handle unit, thereby making the device compact on the whole.

Due to the linear motion conversion mechanism that converts the sliding direction of the slider to the sliding direction of the handle unit, the device does not need to be installed in the same direction as the sliding direction of the handle unit, so the device becomes compact in the width direction of the vehicle.

As the slider is slid in the lengthwise direction of the vehicle, the device becomes compact in the height direction of the vehicle.

Due to the driving unit, sliding the slider, the handle unit can be withdrawn and entered with motorized movement.

Due to the slider return spring that slides the slider, the handle unit can be manually withdrawn and entered.

Due to the sliding of the slider, the motorized latch unit can be mechanically and electrically locked or unlocked, so that the electrical malfunction of the motorized latch unit can be prevented.

By installing the moving nut included in the driving unit in a state separated from the slider, the slider can be slid independently of the driving unit. Therefore, when a user's hand is caught in the handle unit, the hand can be removed by pulling the handle unit, thereby enhancing the use safety.

The linear motion conversion mechanism comprises a pin installed in an inclined long hole formed in the slider, thereby enhancing the assemblability between the handle unit and the slider.

The water tightness of the power delivery unit is enhanced by separating the space where the handle unit is in contact with the outside and the space where the power delivery unit of the driving unit is installed are not connected to each other.

A button capable of entering the handle unit is formed on the handle unit, so that the handle unit can be easily entered. The button is disposed at a position that can be pressed only when the handle unit is withdrawn, thereby reducing the inflow of foreign substances through the button and enhancing the user interface.

A button capable of withdrawing the handle unit is formed at the rear side of the handle unit, so that a user can easily withdraw the handle unit by pressing the handle unit inward.

By installing a bumper on the outer side of the slider, it is possible to reduce noise generated between the slider and the housing on which the slider is installed and the blocking plate when the slider is being slid.

Since a motorized latch or a manual latch can be used, a latch can be selected according to the requirements of a user.

By further comprising a key cylinder that can manually unlock the motorized latch or the manual latch, a user can open or close the vehicle door in various ways.

By connecting the motorized latch or the manual latch and the key cylinder through a gear, it is possible to respond to a key mounting position that is changed according to the exterior design of the vehicle, and the rotational force of the key that turns the key cylinder can be delivered to the motorized latch or the manual latch more efficiently.

When the manual latch is used, by comprising a lever that delivers the rotational force of the handle unit to the manual latch unit and a weight balance that is moved to a position where the operation of the lever can be prevented by an impact when the impact is applied to the vehicle door, a situation where the vehicle door is being opened by an external impact can be prevented.

When the manual latch is used, by comprising a weight balance that is moved to a position where the sliding of the slider can be blocked by an impact when the impact is applied to the vehicle door, a situation where the vehicle door is opened by an external impact can be prevented.

The handle unit is separated into a rear side handle unit that is slid by a linear motion conversion mechanism, and a front side handle unit that is pin-coupled with the rear side handle unit and capable of pulling operation, so that it can be stably driven without tangling between the sliding and pulling operations.

DESCRIPTION OF THE PREFERRED EMBODIMENTS

Hereinafter, preferred embodiments of the present invention will be described in detail with reference to the accompanying drawings.

For reference, for the same configuration as the prior art among the configurations of the present invention to be described hereinafter, reference will be made to the above mentioned prior art, and a separate detailed description will be omitted.

The terms used herein are for reference only to specific embodiments and are not intended to limit the invention. The singular forms used herein comprise plural forms unless the phrases clearly indicate the opposite meaning.

As used herein, the meaning of "comprising" embodies specific features, areas, integers, steps, actions, elements and/or components, but it does not exclude the presence or addition of other specific features, areas, integers, steps, actions, elements, components and/or groups.

In a preferred embodiment of the present invention, the front-to-rear side means the lengthwise direction of the vehicle, the up-and-down direction means the widthwise direction of the vehicle, and the left-to-right direction means the vertical direction of the vehicle.

Embodiment 1

As illustrated in FIGS. 1 to 5, a flush handle for a vehicle door according to a first preferred embodiment of the present invention comprises: a housing 1100; a slider 1600 installed in the housing 1100; a handle unit 1200 accommodated in the slider 1600; and a linear motion conversion mechanism, sliding the handle unit 1200 in the front-to-rear direction in accordance with a sliding of the slider 1600 in the left-to-right direction, or sliding the slider 1600 in the left-to-right direction in accordance with a sliding of the handle unit 1200 in the front-to-rear direction.

The linear motion conversion mechanism comprises: a linear motion conversion unit for supporting the relative sliding between the slider 1600 and the handle unit 1200; and a driving unit 1700, sliding the slider 1600.

The linear motion conversion unit comprises: first and second inclined long holes 1601 and 1602 formed in the slider 1600, and first and second pins 1301 and 1302 installed in the handle unit 1200 to be slid along the first and second inclined long holes 1601 and 1602.

Hereinafter, each configuration will be described in detail with reference to FIG. 5.

<Housing>

Figure 6:
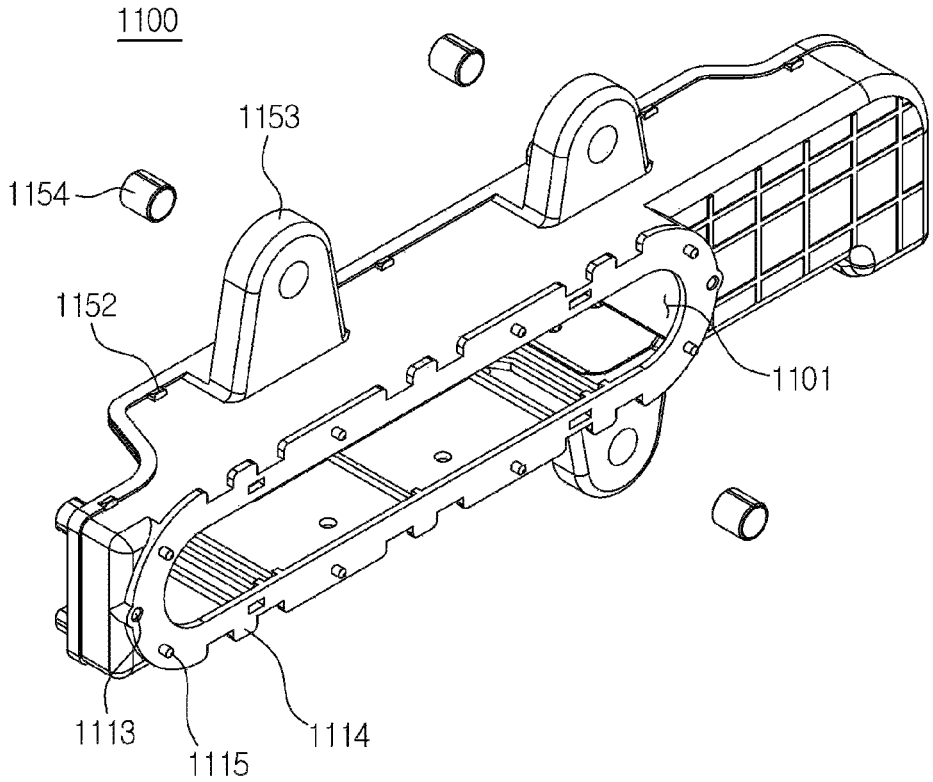
FIG. 6 is a front perspective view of the housing of a flush handle for a vehicle door according to a first preferred embodiment of the present invention.
Figure 7:
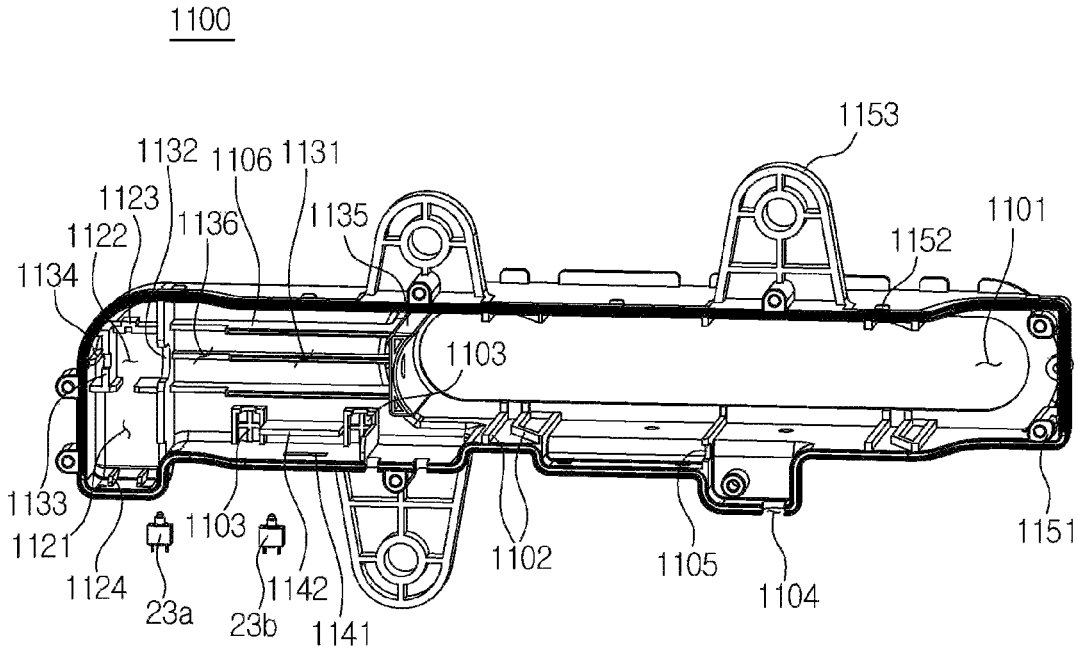
FIG. 7 is a rear perspective view of the housing of a flush handle for a vehicle door according to a first preferred embodiment of the present invention.

The housing 1100 is illustrated in detail in FIGS. 6 to 7.

The housing 1100 is formed, on the whole, in the shape of a cuboid with open rear and left sides. That is, it is composed of a front surface portion and a circumferential portion formed to be protruded rearward from the circumference of the front surface portion.

A handle unit 1200 and a slider 1600 are disposed at a central portion of the housing 1100, a driving unit 1700 is disposed at a right side portion of the housing 1100, and a key cylinder 1900 is disposed at a left side portion of the housing 1100.

In the housing 1100, a handle unit through hole 1101 is formed to be long from the central portion to the left side portion of the housing 1100. The handle unit through hole 1101 is formed as the shape of the front portion of the handle unit 1200, and in the first embodiment, formed in the shape of a rectangle with arc-shaped left and right sides to be penetrated through the front-to-rear direction. The handle unit through hole 1101 is formed larger than the front portion of the handle unit 1200 so that the interference between the handle unit through hole 1101 and the handle unit 1200 is prevented.

A first guide portion 1102 and a second guide portion 1105 are formed to be protruded inward in the upper and lower portions of the circumferential portion of the housing 1100.

The first guide portion 1102 is disposed at the left and right sides of the handle unit through hole 1101, and the first and second pins 1301 and 1302 inserted into the handle unit 1200 and the slider 1600 guide the sliding of the slider 1600.

The first guide portion 1102 is divided into two portions, a left and a right side portions. The right side of the first guide portion 1102 is formed in a straight line extending straight in the front-to-rear direction, and the rear side portion of the left side of the first guide portion 1102 is formed in a straight line inclined leftward as it travels from front to rear.

Due to this first guide portion 1102, a space is secured to which the handle unit 1200 is movable rightward when rotating counterclockwise along the turning radius while the first and second pins 1301 and 1302 are located in the rear side, and when they are located in the front side, it can be slid in the front-to-rear direction.

The second guide portion 1105 is disposed at the center of the handle unit through hole 1101 and guides the sliding of the slider 1600.

The second guide portion 1105 formed on the upper portion is formed in the form of a straight line extending straight in the front-to-rear direction, and the second guide portion 1105 formed in the lower portion is in the form of a letter '¬', on the whole, and formed in a shape in which a second straight line portion that runs continuous in the downward direction is connected at the rear direction of a first straight line portion that runs continuous in the front-to-rear direction.

A groove is formed to be open rearward in the second straight line portion, and a door latch connection portion 30, which will be described later, is fitted.

The left portion of the second guide portion 1105 formed in the lower portion of the housing 1100 is formed to be protruded downward. A door latch connection portion penetrating groove 1104 is formed to be open rearward and to be penetrated through the up-down direction in the lower left of the protruded space, and thereby a portion of the door latch connection portion 30 is installed.

In the lower right portion of the housing 1100, two third sensor installation grooves 1103 are formed to be spaced apart from each other in the left-to-right direction. The third sensor installation groove 1103 is formed in a way that a rim of a rectangular shape having a partially open upper portion is protruded rearward. Due to this, third sensors 23*a* and 23*b* are installed in the rear-to-front direction in the third sensor installation groove 1103, and pressed through the open portion.

In the right center of the housing 1100, three third guide portions 1106 are formed to be protruded rearward. The third guide portion 1106 is disposed on the right side of the handle unit through hole 1101.

The third guide portion 1106 is formed long in the left-to-right direction, and the lengths of the widths of the left and center portions are formed wider than the lengths of the widths of the right side. Lead screw installation grooves 1131 are formed in the rear direction of the left side and center, and bumper installation grooves 1136 are formed in the rear direction of the right side.

In addition, the length of the front-to-rear width of the third guide portion 1106 disposed in the middle portion in the up-down direction is narrower than the length of the front-to-rear width of the third guide portion 1106 disposed in the upper and lower portions. Due to this, the middle portion and the upper and lower portions of each of the lead screw 1724 installed in a lead screw installation groove 1131, which will be described later, a slider return spring 1730 disposed surrounding a lead screw 1724, and a bumper 1740 installed in the bumper installation groove 1136 can be guided by the third guide portion 1106.

The front outer side of the housing 1100 is coupled with a bumper member 1500, which will be described later. A first bumper fastening portion 1113 capable of fastening bolts is formed on the left and right sides centered around the handle unit through hole 1101. A plurality of second bumper fastening portions 1114 is formed on the upper side and the lower side around the handle unit through hole 1101. The left and right sides, with respect to the central portion, of the second bumper fastening portion 1114 is formed recessed toward the direction of the handle unit through hole 1101. Between the first bumper fastening portion 1113 and the second bumper fastening portion 1114 and between the second bumper fastening portion 1114 and the second bumper fastening portion 1114, a third bumper fastening portion 1115 has a shape of a cylindrical column protruded forward. Due to this, the housing 1100 and the bumper member 1500 may be more firmly coupled.

The right side of the housing 1100 is formed to be protruded downward.

In the lower right side of the housing 1100, a first motor installation groove 1121 is formed to be open rearward.

In the upper portion of the first motor installation groove 1121, a worm gear installation groove 1122 is formed to be open rearward.

The first motor installation groove 1121 is disposed at the right side of the third guide portion 1106. Between the first motor installation groove 1121 and the third guide portion 1106, a lead screw penetrating portion 1132 is formed long in the up-down direction in a way that the upper and lower portions of the lead screw penetrating portion 1132 are connected to the circumferential portion of the housing 1100.

The right and lower sides of the first motor installation groove 1121 are blocked by the circumference of the housing 1100, the upper side of the first motor installation groove 1121 is blocked by a partition formed between the first motor installation groove 1121 and the worm gear installation groove 1122, and the left side of the first motor installation groove 1121 is blocked by the lead screw penetrating portion 1132.

In the lead screw penetrating portion 1132, a groove is formed to be open rearward, and thereby the right side of the lead screw 1724 is installed.

In the lower portion of the first motor installation groove 1121, a first motor support portion 1124 is formed to be protruded upward. A portion of the lower portion of the motor 1710 inserted into the first motor installation groove 1121 is supported by being inserted between the first motor support portion 1124.

In the lower portion of the worm gear installation groove 1122, a groove is formed to be open rearward and to be penetrated through the up-down direction, so that the worm 1721 formed in the upper portion of the motor 1710 is installed in the worm gear installation groove 1122 through the groove.

In the upper portion of the worm gear installation groove 1122, a first motor shaft installation portion 1123, in which a groove is formed to be open rearward and downward, is formed, and thereby the upper portion of the worm 1721 is installed.

In the right side of the worm gear installation groove 1122, a lead screw installation portion 1133 in which a groove is formed to be open rearward, is formed, and thereby the right side of the axis of the lead screw 1724 is installed.

In the right side of the periphery of the housing 1100, a lead screw support 1134 is formed to be protruded leftward. The lead screw support portion 1134 is disposed at the right side of the lead screw installation portion 1133. The right end of the lead screw 1724 is supported by the lead screw support portion 1134 so that the lead screw 1724 does not move further rightward.

Between the third guide portion 1106 and the handle unit through hole 1101, a lead screw installation portion 1135 is formed to be protruded rearward. The right side of the lead screw installation portion 1135 is formed to be flat so that the lead screw 1724 does not move further leftward. In addition, the left side of the lead screw installation portion 1135 has a shape of an arc convex on the right side, and thereby the interference between the lead screw installation portion 1135 and the handle unit 1200 is prevented.

In the center of the lead screw installation portion 1135, a groove is formed to be penetrated through the left-to-right direction, and thereby the left side of the axis of the lead screw 1724 is installed.

In the lower right portion of the circumferential portion of the housing 1100, a wire penetrating groove 1141 is formed to be penetrated through the up-down direction. The wire penetrating groove 1141 is disposed between the third sensor installation grooves 1103.

Between the third sensor installation grooves 1103, a wire guide portion 1142 is formed to be protruded rearward, and the third sensor installation groove 1103 at the left side and the third sensor installation groove 1103 at the right side are connected by the wire guide portion 1142.

Due to this, a wire 20 is inserted into the housing 1100 through the wire penetrating groove 1141, and some of the wires 20 is connected to third sensors 23*a* and 23*b* through the lower portion of the wire guide portion 1142.

In the circumferential portion of the housing 1100, a first fastening portion 1151 and a second fastening portion 1152 coupled with a blocking plate 1800 are formed.

The first fastening portion 1151 is formed in a form comprising a groove through which the bolt can be inserted from rear to front. A portion of the first fastening portion 1151 is formed to be protruded outward in a portion of the right, upper, and lower side surfaces of the circumferential portion of the housing 1100, and the rest of the first fastening portion 1151 is formed to be protruded rearward in the left side of the housing 1100 and in the right side of the door latch connection portion penetrating groove 1104.

In the upper and lower side surfaces of the circumferential portion of the housing 1100, a second fastening portion 1152 is formed to be protruded outward. The second fastening portion 1152 has a shape of a protrusion inclined inward as it travels from front to rear.

In the circumferential portion of the housing 1100, a third fastening portion 1153 that is coupled with the door panel is formed.

In the upper and lower side surfaces of the circumferential portion of the housing 1100, a third fastening portion 1153 is formed to be protruded outward. In the third fastening portion 1153, a groove is formed to be penetrated through the front-to-rear direction, and is coupled to the door panel through the groove. A metal pad 1154 in the shape of a donut is installed in the groove to prevent the coupling portion between the housing 1100 and the door panel from being damaged and loosened.

<Handle Unit>

Figure 8:
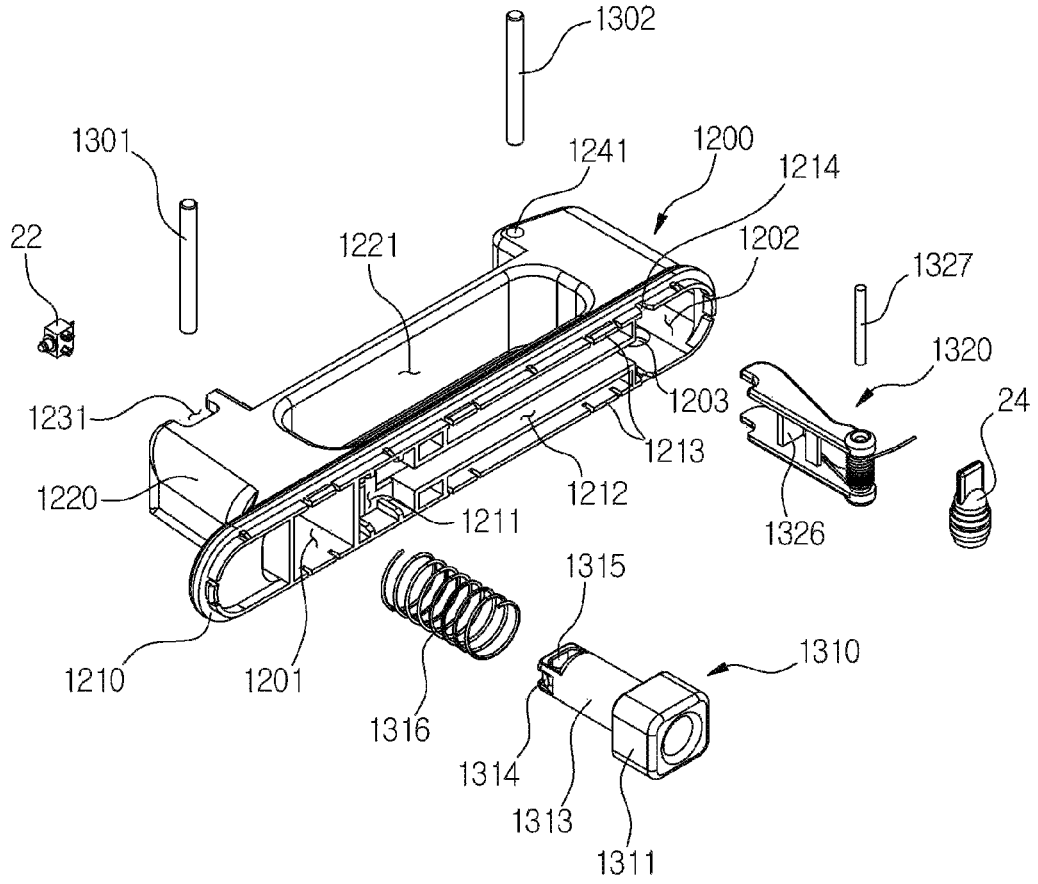
FIG. 8 is a front exploded perspective view of a flush handle for a vehicle door according to a first preferred embodiment of the present invention.
Figure 9:
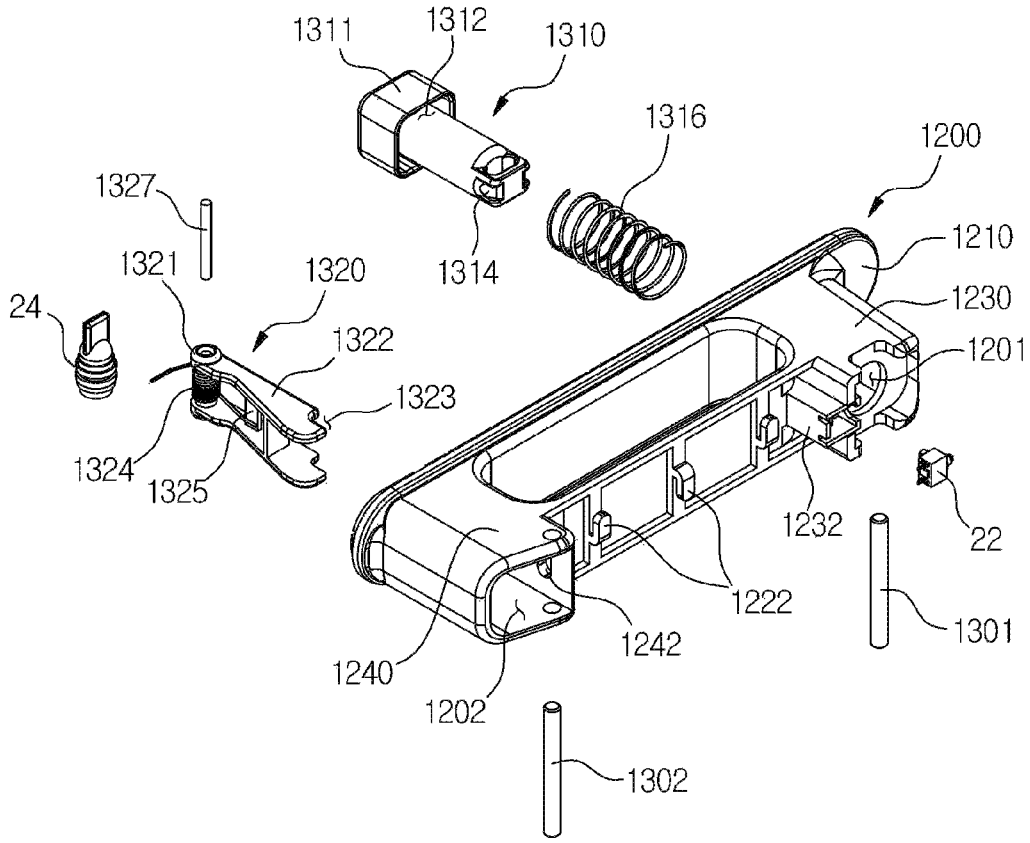
FIG. 9 is an exploded rear perspective view of a handle unit of a flush handle for a vehicle door according to a first preferred embodiment of the present invention.

The handle unit 1200 is illustrated in detail in FIGS. 8 to 9.

The handle unit 1200 is formed in a shape in which the left and right sides of a rectangle are protruded rearward, on the whole. The handle unit 1200 comprises a handle unit main body 1220 corresponding to the rectangle, a left side portion 1230 of the handle unit corresponding to the protruding portion, and a right side portion 1240 of the handle unit.

In the left side portion of the handle unit 1200, an extension portion installation groove 1201 has a shape of a rectangle to be penetrated through the front-to-rear direction, and in the right side portion of the handle unit 1200 a pivot unit installation groove 1202 has a shape of a rectangle to be penetrated through the front-to-rear direction.

The left and right and up-down directions of the extension portion installation groove 1201 and the pivot unit installation groove 1202 are blocked by the handle unit 1200. Due to this, an extension portion 1310, which will be described later, is moved along the extension portion installation groove 1201 within the extension portion installation groove 1201, and the pivot unit 1320 is rotated centered around a third pin installation groove 1214 or a pivot pin 1327 within the pivot unit installation groove 1202.

In the lower portion in front of the pivot unit installation groove 1202, an LED installation groove 1203 is formed to be penetrated through the up-down direction. In the LED installation groove 1203 the lower portion of the LED 24, which will be described later, is inserted, so that when the handle unit 1200 is withdrawn, a user can check the light of the LED 24 from the outside of the handle unit 1200.

In the left side of the pivot unit installation groove 1202, a wire penetrating groove 1242 is formed to be penetrated through the left-to-right direction. The wire 20 connected to the outside through a wire insertion groove 1801 of a blocking plate 1800, which will be described later, is connected to each sensor of the handle unit 1200 through the wire penetrating groove 1242, and some of them are connected to the LED 24.

In the front surface of the handle unit main body 1220, a handle cover installation portion 1210 is formed. The handle cover installation portion 1210 is formed to be extended further leftward than the handle unit main body 1220. The handle cover installation portion 1210 comprises a rear surface panel formed in the shape of a rectangle having an arc-shaped left and right sides in accordance with the shape of the handle unit through hole 1101 and a circumferential portion formed protruded rearward at a place inwardly apart a predetermined interval from the circumference of the rear plate.

In a central portion of the handle cover installation portion 1210, a button sensor installation groove 1211 and a wire installation portion 1212 are formed.

The button sensor installation groove 1211 is formed to be open forward, and thereby a button 25 and a button sensor 26 are installed. The button 25 is disposed at the front direction of the button sensor 26, and when the button 25 is pressed from front to rear, the button sensor 26 is pressed. The button 25 and the button sensor 26 are illustrated in detail in FIG. 10.

The wire installation portion 1212 is formed to be open in the front and left and right directions, and thereby the wire 20 entered through the pivot unit installation groove 1202 is installed. The wire 20 is connected to the button sensor 26 through the wire installation portion 1212.

In the up, down, left, and right sides of the circumferential portion of the handle cover installation portion 1210, a handle cover fastening portion 1213 in the shape of a hook is formed to be protruded outward of the circumferential portion of the handle cover installation portion 1210. The handle cover fastening portion 1213 comprises a protrusion formed inclined further outward of the handle cover installation portion 1210 as it travels from front to rear, and grooves formed to be penetrated through the inward-outward directions at both sides of the protrusion to allow elastic deformation of the both sides of the protrusion.

Due to this, the handle cover 1400, which will be described later, is installed on the outer surface of the circumferential portion of the handle cover installation portion 1210.

In the upper and lower portions of the right side of the circumferential portion of the handle cover installation portion 1210, a third pin installation groove 1214 is formed to have an open front and to be penetrated through the up-down direction.

In the center of the handle unit main body 1220, a first through hole 1221 is formed to be penetrated through the up-down direction. The first through hole 1221 has a shape of a rectangle with rounded corners. The first through hole 1221 is formed large enough to allow a user's hand to be inserted, so that the user can pull the handle unit 1200 by putting a hand in the first through hole 1221. At this time, due to the shape of the first through hole 1221, the user's grip feeling is enhanced.

In the rear surface of the handle unit main body 1220, a wire installation portion 1222 is formed to be protruded rearward. The wire installation portion 1222 is formed to be bent upward or downward after being extended rearward.

The wire installation portion 1222 formed to be bent upward and the wire installation portion 1222 formed to be bent downward are alternately disposed so that installation of the electric wire 20 is easy, and, at the same time, the wire 20 is prevented from being flowed in the up-down direction.

The wire 20 connected to the outside through the wire insertion groove 1801 of the blocking plate 1800, which will be described later, is connected to a second sensor 22 installed in the left rear direction of the handle unit 1200 through the wire installation portion 1222.

In the front direction of the handle unit left side portion 1230, a partition wall is formed, and a circular groove to be penetrated through the front-to-rear direction is formed in the partition wall. The groove is in communication with the extension portion installation groove 1201.

The handle unit left side portion 1230 is formed to be open rearward.

The handle unit left side portion 1230 comprises a first pin installation groove 1231 formed to be penetrated through the up-down direction.

In the right side of the handle unit left side portion 1230, a second sensor installation groove 1232 is formed to be protruded outward. In the left side of the second sensor installation groove 1232, a groove is formed to be protruded rearward, so that the second sensor installation groove 1232 and the extension portion installation groove 1201 are in communication with each other. Due to this, the second sensor 22 installed in the second sensor installation groove 1232 is pressed through the groove by an extension portion 1310, which will be described later.

The right side portion 1240 of the handle unit is formed such that the rear side is inclined further forward as it travels from left to right. Due to this, when the handle unit 1200 is rotated counterclockwise centered around the right side portion 1240 of the handle unit, the blocking plate 1800 installed in the rear surface of the handle unit 1200 and the housing 1100 is prevented from being interfered.

In the left side of the right portion 1240 of the handle unit, a second pin installation groove 1241 is formed to be penetrated through the up-down direction. The handle unit 1200 is connected to the slider 1600 by a second pin 1302 inserted into the second pin installation groove 1241.

<Extension Portion>

An extension portion 1310 is illustrated in detail in FIGS. 8 to 9.

The extension portion 1310 is installed in the left side of the handle unit 1200 so as to be adjustable in length with respect to the first pin 1301.

The extension portion 1310 comprises a head portion 1311 formed in the shape of a cylindrical column with rounded corners, and a length portion 1313 formed in the shape of a cylindrical column in the rear side of the head portion 1311. The length of the diameter of the length portion 1313 is formed to be smaller than the length of one side of the head portion 1311.

The head portion 1311 is formed to be open rearward, and an extension portion return spring insertion groove 1312 is formed between the inner surface of the head portion 1311 and the outer surface of the length portion 1313.

In the rear of the length portion 1313, a second sensor anti-pressing portion 1314 is formed in a way that the left side surface and right side surface thereof are inclined further toward the center of the length portion 1313 as they travel from front to rear. The second sensor 22 is disposed at the right side of one second sensor anti-pressing portion 1314, but it is possible to further enhance the assemblability by forming the second sensor anti-pressing portion 1314 on both left and right sides.

In the rear of the length portion 1313, a slot 1315 is formed to be penetrated through the up-down direction. The slot 1315 is formed long in the left-to-right direction.

An extension portion return spring 1316 is fitted in the outer side of the length portion 1313.

The extension portion 1310 is fitted from front to rear of the handle unit 1200. The rear direction of the extension portion 1310 is blocked by a partition wall formed in the front direction of the left side portion 1230 of the handle unit.

At this time, the front direction of the extension portion return spring 1316 is fitted into the extension portion return spring insertion groove 1312, and the rear direction is blocked by a partition formed in front direction of the left side portion 1230 of the handle unit, and thereby it is compressed and restored in the front-to-rear direction between the extension portion return spring insertion groove 1312 and the partition wall depending on the movement of the handle unit 1200.

After the assembly, the first pin 1301 is fitted into the slot 1315 of the extension portion 1310 protruding rearward of the handle unit 1200 and the first inclined long hole 1601 of the slider 1600. Due to this, the left side portion of the handle unit 1200 is connected to the slider 1600.

At this time, due to the shape of the slot 1315, the first pin 1301 freely slides along the slot 1315 when the handle unit 1200 is rotated. Due to this, the handle unit 1200 can be rotated while keeping the width of the first inclined long hole 1601 constant.

<Pivot Unit>

A pivot unit 1320 is illustrated in detail in FIGS. 8 to 9.

The pivot unit 1320 is installed in the right side of the handle unit 1200 in a way that the rotation axis of the handle unit 1200 can be changed.

The pivot unit 1320 comprises: a rotating shaft 1321 in the shape of a cylindrical column disposed in the up-down direction; a rotating portion 1322 that is formed to be extended rearward from the upper portion and the lower portion of the rotating shaft 1321 with respect to the rotating shaft 1321, a pivot unit return spring installation portion 1325 connecting the upper rotating portion 1322 and the lower rotating portion 1322 to each other, and a reinforcement portion 1326.

The diameter of the central portion of the rotating shaft 1321 is formed smaller than the diameters of the upper and lower portions of the rotating shaft 1321. The rotating shaft 1321 may be detachably assembled to the pivot unit 1320. A pivot unit return spring 1324 is wound on the outer side of the rotating shaft 1321. Due to the shape of the rotating shaft 1321, the pivot unit return spring 1324 will not be separated along the up-down direction.

A groove is formed in the center of the rotating shaft 1321 to be penetrated through the up-down direction. A pivot pin 1327 is inserted into the groove. The length in the height direction of the pivot pin 1327 is formed to be longer than the length in the height direction of the rotating shaft 1321, and after installation, a portion of the upper and lower portions of the pivot pin 1327 is protruded outward of the rotating shaft 1321.

The rotating portion 1322 is formed in the form of a plate being extended in the front-to-rear direction. In the rotating portion 1322, the rear end of the rotating portion 1322 is formed long enough to be in contact with a pivot unit engaging portion 1803 of the blocking plate 1800, which will be described later, when the handle unit 1200 is entered.

In the left side of the rear side of the rotating portion 1322, a second pin engagement prevention groove 1323 is formed concavely. When the left side surface of the rotating portion 1322 is in contact with the inner surface of the pivot unit installation groove 1202 of the handle unit 1200, the second pin 1302 is positioned in the second pin engagement prevention groove 1323.

The pivot unit return spring installation portion 1325 has a shape of a rectangular plate and a wide surface is disposed to be facing the left-to-right direction. The pivot unit return spring installation portion 1325 is disposed behind the rotating shaft 1321.

One side of the pivot unit return spring 1324 is in contact with the rear surface of the handle cover 1400, which will be described later, and the other side is in contact with the right side surface of the pivot unit return spring installation portion 1325. The pivot unit return spring 1324 is wound clockwise centered around the one side. That is, due to the pivot unit return spring 1324, the pivot unit 1320 receives an elastic force in the counterclockwise direction centered around the rotating shaft 1321.

The reinforcement portion 1326 is formed in the form of a rectangular plate and a wide surface is disposed in a way to face the front-to-rear direction. The reinforcement portion 1326 is disposed at the rear direction of the pivot unit return spring installation portion 1325. Due to the reinforcement portion 1326, the pivot unit 1320 can be reduced in weight while maintaining the rigidity.

The pivot unit 1320 is installed from front to rear of the handle unit 1200. The front side of the pivot unit 1320 is then blocked by the handle cover 1400 being installed in the front side of the handle unit 1200, and will not be flowed in the rear side by the pivot pin 1327 whose upper and lower portions are installed in the third pin installation groove 1214 of the handle unit 1200.

<Handle Cover>

Figure 10:
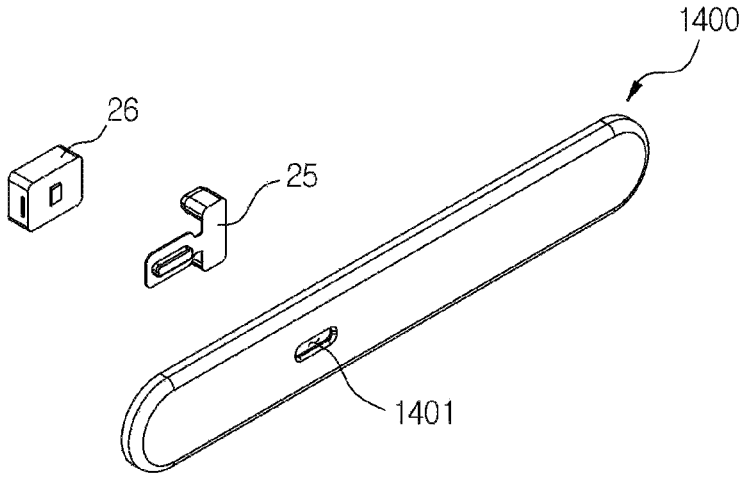
FIG. 10 is a front perspective view of the handle cover of a flush handle for a vehicle door according to a first preferred embodiment of the present invention.
Figure 11:
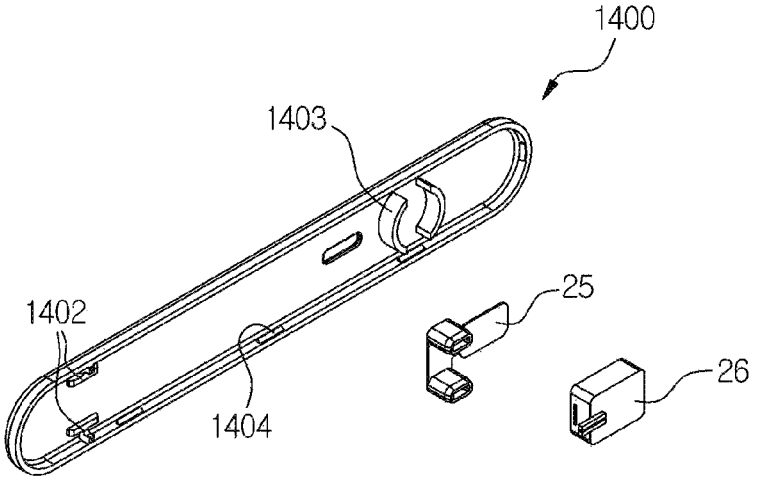
FIG. 11 is a rear perspective view of the handle cover of a flush handle for a vehicle door according to a first preferred embodiment of the present invention.

A handle cover 1400 is illustrated in detail in FIGS. 10 to 11.

The handle cover 1400 has a shape of a rectangle with left and right sides having an arc-shaped left and right sides in accordance with the shape of the handle cover installation portion 1210 of the handle unit 1200. The handle cover 1400 is formed to be open rearward.

In the left side of the handle cover 1400, a button installation groove 1401 is installed to be penetrated through the front-to-rear direction. The button installation groove 1401 is disposed at the front direction of the button sensor installation groove 1211 of the handle unit 1200. A portion of the button 25 is installed so as to be inserted into the button installation groove 1401, and a user can press a portion of the button 25.

In the upper and lower portions of the right side of the handle cover 1400, a third pin support portion 1402 is formed to be protruded rearward.

The third pin support portion 1402 has a shape of a letter 'T'. The end of the vertical side in the letter 'T' is formed to be connected to the inner surface of the handle cover 1400, and the other end is protruded further rearward than the remaining portion, so as to be in contact with the upper and lower portions of the pivot pin 1327. Due to this, the pivot pin 1327 will not be flowed in the forward direction.

In the left side of the handle cover 1400, an extension portion support portion 1403 is formed to be protruded rearward. The rear surface of the extension portion support portion 1403 is in contact with the front surface of the extension portion 1310.

In the top, bottom, left, and right of the handle cover 1400, a handle fastening portion 1404 in the form of a hook is formed to be protruded inward. The handle fastening portion 1404 is formed to be inclined further outward as it travels from front to rear.

When assembling the handle cover 1400, the inclined portion of the handle fastening portion 1404 of the handle cover 1400 pushes the inclined portion of the handle cover fastening portion 1213 of the handle unit 1200 so that the handle cover fastening portion 1213 can be gradually elastically deformed.

<Bumper Member>

Figure 12:
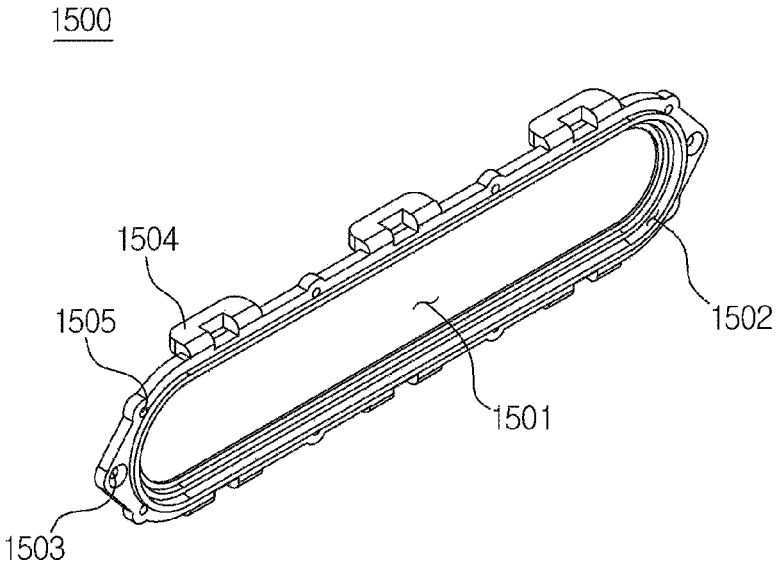
FIG. 12 is a front perspective view of a bumper member of a flush handle for a vehicle door according to a first preferred embodiment of the present invention.

A bumper member 1500 is illustrated in detail in FIG. 12.

In the center portion of the bumper member 1500, a handle through hole 1501 through which the handle unit 1200 and the handle cover 1400 are slid is formed to be penetrated through the front-to-rear direction. The handle through hole 1501 has a shape of a rectangle having an arc-shaped left and right sides in accordance with the shape of the front side of the handle unit 1200 and the shape of the handle cover 1400.

The shape is composed of multiple stages, and the size of the shape increases as it travels from rear to front of the bumper member 1500. Due to this, a handle cover installation groove 1502 has a shape of a step between the handle through hole 1501 formed at the rear direction of the bumper member 1500 and the handle through hole 1501 formed in the front direction. Due to the handle cover installation groove 1502, manual manipulation of the handle unit 1200 becomes easier, and the insertion of a key into the key cylinder 1900 becomes smoother.

The rear direction of the bumper member 1500 is coupled with the front surface of the housing 1100. In the left and right sides of the handle through hole 1501, a first housing fastening portion 1503 capable of fastening bolts is formed. In the upper side and the lower side with respect to the handle through hole 1501, a plurality of second housing fastening portions 1504 is formed. The second housing fastening portion 1504 is formed to be extended rearward, and a groove through which the central portion of the second bumper fastening portion 1114 of the housing 1100 can be inserted is formed to be penetrated through the up-down direction. Between the first housing fastening portion 1503 and the second housing fastening portion 1504, and between the second housing fastening portion 1504 and the second housing fastening portion 1504, a groove wherein the third bumper fastening portion 1115 of the housing 1100 may be inserted is formed to be penetrated through the front-to-rear direction. Due to this, the bumper member 1500 and the housing 1100 may be more firmly coupled.

Due to the bumper member 1500, the housing 1100 is not directly in contact with the door panel and is protected from an external impact, and also performs a function of dust-proofing and waterproofing to prevent contaminants or moisture from entering the housing 1100 from the outside.

<Slider>

Figure 13:
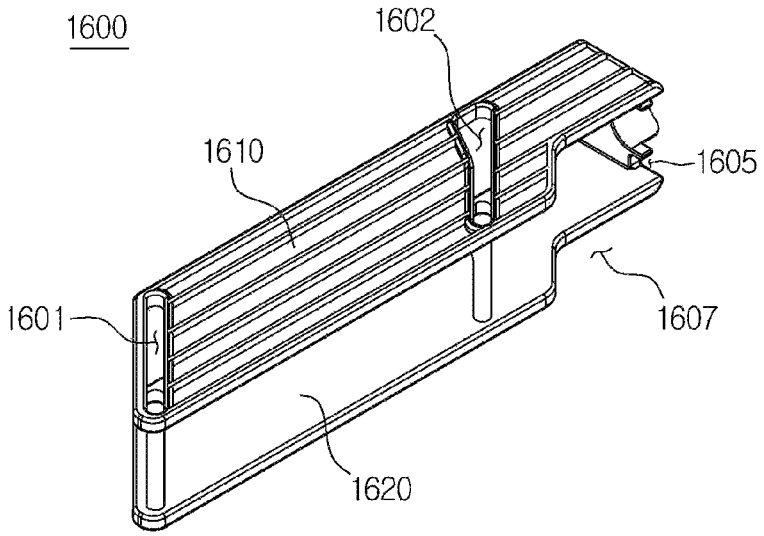
FIG. 13 is a front perspective view of a slider of a flush handle for a vehicle door according to a first preferred embodiment of the present invention.
Figure 14:
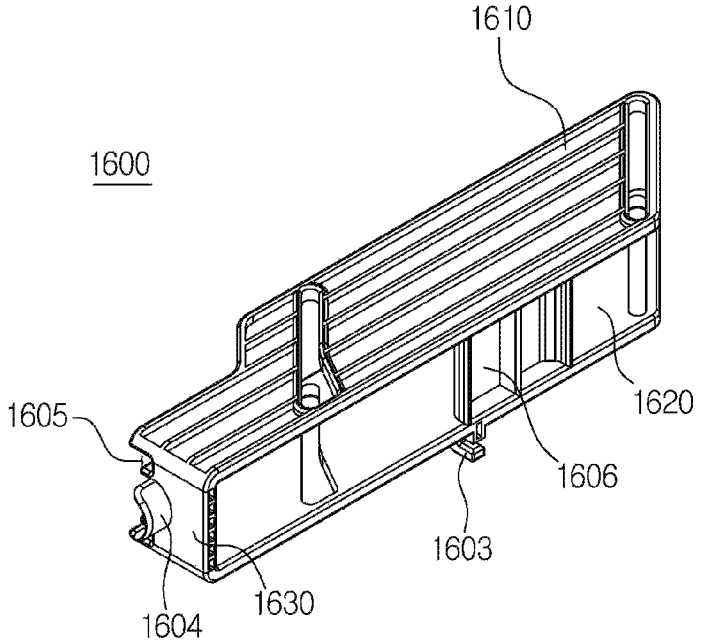
FIG. 14 is a rear perspective view of a slider of a flush handle for a vehicle door according to a first preferred embodiment of the present invention.

A slider 1600 is illustrated in detail in FIGS. 13 to 14.

The slider 1600 comprises an upper surface 1610 and a lower surface 1620 formed to be extended leftward from both upper and lower ends of a right surface 1630 and a right surface 1630. That is, the slider 1600 is formed to be open leftward, forward, and rearward, so that the handle unit 1200 can be accommodated in the space.

The upper surface 1610 and the lower surface 1620 are formed, on the whole, in the form of a rectangular plate. The left side of the upper surface 1610 and the lower surface 1620 is formed to be inclined further rightward as they travel from front to rear, and in the right side, a housing interference prevention portion 1607 is formed to have an open front and right side. The left side surfaces of the housing interference prevention portion 1607 are formed parallel to the left side surfaces of the upper surface 1610 and the lower surface 1620.

Due to this, a space in the left rear direction of the slider 1600 is secured, so that the key cylinder 1900 can be installed. In addition, when the slider 1600 is slid rightward, in the line where the slider 1600 and the housing 1100 are not interfered, the front-to-rear gap of the right side of the housing 1100 can be formed as compact as possible.

The first and second inclined long holes 1601 and 1602 are formed in the up-down directions in the left and right sides of the upper surface 1610 and the lower surface 1620. The first and second inclined long holes 1601 and 1602 are formed parallel to the left side surfaces of the upper surface 1610 and the lower surface 1620.

The first inclined long hole 1601 is formed on the left side of the slider 1600, and the second inclined long hole 1602 is formed on the right side of the slider 1600.

The first inclined long hole 1601 is formed to have the same width from the front direction up to the rear direction. The width is formed similar to or slightly larger than the size of the diameter of the first pin 1301.

The second inclined long hole 1602 comprises an entry portion formed in the rear direction of the second inclined long hole 1602 and a withdrawal portion formed in the front direction of the second inclined long hole 1602.

The width of the withdrawal portion is similar to or slightly larger than the diameter of the second pin 1302.

The left side surface of the second inclined long hole 1602 is formed to be inclined leftward as it travels from middle portion to rear, and the width of the entry portion is gradually widened as it travels from front to rear. The rear surface of the second inclined long hole 1602 is formed parallel to the rear surface of the slider 1600.

Due to this, the second pin 1302 inserted into the second inclined long hole 1602 can be moved within the second inclined long hole 1602, without moving the slider 1600 when the handle unit 1200 is rotated centered around the rotation axis 1321 of the pivot unit 1320.

In the rear direction of the lower surface 1620, a door latch connection portion installation portion 1603 is formed to be protruded downward. The door latch connection portion installation portion 1603 has a shape of a letter '⊏', and a concave portion of the letter '⊏' is formed rearward. The door latch connection portion installation portion 1603 is disposed to be inserted into the right side of the door latch connection portion penetrating groove 1104 of the housing 1100.

In the rear of the upper surface 1610 and the lower surface 1620, a reinforcement portion 1606 is formed in the form of connecting the upper surface 1610 and the lower surface 1620. The reinforcement portion 1606 is formed on the upper portion of the door latch connection portion installation portion 1603. Due to the reinforcement portion 1606, the rigidity of the slider 1600 is enhanced.

The right surface 1630 is formed, on the whole, in the shape of a rectangular plate. The right surface 1630 comprises a slider return spring fitting portion 1604 formed to be protruded rearward, and a moving nut insertion groove 1605, in the shape of a letter '⊏' having an open front and to be penetrated through the left-to-right direction, in the upper portion and the lower portion of the slider return spring fitting portion 1604.

The slider return spring fitting portion 1604 has a shape of an arc in which a concave portion is formed forward. Inner side of the slider return spring fitting portion 1604, a lead screw 1724, which will be described later, is disposed, and a slider return spring 1730 is fitted to the outer side of the slider return spring fitting portion 1604. That is, the slider return spring fitting portion 1604 is disposed between the lead screw 1724 and the slider return spring 1730. The inner side diameter of the slider return spring fitting portion 1604 is formed to be the same as and similar to the outer side diameter of the moving nut 1750 fitted to the lead screw 1724, and thereby the slider return spring fitting portion 1604 and the lead screw 1724 are not in contact with each other.

The inner surface of the lower portion of the moving nut insertion groove 1605 formed in the upper portion is in contact with the third guide portion 1106 of the housing 1100, and thereby guided by the third guide portion 1106, and the inner surface of the upper portion is formed to be spaced apart from the third guide portion 1106 by a predetermined interval. The moving nut insertion groove 1605 formed in the lower portion is formed symmetrically with respect to the moving nut insertion groove 1605 and the slider return spring fitting portion 1604 formed in the upper portion.

Due to this, a space in which the moving nut 1750 can be installed is formed between the moving nut insertion groove 1605 and the third guide portion 1106. After the moving nut 1750 is installed, the inner surface of the moving nut 1750 and the outer surface of the third guide portion 1106 are in contact with each other.

<Driving Unit>

Figure 15:
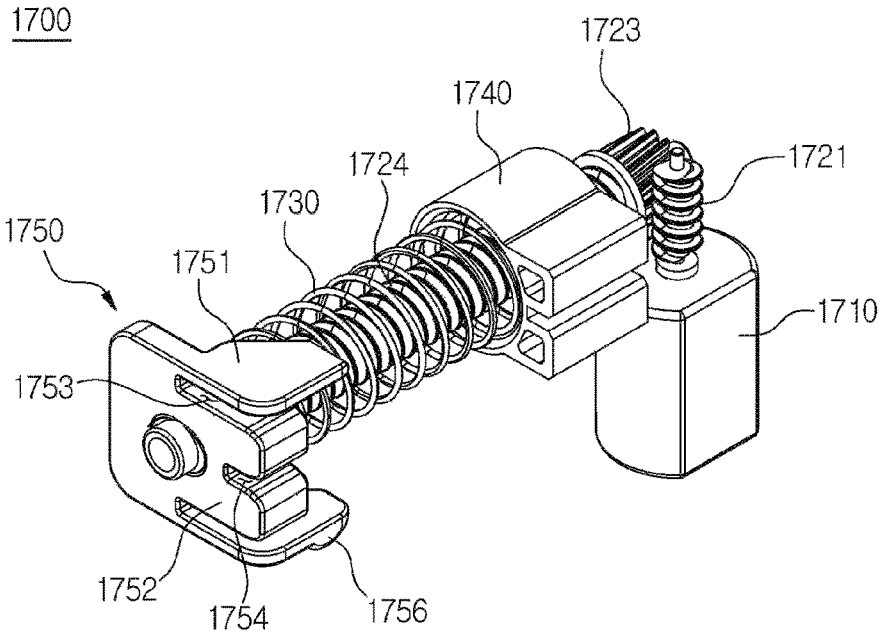
FIG. 15 is a front perspective view of a driving unit of a flush handle for a vehicle door according to a first preferred embodiment of the present invention.
Figure 16:
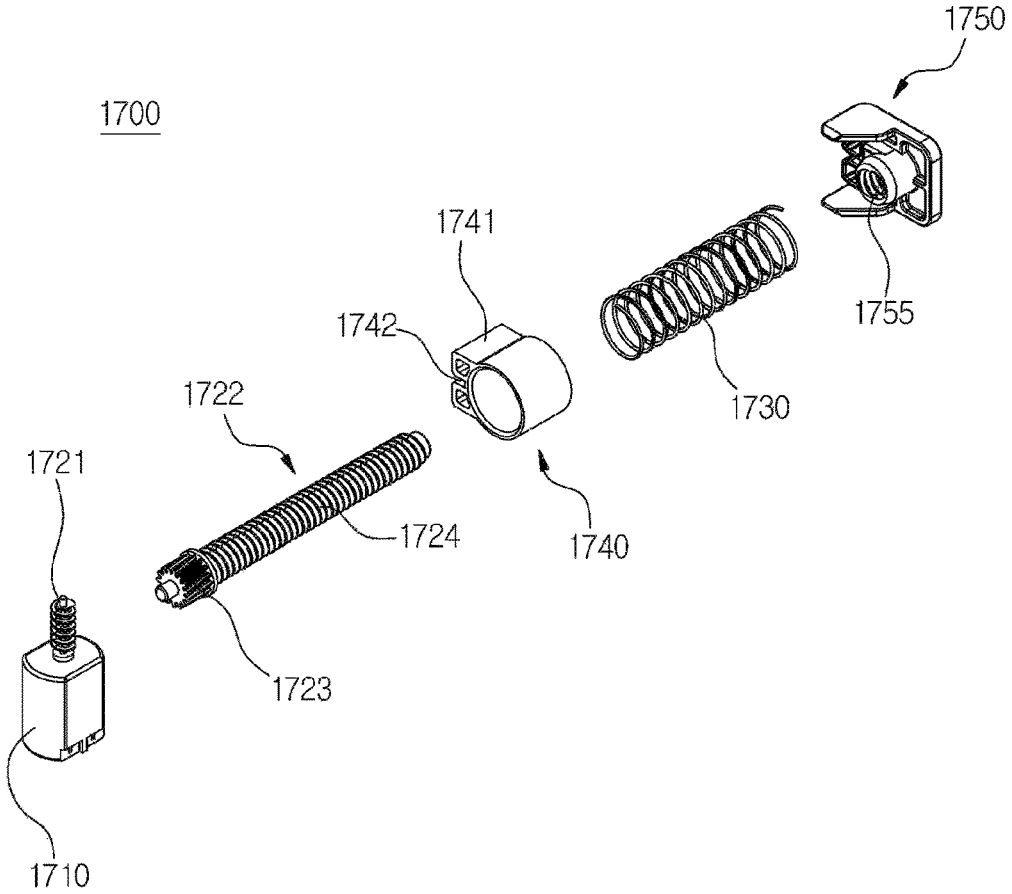
FIG. 16 is a rear exploded perspective view of a driving unit of a flush handle for a vehicle door according to a first preferred embodiment of the present invention.

A driving unit 1700 is illustrated in detail in FIGS. 15 to 16.

The driving unit 1700 comprises a power delivery unit, a worm 1721 rotated by the power delivery unit, a double gear 1722 rotated by the worm 1721, a moving nut 1750 being slid in the left-to-right direction by the double gear 1722 and the housing 1100.

The power delivery unit may be provided with a motor 1710.

The driving unit 1700 is disposed at the right side of the housing 1100.

The motor 1710 is installed in the housing 1100 in an up-down direction.

The motor 1710 is operated or stopped by a control unit (not shown).

A worm 1721 is installed in the shaft of the motor 1710.

The double gear 1722 comprises a worm wheel 1723 and a lead screw 1724 disposed at the left side of the worm wheel 1723. The worm wheel 1723 and the lead screw 1724 are connected by a single shaft and thereby rotated at the same time. Between the worm wheel 1723 and the lead screw 1724, a disc whose one surface is connected to the worm wheel 1723, and the other surface is connected to the lead screw 1724 is formed The worm 1721 is teeth-coupled with the worm wheel 1723. The double gear 1722 is disposed at the left-to-right direction in the rear direction of the worm 1721.

A slider return spring 1730 is installed on the outer side of the lead screw 1724. After assembly is completed, one side of the slider return spring 1730 is installed in the slider return spring fitting portion 1604 of the slider 1600, and the other side of the slider return spring 1730 is in contact with the left side surface of the lead screw penetrating portion 1132.

In the outer side of the slider return spring 1730, a bumper 1740 is installed.

The bumper 1740 is formed, on the whole, in the shape of a circular pipe. The bumper 1740 is disposed in the left-to-right direction.

In the front direction of the bumper 1740, guide portions 1741 formed to be protruded forward are formed at upper and lower portions, respectively.

The guide portion 1741 has a shape of a rectangular pipe. The guide portion 1741 is disposed in the left-to-right direction.

The upper guide portion 1741 and the lower guide portion 1741 are spaced apart from each other. That is, a housing insertion groove 1742 is formed between the two guide portions 1741.

The bumper 1740 is installed in the bumper installation groove 1136 of the housing 1100. The third guide portion 1106 formed in the middle is inserted into the housing insertion groove 1742. The upper surface of the upper portion guide portion 1741 is in contact with the lower surface of the third guide portion 1106 formed in the upper portion, and the lower surface of the lower portion guide portion 1741 is in contact with the upper surface of the third guide portion 1106 formed in the lower portion. That is, the bumper 1740 is disposed between the third guide portions 1106, and thereby it does not flow in the up-down direction. The bumper 1740 does not flow in the left-to-right direction over a certain range due to the shape of the third guide portion 1106.

Due to the bumper 1740, the slider return spring 1730 cannot be moved in the up-down and in the front-to-rear direction by a predetermined amount, and noise, vibration, and the like generated when the slider return spring 1730 is operated are absorbed.

The moving nut 1750 is formed, on the whole, in the shape of a rectangular plate.

The moving nut 1750 is disposed such that the wide surface thereof is disposed facing the left-to-right direction.

The central portion of the moving nut 1750 comprises: a second housing insertion groove 1754 formed to have an open front and to be penetrated through the left-to-right direction; a second guide portion 1752 formed in the upper and lower portions of the second housing insertion groove 1754; a first housing insertion groove 1753 formed to have an open front and to be penetrated through the left-to-right direction in the upper and the lower portions of the second guide portion 1752; and a first guide portion 1751 formed to be protruded rightward in the upper and the lower portions of the first housing insertion groove 1753.

The depth of the first housing insertion groove 1753 in the front-to-rear direction is formed to be deeper than the depth of the second housing insertion groove 1754 in the front-to-rear direction.

The third guide portion 1106 of the housing 1100 is inserted into the first housing insertion groove 1753 and the second housing insertion groove 1754.

The rear surface of the first guide portion 1751 is formed to be inclined leftward as it travels from front to rear, so that it can be more easily inserted into the moving nut 1750 when the slider 1600 is sliding in the left-to-right direction.

In addition, the moving nut 1750 comprises a lead screw insert portion 1755 formed to be protruded rightward from the central portion.

A female screw portion is formed in the lead screw insert portion 1755 to be penetrated through the left-to-right direction. A lead screw 1724 is fitted to the female screw portion.

When the lead screw 1724 is rotated, the moving nut 1750, since one side is inserted into the housing 1100, is slid in the left-to-right direction along the third guide portion 1106.

The moving nut 1750 is disposed at the left side of the slider 1600 than the right surface 1630. Therefore, when the moving nut 1750 is moved rightward, the slider 1600 is pushed rightward by the moving nut 1750, and when the moving nut 1750 is moved leftward, the slider 1600 is pushed leftward by the slider return spring 1730.

In the first guide portion 1751 formed in the lower portion, the third sensor pressing portion 1756 is formed to be protruded downward. The third sensor pressing portion 1756 is protruded sufficiently to push the upper portions of the third sensors 23*a* and 23*b* when the moving nut 1750 is slid in the left-to-right direction.

The moving nut 1750 is disposed in the slider 1600 in a way that the third sensor pressing portion 1756 is disposed further at front direction than the front surface of the slider 1600. Due to this, the interference between the slider 1600 and the third sensor pressing portion 1756 is prevented when the slider 1600 is slid in the left-to-right direction separately from the moving nut 1750.

<Blocking Plate>

The housing 1100 comprises a blocking plate 1800 coupled to the rear direction of the housing 1100.

Figure 17:
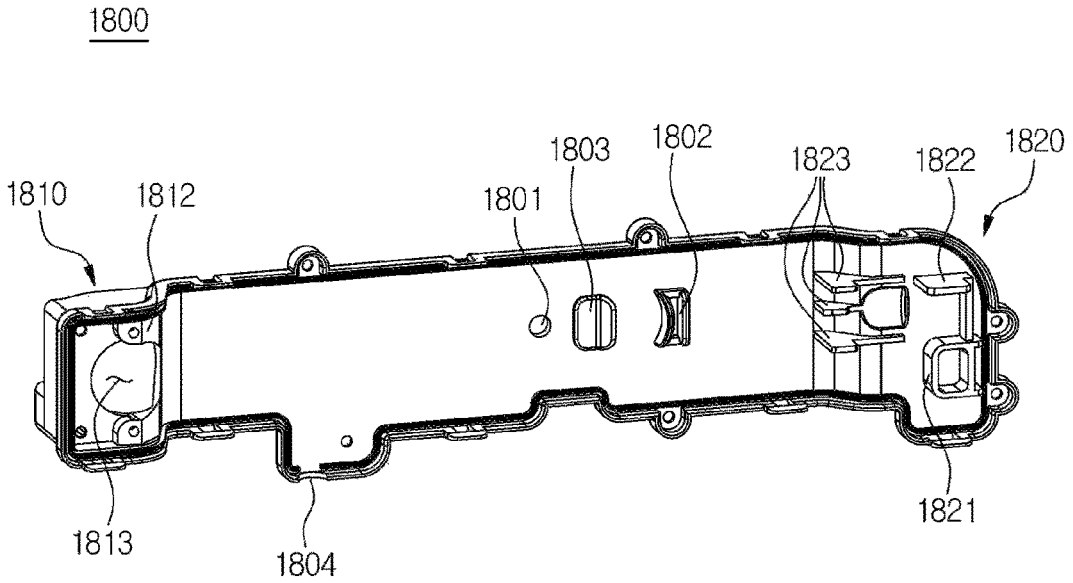
FIG. 17 is a front perspective view of a blocking plate of a flush handle for a vehicle door according to a first preferred embodiment of the present invention.
Figure 18:
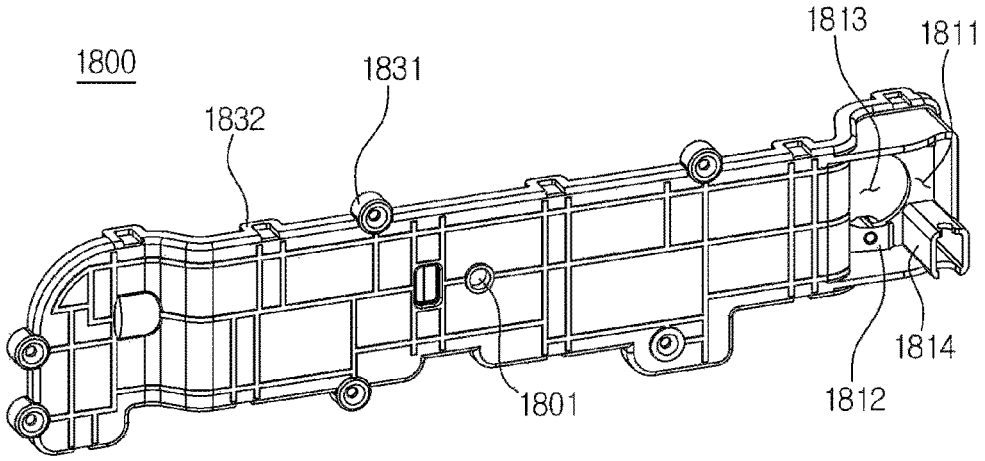
FIG. 18 is a rear perspective view of a blocking plate of a flush handle for a vehicle door according to a first preferred embodiment of the present invention.

The blocking plate 1800 is illustrated in detail in FIGS. 17 to 18.

The blocking plate 1800 is formed, on the whole, in the shape of a cuboid having an open front. That is, it is composed of a rear surface portion and a circumferential portion formed to be protruded forward from the circumference of the rear surface portion.

The shape of the blocking plate 1800 is formed, on the whole, along the shape of the housing 1100.

The left side portion 1810 and the right side portion 1820 of the blocking plate 1800 are formed to be protruded further forward than the central portion of the blocking plate 1800.

In the center of the blocking plate 1800, a wire insertion groove 1801 is formed to be penetrated through the front-to-rear direction. A portion of the electric wire 20 is connected to the inside of the housing 1100 through the wire insertion groove 1801.

In the center of the blocking plate 1800, a housing support portion 1802 and a pivot unit engaging portion 1803 are formed to be protruded forward.

The pivot unit engaging portion 1803 is disposed at the right side than the wire insertion groove 1801, and the housing support portion 1802 is disposed at the right side than the pivot unit engaging portion 1803.

The left side of the housing support portion 1802 is protruded in the shape of an arc formed with a concave left side, and the right side of the housing support portion 1802 protruded in the shape of a straight line formed in the up-down direction. Due to this shape, the lead screw installation portion 1135 of the housing 1100 may be inserted into the housing support portion 1802. For this reason, the lead screw installation portion 1135 can more firmly support the lead screw 1724.

The right side of the pivot unit engaging portion 1803 is formed to be inclined forward as it travels from left to right. Due to this inclined portion, even if a user presses the right side of the handle unit 1200 and the pivot unit 1320 receives a force, the pivot unit 1320 is not pushed rightward beyond the pivot unit engaging portion 1803. In addition, since the pivot unit return spring 1324 installed in the pivot unit 1320 receives an elastic force in the counterclockwise direction, the pivot unit 1320 is not moved rightward of the pivot unit engaging portion 1803 even when it is not in contact with the pivot unit engaging portion 1803.

In the lower left of the blocking plate 1800, a door latch connection portion penetrating groove 1804 is formed to be open forward and to be penetrated through the up-down direction, and thereby a portion of the door latch connection portion 30 is installed.

The door latch connection portion penetrating groove 1804 is disposed at the rear direction of the door latch door latch connection portion penetrating groove 1104 of the housing 1100.

In the left side portion 1810, a key cylinder installation groove 1811 is formed to be open rearward.

In the upper and lower portions of the key cylinder installation groove 1811, a key cylinder fastening portion 1812 is formed. In the key cylinder fastening portion 1812, a groove through which a bolt can be inserted is formed to be penetrated through the front-to-rear direction, so that the key cylinder 1900 can be bolt-coupled to the key cylinder fastening portion 1812 and installed therein.

The right side of the key cylinder installation groove 1811 and the key cylinder fastening portion 1812 are formed inclined rightward as it travels from front to rear, so that the key cylinder 1900 is also installed inclined rightward as it travels from front to rear. Due to this, when the left side of the handle unit 1200 is pulled forward, the gap between the handle unit 1200 and the bumper member 1500 needed for a user for operating the key cylinder 1900 can be minimized.

Between the two key cylinder fastening portions 1812, a key cylinder penetrating groove 1813 is formed to be penetrated through the front-to-rear direction. The key cylinder penetrating groove 1813 has a shape of a circle.

The front direction of the key cylinder 1900 is inserted into the housing 1100 through the key cylinder penetrating groove 1813. Due to this, when the left side of the handle unit 1200 is lifted forward to expose the inside of the housing 1100, the key cylinder 1900 can be operated.

In the lower left end of the inside of the key cylinder installation groove 1811, a door key connection portion installation portion 1814 is formed to be protruded rearward. The door key connection portion installation portion 1814 is formed in a rectangular pipe shape. In the door key connection portion installation portion 1814, a groove is formed to be open rearward and to be penetrated through the up-down direction, a portion of the door key connection portion 50, which will be described later, is installed in the groove.

In the right portion 1820, a motor support portion 1821, a motor shaft support portion 1822, and a bumper support portion 1823 are formed to be protruded forward.

The motor support portion 1821 is formed in the lower right portion of the right side portion 1820.

The motor support portion 1821 has a shape of a rectangular pipe with rounded corners. Due to this, the motor support portion 1821 is reduced more in weight.

The front surface of the motor support 1821 is in contact with the rear surface of the motor 1710 installed in the housing 1100. Due to this, the motor 1710 is not flowed rearward.

The motor shaft support portion 1822 is formed in the form of a rectangular plate with the wider surface thereof is facing the up-down direction.

The motor shaft support portion 1822 is disposed at the upper portion of the motor support portion 1821.

The front surface of the motor shaft support portion 1822 is in contact with the rear surface of the first motor shaft installation portion 1123 of the housing 1100. Due to this, the shaft of the motor 1710 is not flowed rearward.

The bumper support portion 1823 is formed in the form of a plate whose left side is protruded further forward than the right side.

The bumper support portion 1823 is disposed at the left side of the motor support portion 1821 and the motor shaft support portion 1822.

The front surface of the left side of the bumper support portion 1823 is in contact with the rear surface of the third guide portion 1106 of the housing 1100, and the front surface of the right side of the bumper support portion 1923 is in contact with the rear surface of the bumper 1740 installed in the housing 1100. Due to this, the bumper 1740 is not flowed rearward and leftward.

In the circumferential portion of the blocking plate 1800, a first fastening portion 1831 and a second fastening portion 1832 coupled with the housing 1100 are formed.

The first fastening portion 1831 is formed comprising a groove through which the bolt can be inserted from rear to front.

A portion of the first fastening portion 1831 is formed protruded outward in the right side surface, the upper side surface, and the lower side surface of the circumferential portion of the blocking plate 1800; a remaining portion of the first fastening portion 1831 is formed to be protruded rearward in the left side of the blocking plate 1800; and the rest of the first fastening portion 1831 is formed to be penetrated through the front-to-rear direction in the left side lower portion.

In the upper and lower side surfaces of the circumferential portion of the blocking plate 1800, the second fastening portion 1832 is formed to be protruded forward. In the central portion of the second fastening portion 1832, a groove to be penetrated through the up-down direction is formed, and thereby a second fastening portion 1152 of the housing 1100 is inserted into the groove.

Due to this, the blocking plate 1800 and the housing 1100 can be more firmly coupled. In addition, a sealing member 1850 is inserted between the front surface of the blocking plate 1800 and the rear surface of the housing 1100. The sealing member 1850 may fill the gap between the blocking plate 1800 and the housing 1100 and may perform the role of waterproofing and dust proofing.

<Connection Portion>

A door latch connection portion 30 is illustrated in detail in FIGS. 5 and 31 to 37.

One end of the door latch connection portion 30 is connected to the slider 1600 and the other end is connected to the motorized latch unit 2000.

Figure 31:
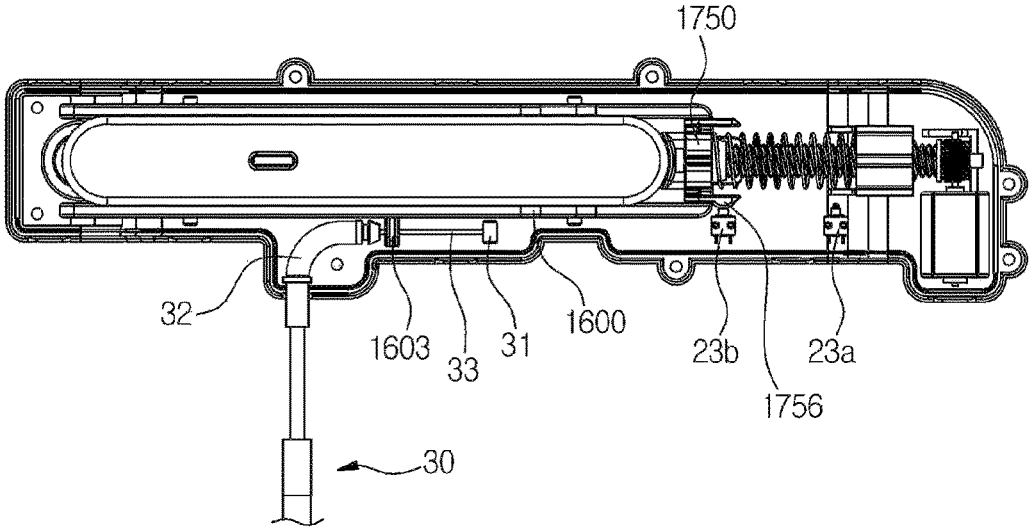
FIG. 31 is a front view of a flush handle for a vehicle door according to the first preferred embodiment of the present invention in a state of being entered (excluding the housing).

As illustrated in FIG. 31, the door latch connection portion 30 comprises a cable 33 and a tube 32 surrounding the cable 33, thereby forming an engagement protrusion 31 in one end of the cable 33.

The cable 33 is installed in the door latch connection portion installation portion 1603 of the slider 1600, so that an engaging protrusion 31 is located further in the right side than the door latch connection portion installation portion 1603.

Since the width of the groove of the door latch connection portion installation portion 1603 is formed to be larger than the diameter of the cable 33 and smaller than the diameter of the door latch connection portion 30, the engagement protrusion 31 is pulled to the right side or returned to its original state by the door latch connection portion installation portion 1603.

A groove is formed in the circumference of the one side of the tube 32, and by inserting the groove into the groove of the second guide portion 1105 of the housing 1100, the tube 32 is fixed to the housing 1100. Due to this, when the slider 1600 is slid, only the cable 33 installed inside the tube 32 is moved while the tube 32 remains still.

In the other end of the cable 33, a stopper (not shown) of the motorized latch unit 2000 is formed.

Figure 32:
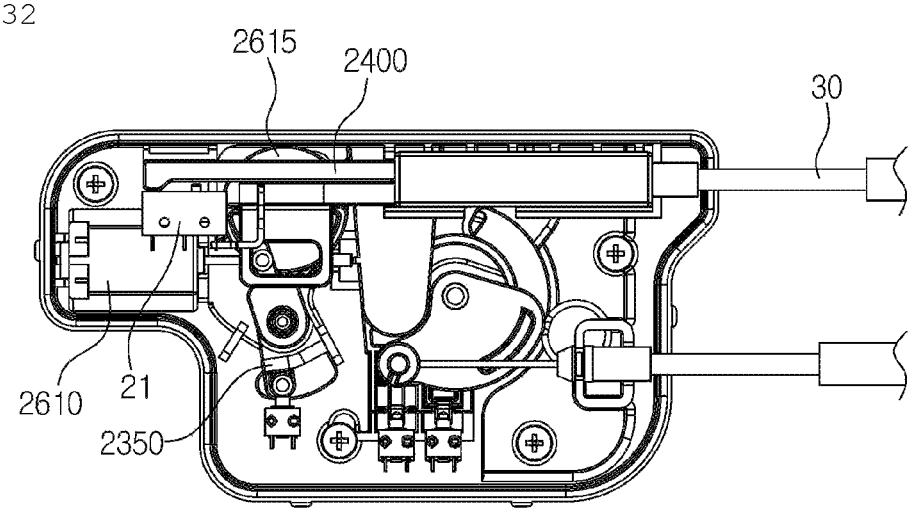
FIG. 32 is a right side view of a latch of a flush handle for a vehicle door according to a first preferred embodiment of the present invention in a state of being entered.
Figure 33:
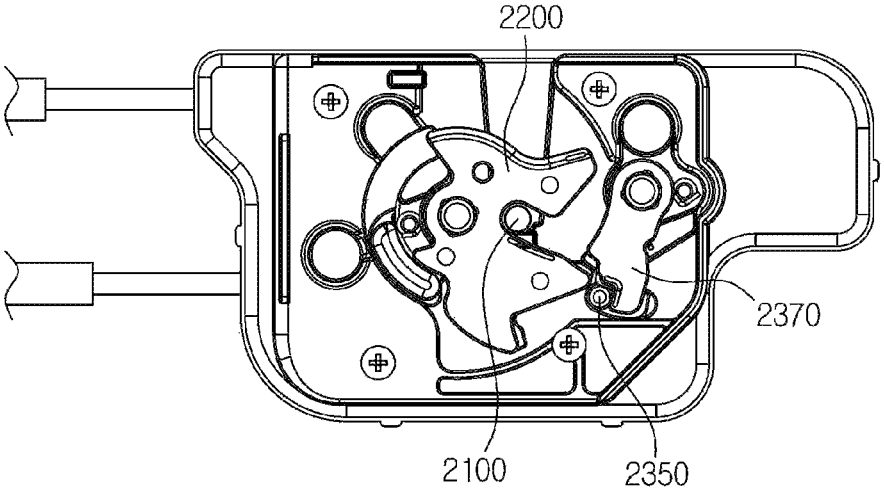
FIG. 33 is a left side view of a latch of a flush handle for a vehicle door according to a first preferred embodiment of the present invention in a state of being entered.

The stopper is connected to a safety plate 2400, as illustrated in FIG. 32. When the cable 33 is pulled or returned to its original state, also the safety plate 2400 is slid accordingly.

When one side of the safety plate 2400 is pulled along the door latch connection portion 30, the safety plate 2400 is separated from a lock member 2615 and the rotation of the lock member 2615 becomes possible, and the first sensor 21 is pressed by the safety plate 2400 so that power is applied to the motor 2610, and thereby the operation of the motor 2610 becomes possible. That is, the motorized latch unit 2000 is unlocked.

Figure 35:
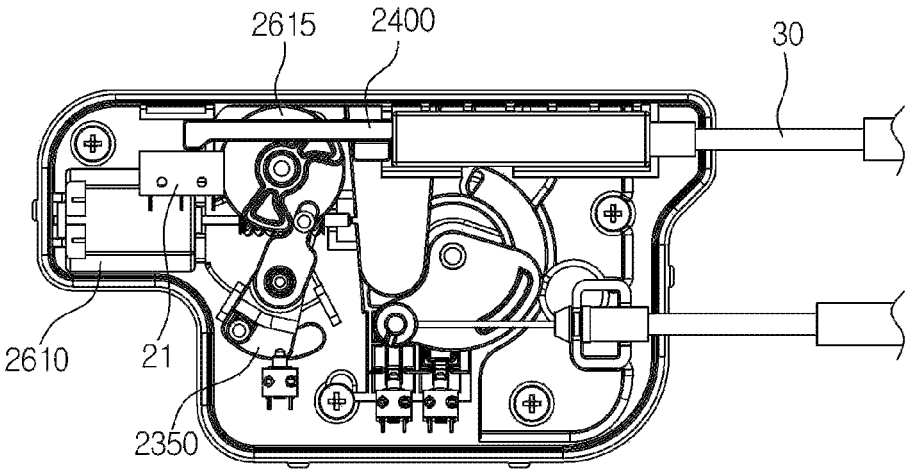
FIG. 35 is a right side view of a latch of a flush handle for a vehicle door according to a first preferred embodiment of the present invention in a state being withdrawn motorizedly.

At this time, when an operation command is issued to the motor 2610 due to the pressing of a specific sensor, operation of the remote control, and the like, the motor 2610 is operating, and the locking member 2615 teeth-coupled with the worm installed on the shaft of the motor 2610 is rotating, and the open lever 2350 inserted in the locking member 2615 is rotating. That is, it becomes the state as illustrated in FIG. 35.

Figure 36:
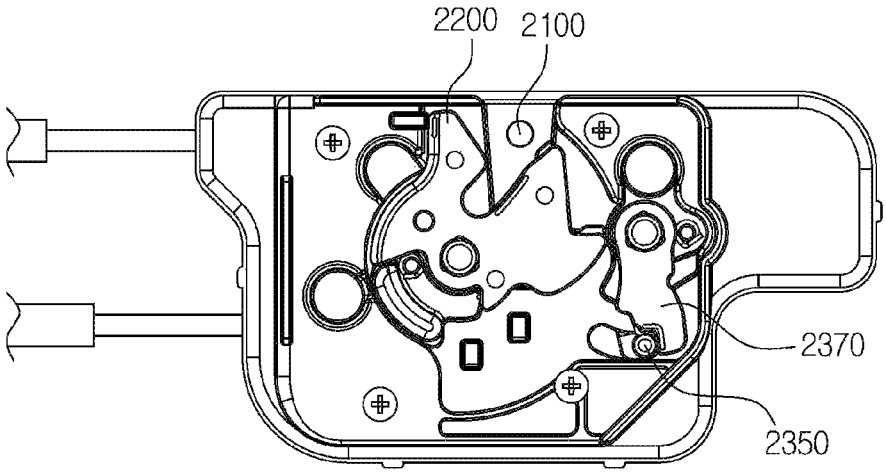
FIG. 36 is a left side view of a latch a flush handle for a vehicle door according to a first preferred embodiment of the present invention in a state in which a motorized door open function is activated after withdrawn motorizedly.

When the open lever 2350 is rotated, the open lever 2350 is rotated the pivoting member 2370 engaged with the latch 2200 so that the pivoting member 2370 is separated from the latch 2200. Due to this, when the latch 2200 is rotating by the restoring force of a spring (not shown) installed in the latch 2200, the striker 2100 of the vehicle body engaged by the latch 2200 releases the latch 2200, and the door panel will be opened. That is, it becomes the state as illustrated in FIG. 36.

Figure 5:
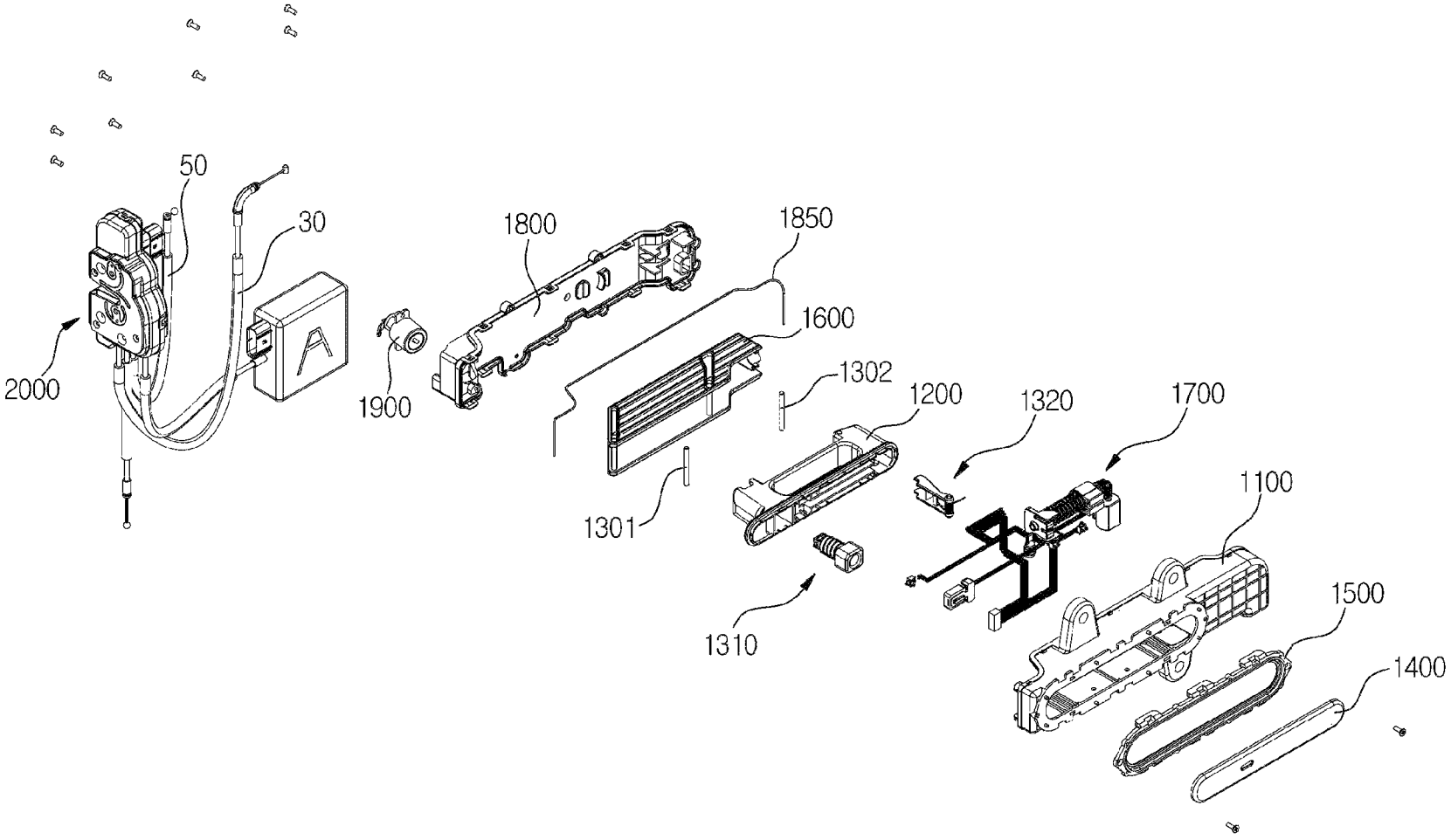
FIG. 5 is a front exploded perspective view of a flush handle for a vehicle door according to a first preferred embodiment of the present invention.

The door key connection portion 50 is illustrated in FIG. 5.

The door key connection portion 50 has the same shape and operation principle as the door latch connection portion 30. However, one end of the door key connection portion 50 is connected to the key cylinder 1900, and when the key cylinder 1900 is rotated clockwise or counterclockwise by the key, it is pulled upward or returned to its original state accordingly. In addition, the other end of the door key connection portion 50 is connected to an open plate (not shown) interlocked with the open lever 2350, so that the latch 2200 can be unlocked by manually rotating the open lever 2350.

Hereinafter, a method of operating a flush handle for a vehicle door according to a first embodiment of the present invention having the above-described configuration will be described.

<Manual Operation Process>

Hereinafter, a process in which the handle unit 1200 is manually operated will be described.

Figure 1:
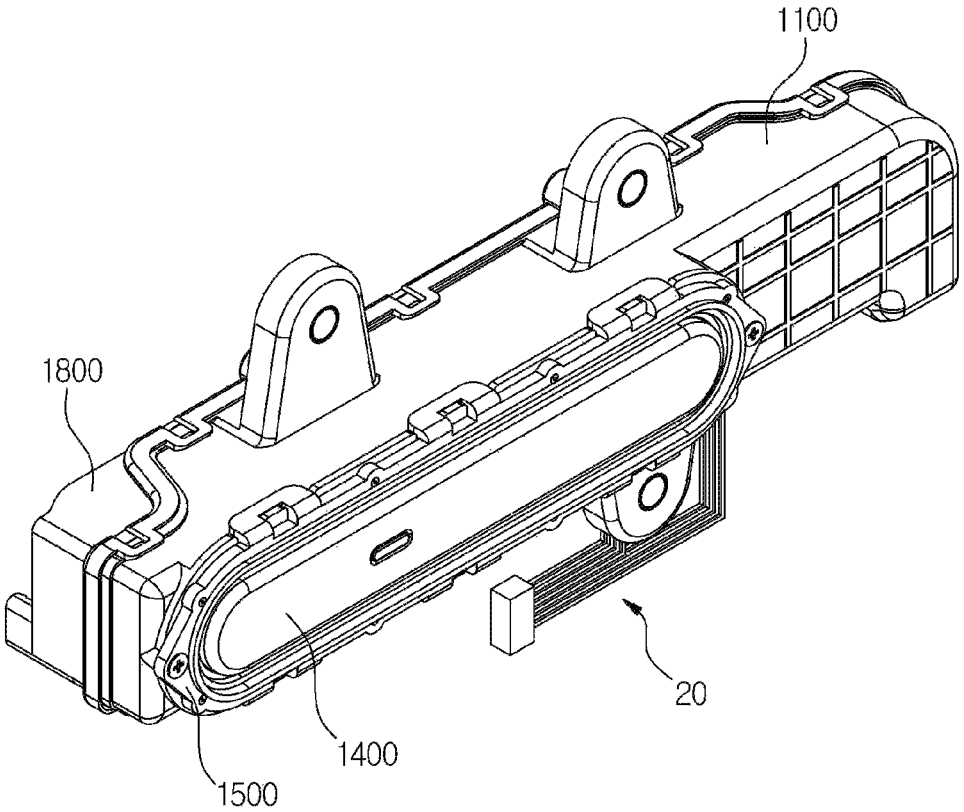
FIG. 1 is a front perspective view of a flush handle for a vehicle door according to a first preferred embodiment of the present invention.
Figure 19:
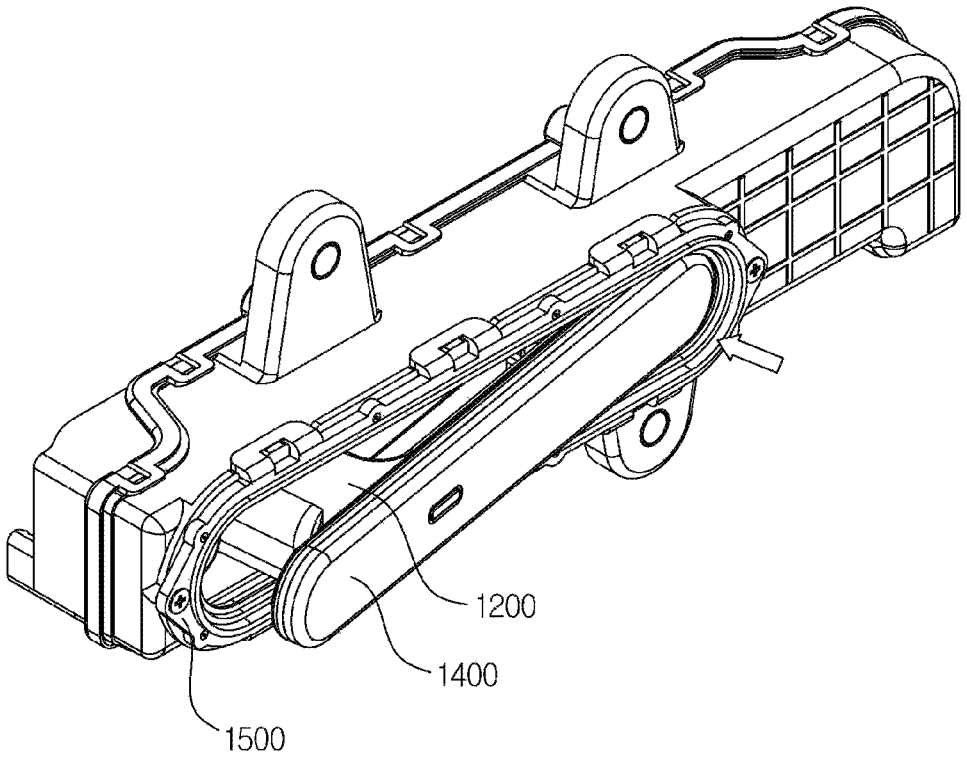
FIG. 19 is a front perspective view of a flush handle for a vehicle door according to a first preferred embodiment of the present invention in a state where the handle is lifted.

As illustrated in FIG. 1, when a user presses the right side of the handle unit 1200 from the front direction rearward while the handle unit 1200 is entered, as illustrated in FIG. 19, the left side of the handle unit 1200 is rotated forward centered around the right side of the handle unit 1200.

Figure 20:
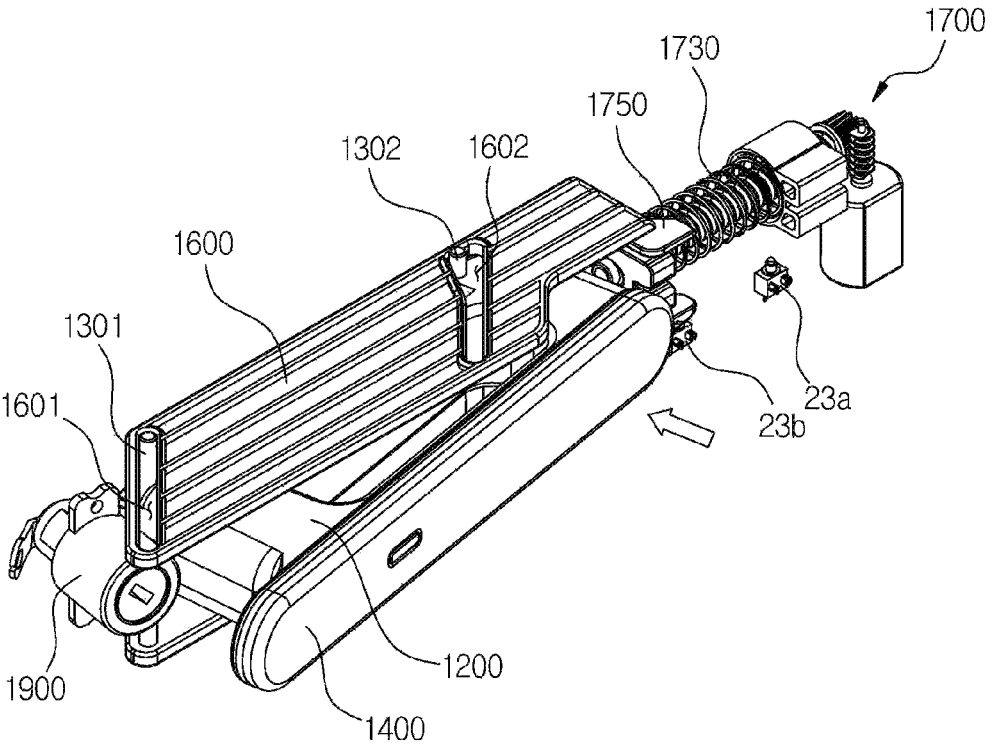
FIG. 20 is a front perspective view of a flush handle for a vehicle door according to a first preferred embodiment of the present invention in a state where the handle is being lifted (excluding the housing and blocking plate).

Due to this, the inside of the housing 1100 is exposed to the left rear direction of the handle unit 1200. In the left rear direction of the handle unit 1200, a key cylinder 1900 is installed as illustrated in FIG. 20.

In this state, a user can operate the key cylinder 1900 by inserting a key between the handle unit 1200 and the bumper member 1500.

Figure 21:
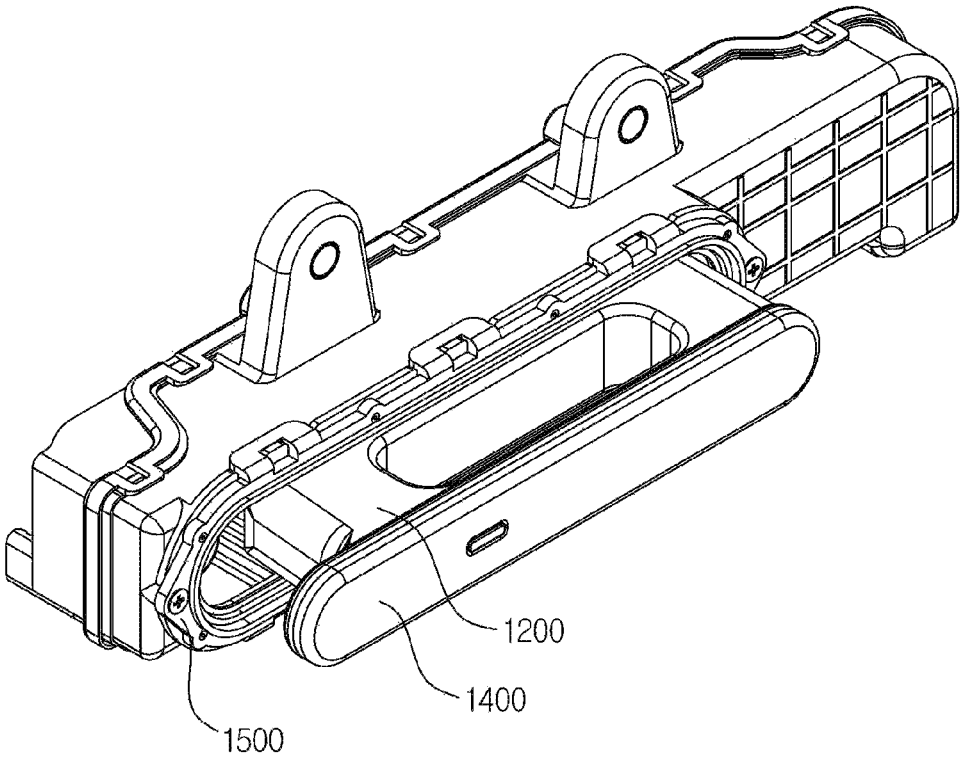
FIG. 21 is a front perspective view of a flush handle for a vehicle door according to a first preferred embodiment of the present invention in a state of being withdrawn.

To further secure a space for inserting the key, the user may pull the handle unit 1200 protruded forward. When the handle unit 1200 is pulled forward sufficiently, as illustrated in FIG. 21, the handle unit 1200 is withdrawn in a horizontal state in the left-to-right direction.

In this state, the user may operate the key cylinder 1900 by inserting a key between the handle unit 1200 and the bumper member 1500.

Figure 22:
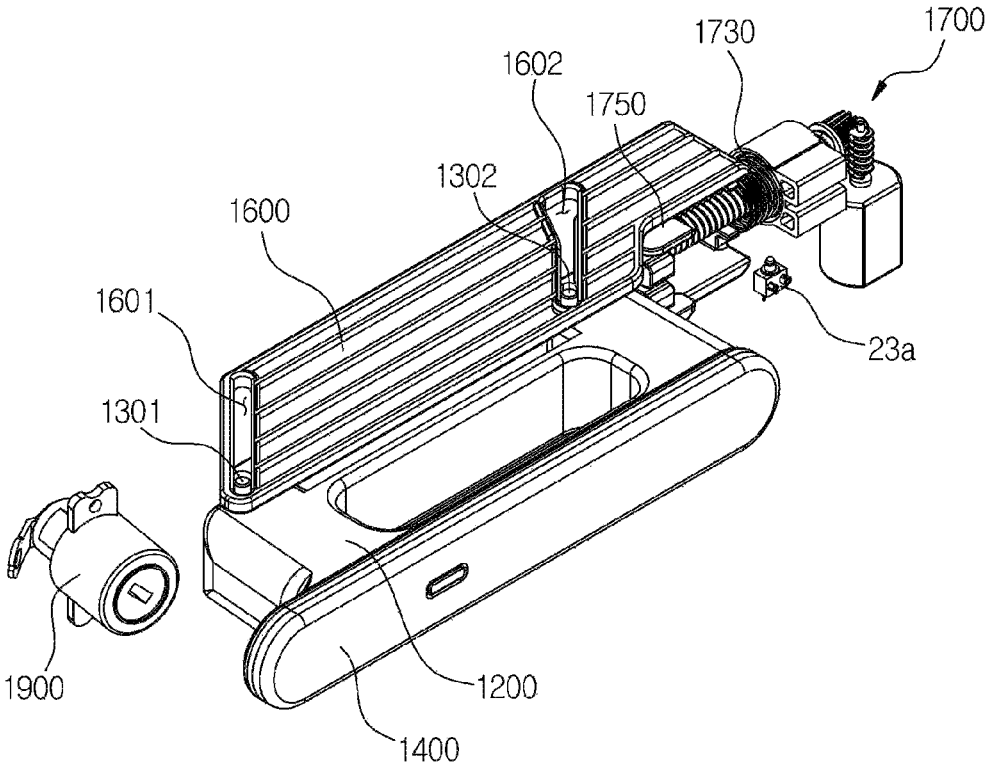
FIG. 22 is a front perspective view of a flush handle for a vehicle door according to a first preferred embodiment of the present invention in a state of being withdrawn manually (excluding the housing and blocking plate).

When the handle unit 1200 is manually withdrawn as described above, as illustrated in FIG. 22, the slider return spring 1730 is compressed rightward by the slider 1600, and the position of the moving nut 1750 is maintained.

Thereafter, when the user releases the handle unit 1200, the handle unit 1200 is returned to the original state by the slider return spring 1730.

<Manual Withdrawal and Entry Process>

Hereinafter, the manual withdrawal and entry process of the handle unit 1200 will be described in detail with reference to a cross-sectional view.

Figure 26:
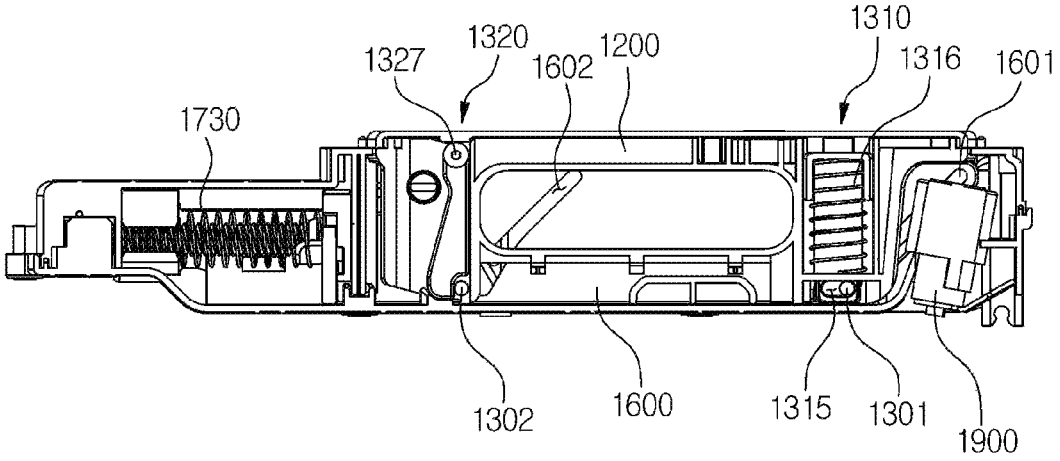
FIG. 26 is a cross-sectional view of a flush handle for a vehicle door according to a first preferred embodiment of the present invention in a state of being entered.
Figure 27:
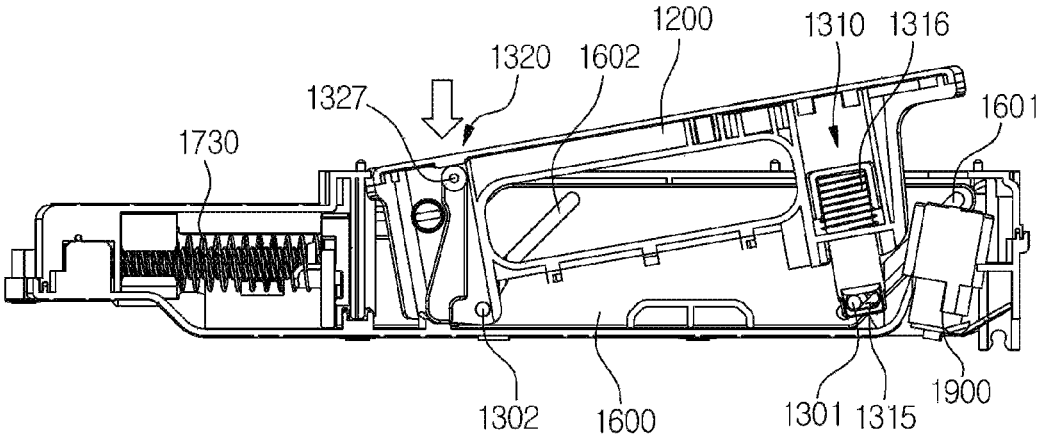
FIG. 27 is a cross-sectional view of a flush handle for a vehicle door according to a first preferred embodiment of the present invention in a state where the handle is being lifted.
Figure 28:
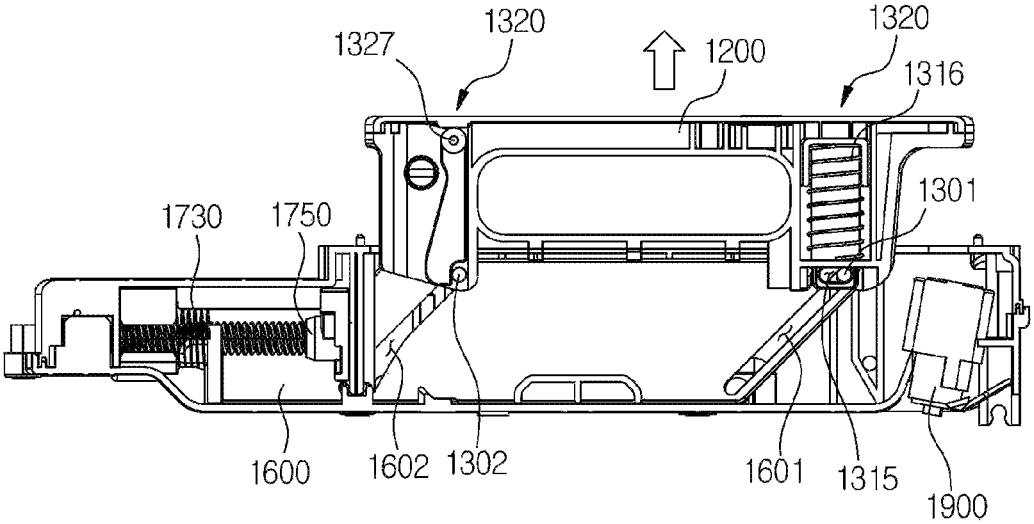
FIG. 28 is a cross-sectional view of a flush handle for a vehicle door according to a first preferred embodiment of the present invention in a state of being withdrawn.

The manual withdrawal and entry process is illustrated in detail in FIGS. 26 to 28.

As illustrated in FIG. 26, in a state wherein the handle unit 1200 is entered, when the right side of the handle unit 1200 is pressed, the rear direction of the pivot unit 1320 installed on the right side of the handle unit 1200 is in close contact with the blocking plate 1800. The pivot unit 1320 receives compression force in the front-to-rear direction by the user and the blocking plate 1800.

The frictional force between the pivot unit 1320 and the blocking plate 1800 is increased by the compression force. When the frictional force becomes greater than the restoring force by the pivot unit return spring 1324 of the pivot unit 1320, the pivot unit 1320 is not rotated centered around the pivot pin 1327, thereby fixing the position of the pivot pin 1327.

In this state, when a pressing force is applied to the right side of the pivot pin 1327, as illustrated in FIG. 27, the handle unit 1200 is rotated counterclockwise centered around the pivot pin 1327.

When the handle unit 1200 is rotated, the second pin 1302 is moved a predetermined distance leftward along the rear side surface of the second inclined long hole 1602, and then blocked by the inclined surface of the first guide portion 1102 in which the upper and lower portions of the second pin 1302 are inserted.

When the position of the second pin 1302 is fixed, the handle unit 1200 is no longer rotated.

When the handle unit 1200 is rotated, the first pin 1301 is moved a predetermined distance along the first inclined long hole 1601, and then blocked at the inclined surface of the first guide portion 1102 in which the upper and lower portions of the first pin 1301 are inserted.

When the position of the first pin 1301 is fixed, the handle unit 1200 is slid with respect to the extension portion 1310 and rotated. The extension portion return spring 1316 inside the extension portion 1310 is compressed as much as the handle unit 1200 is slid.

The extension portion 1310 is slid and rotated with respect to the first pin 1301.

In a state in which the handle unit 1200 is entered, the first pin 1301 and the second pin 1302 are slid only within a space which is formed by the crossing of the grooves of the first and second inclined long holes 1601 and 1602. That is, since there is no force acting on the slider 1600 due to the first pin 1301 and the second pin 1302, the slider 1600 does not slide.

When the user releases the handle unit 1200, the handle unit 1200 is entered by the restoring force of the extension portion return spring 1316 of the extension portion 1310.

In this state, when the user pulls the handle unit 1200 forward, the first pin 1301 and the second pin 1302 are moved in the front direction along the first and second inclined long holes 1601 and 1602. Due to this, the slider 1600 is slid rightward, and the slider return spring 1730 is compressed.

Figure 29:
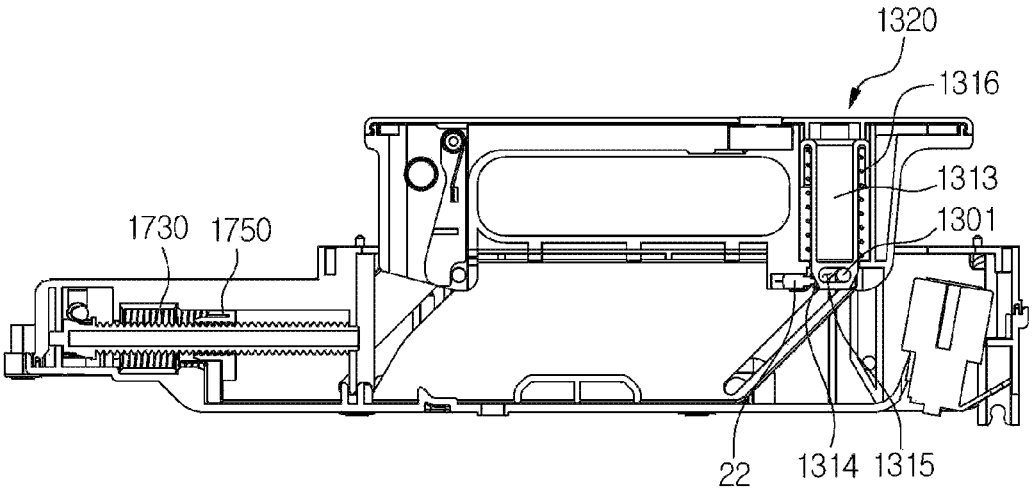
FIG. 29 is a cross-sectional view of a flush handle for a vehicle door according to a first preferred embodiment of the present invention in a state of being withdrawn motorizedly.

When the withdrawal of the handle unit 1200 is completed, the state becomes as illustrated in FIG. 29.

The extension portion return spring 1316 inside the extension portion 1310 is restored to its original state as the first pin 1301 is moved freely. Since there is no friction between the pivot unit 1320 and the blocking plate 1800, the pivot unit 1320 is rotated counterclockwise centered around the pivot pin 1327 by the restoring force of the pivot unit return spring 1324.

Since the slider 1600 is slid not by the driving unit 1700, the moving nut 1750 maintains its original position.

Figure 37:
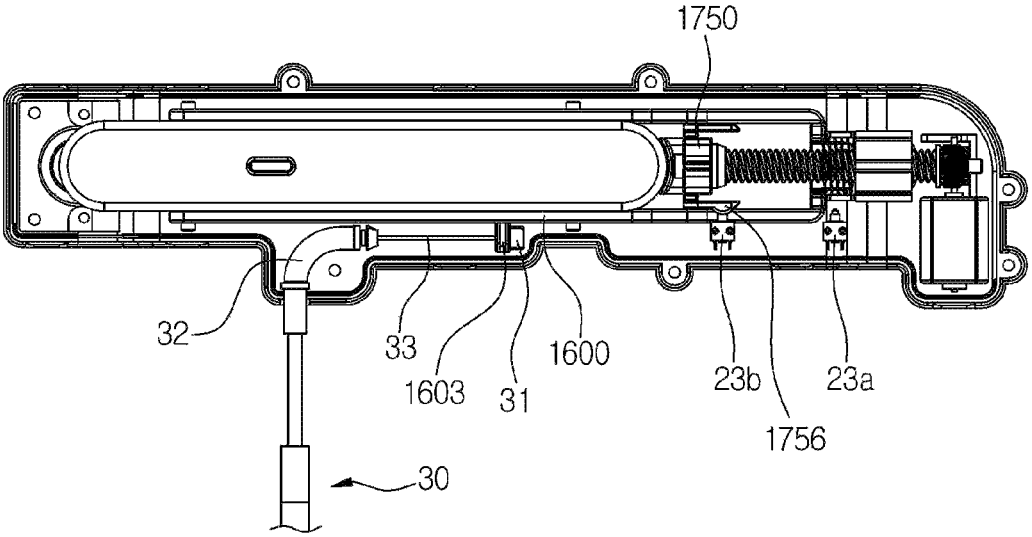
FIG. 37 is a front view of a flush handle for a vehicle door according to a first preferred embodiment of the present invention in a state which an motorized door opening function is activated after being withdrawn manually (excluding the housing).

That is, when the handle unit 1200 is manually operated, the moving nut 1750 maintains a state of pressing the third sensor **23*b* on the left side as illustrated in FIG. 37**.

When the slider 1600 is slid rightward, the door latch connection portion 30 is pulled. Due to this, the motorized latch unit 2000 is unlocked.

However, since the motor 2610 of the motorized latch unit 2000 does not operate in a state where the third sensor **23*b* in the left side is pressed, and thus, unlike the motorized operation process, which will be described later, even if the extension portion 1310 depresses the second sensor 22 by pulling out the left side of the handle unit 1200, the door panel will not be opened through motorized movement. That is, in order to open the door panel, the motorized latch unit 2000** must be operated manually.

When the user inserts a key into the key cylinder 1900 in the handle unit 1200 and turns, the motorized latch unit 2000 is manually operated by the door key connection portion 50, so that the striker 2100 is escaped from the latch 2200, thereby opening the door panel. In addition, the door panel may also be opened by pulling out the manual open cable of the motorized latch unit 2000.

In this state, when the user releases the handle unit 1200, the slider 1600 is moved leftward by the elastic force of the slider return spring 1730, and accordingly the first pin 1301 and the second pin 1302 are moved toward the rear direction along the first and second inclined long holes 1601 and 1602 of the slider 1600, and thereby the handle unit 1200 is entered.

<Motorized Operation Process>

Hereinafter, a process in which the handle unit 1200 is operated through motorized movement will be described.

Figure 2:
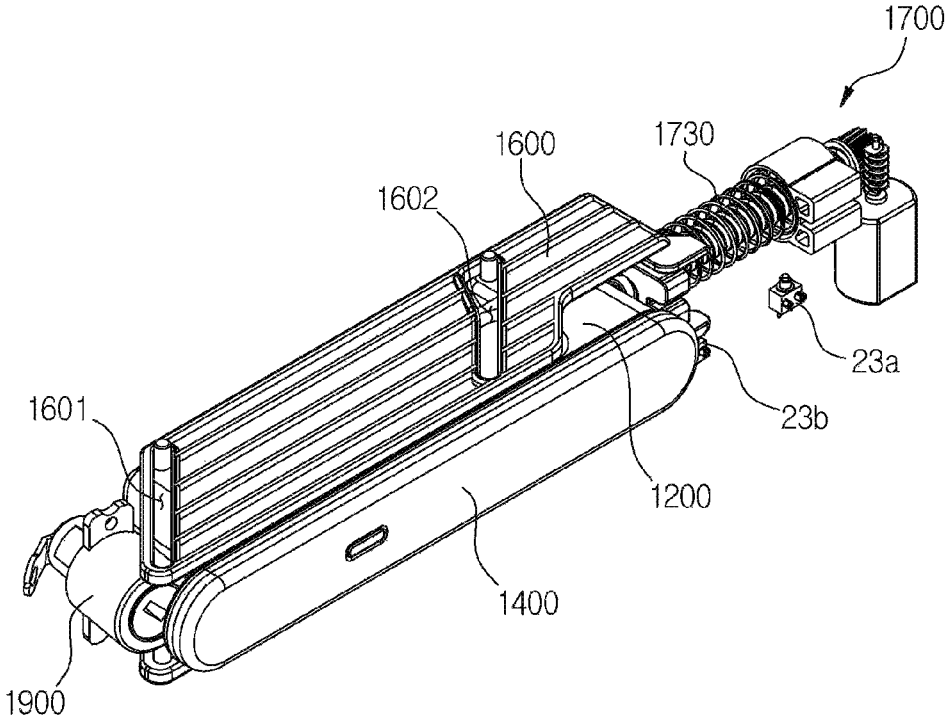
FIG. 2 is a front perspective view of a flush handle for a vehicle door according to a first preferred embodiment of the present invention (excluding housing and blocking plate).
Figure 3:
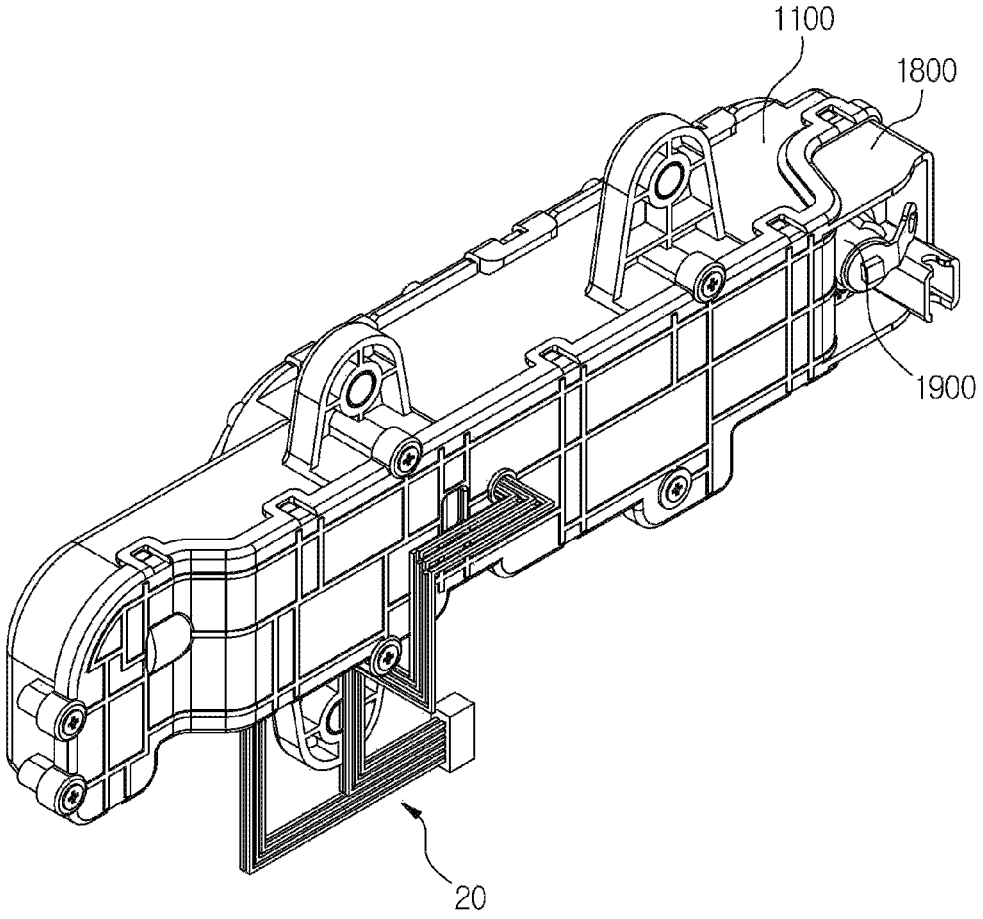
FIG. 3 is a rear perspective view of a flush handle for a vehicle door according to a first preferred embodiment of the present invention.
Figure 4:
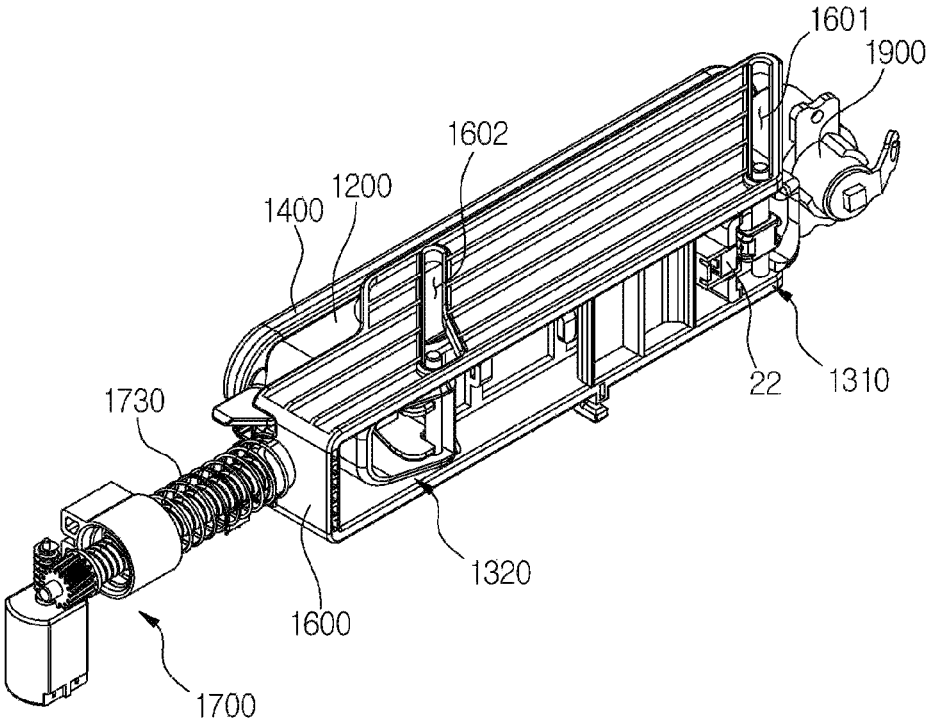
FIG. 4 is a rear perspective view of a flush handle for a vehicle door according to a first preferred embodiment of the present invention (excluding the housing and blocking plate).

As illustrated in FIGS. 1 to 2, when the withdrawal of the handle unit 1200 is inputted through a key or a remote controller, a button, and the like while the handle unit 1200 is being entered, the motor 1710 is operated by the control unit.

When the motor 1710 is operated, the worm 1721 is rotated, and as the worm 1721 is rotated, the worm wheel 1723 of the double gear 1722 is rotated, and the lead screw 1724 together with the worm wheel 1723 is also rotated.

When the lead screw 1724 is rotated, the moving nut 1750 teeth-coupled with the lead screw 1724 is moved rightward, and the slider 1600 is also moved rightward by the moving nut 1750.

When the slider 1600 is moved to the right, the first pin 1301 and the second pin 1302 are moved toward the front direction along the first and second inclined long holes 1601 and 1602 of the slider 1600.

Figure 23:
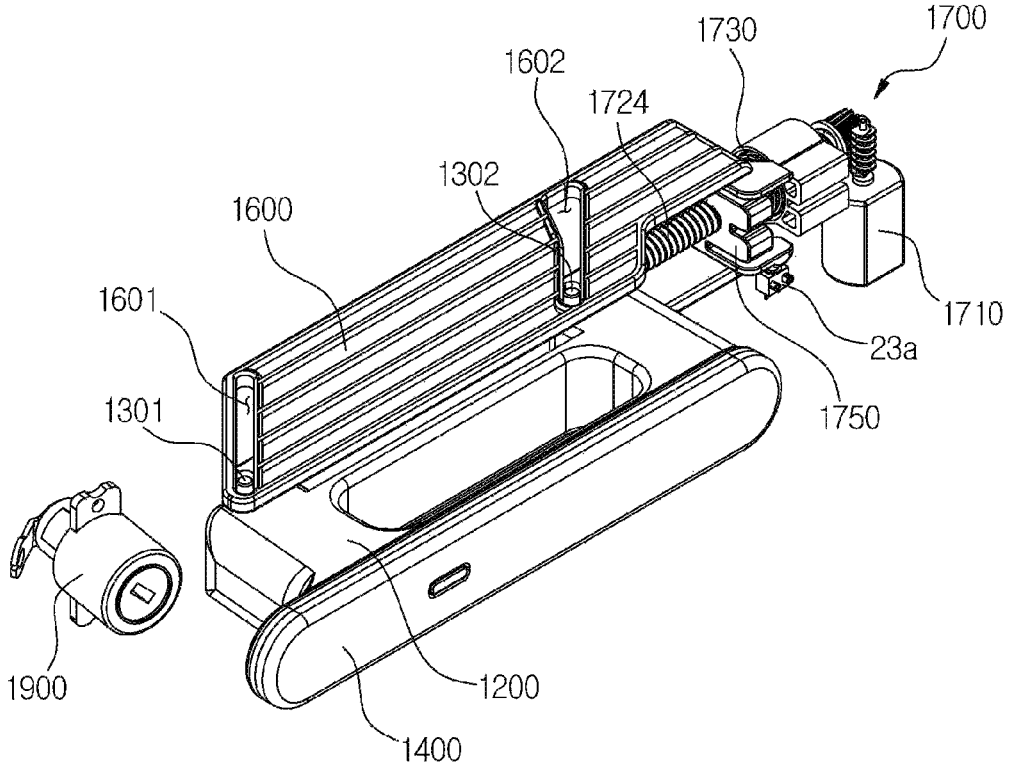
FIG. 23 is a front perspective view of a flush handle for a vehicle door according to a first preferred embodiment of the present invention in a state being withdrawn motorizedly (excluding the housing and blocking plate).
Figure 34:
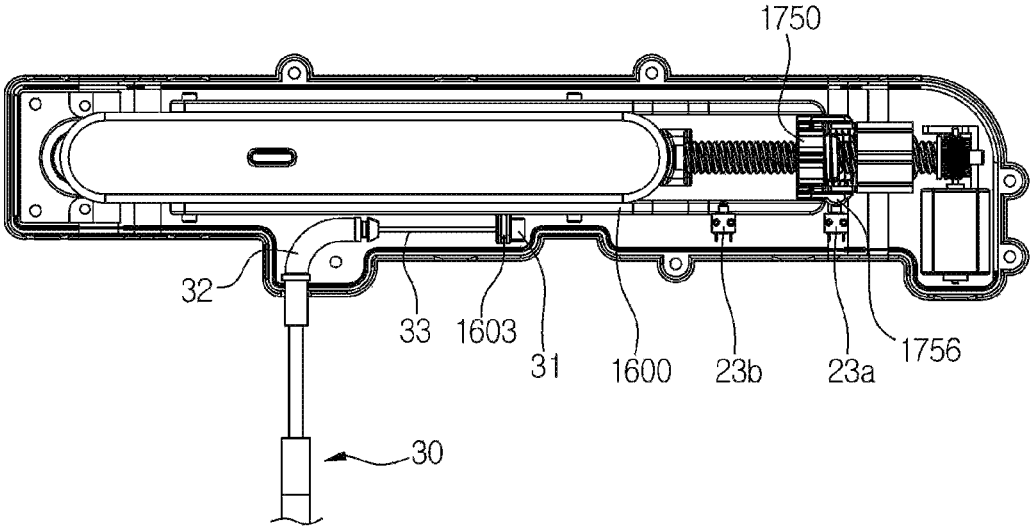
FIG. 34 is a front view of a flush handle for a vehicle door according to a first preferred embodiment of the present invention in a state of being withdrawn motorizedly (excluding the housing).

Accordingly, the handle unit 1200 is withdrawn toward the front direction and is in a state as illustrated in FIGS. 23, 29, and 34.

When the moving nut 1750 is moved to the right side, the third sensor pressing unit 1756 of the moving nut 1750, as illustrated in FIG. 34, presses the third sensor 23*a* in the right side. When the third sensor 23*a* is pressed, the operation of the motor 1710 is stopped.

In addition, when the slider 1600 is slid rightward, the door latch connection portion 30 is pulled. When one side of the safety plate 2400 is pulled according to the door latch connection portion 30, the safety plate 2400 is separated from the lock member 2615, so that the rotation of the lock member 2615 becomes possible, and the first sensor 21 is pressed by the safety plate 2400, thereby enabling the operation of the motor 2610. That is, the motorized latch unit 2000 is unlocked.

In this state, the user may open the door panel by operating the key cylinder 1900 by inserting a key between the handle unit 1200 and the bumper member 1500 as in the manual operation method described above.

Figure 24:
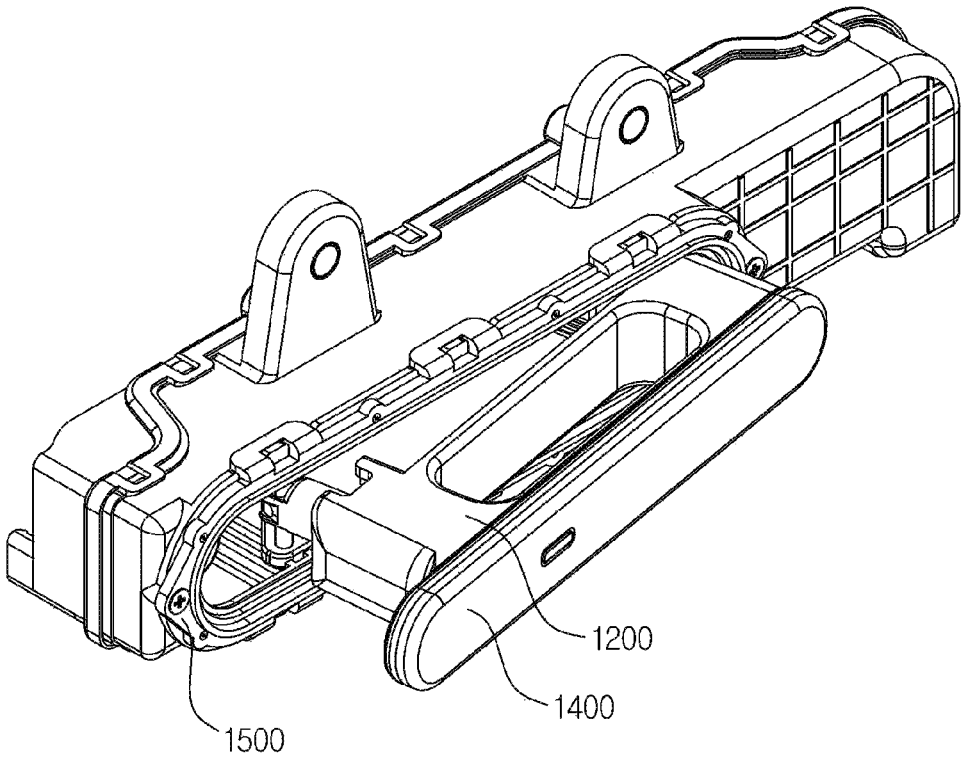
FIG. 24 is a front perspective view of a flush handle for a vehicle door according to a first preferred embodiment of the present invention in a state of being pulled.
Figure 25:
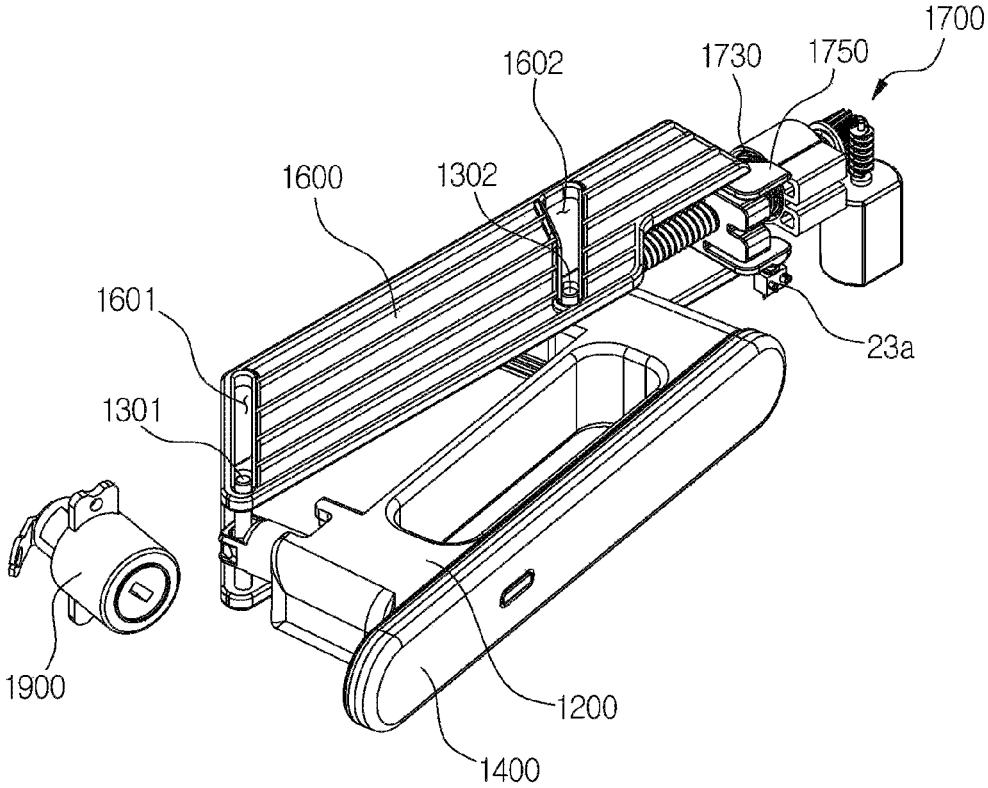
FIG. 25 is a front perspective view of a flush handle for a vehicle door according to a first preferred embodiment of the present invention in a state of being pulled (excluding the housing and blocking plate).
Figure 30:
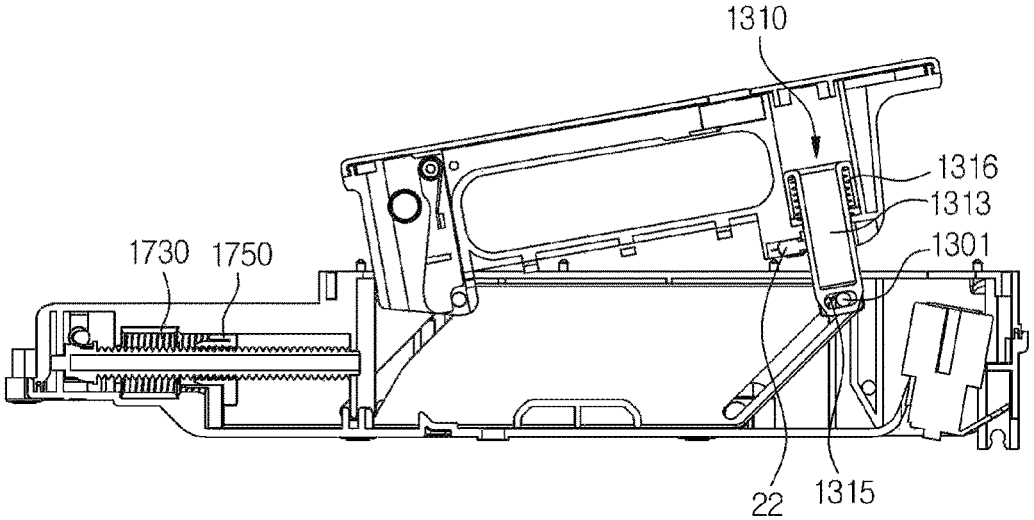
FIG. 30 is a cross-sectional view of a flush handle for a vehicle door according to a first preferred embodiment of the present invention in a state of being pulled.

Unlike this, when a user want to open the door panel through motorized movement, the user can pull the left side of the handle unit 1200 toward the front direction as illustrated in FIGS. 24, 25 and 30.

When the left side of the handle unit 1200 is pulled toward the front direction, unlike when the handle unit 1200 is entered, since the rear direction of the pivot unit 1320 is not fixed, the handle unit 1200 is rotated counterclockwise centered around the second pin 1302.

As the left side of the handle unit 1200 is rotated, the extension portion return spring 1316 in the extension portion 1310 is compressed. As the handle unit 1200 is slid toward the front direction with respect to the extension portion 1310, the second sensor 22 installed in the rear direction of the handle unit 1200 is separated from the second sensor anti-pressing portion 1314 formed at the rear direction of the extension portion 1310, and pressed by the outer surface of the length portion 1313 of the extension portion 1310.

When the first sensor 21, the second sensor 22, and the third sensor 23*a* in the right side are all pressed, the motor 2610 of the motorized latch unit 2000 is operated, as illustrated in FIGS. 35 to 36, and thereby the door panel is opened.

When the user releases the handle unit 1200, the handle unit 1200 is returned to the state as illustrated in FIG. 23 by the extension portion return spring 1316 of the extension portion 1310.

Thereafter, when the motor 1710 is rotated in the opposite direction to when the handle unit 1200 is withdrawn, as the moving nut 1750 is moved leftward, the slider 1600 is moved leftward by the restoring force of the slider return spring 1730.

When the slider 1600 is moved leftward, the first pin 1301 and the second pin 1302 are moved toward the rear side along the first and second inclined long holes 1601 and 1602 of the slider 1600.

When the moving nut 1750 is moved leftward, the third sensor pressing unit 1756 of the moving nut 1750 presses the third sensor 23*b* in the left side as illustrated in FIG. 31. When the third sensor 23*b* is pressed, the operation of the motor 1710 is stopped.

When the slider 1600 is slid leftward, the door latch connection portion 30 is returned to its original state. When the safety plate 2400 is returned to the original state along the door latch connection portion 30, as illustrated in FIG. 32, the safety plate 2400 is inserted in the lock member 2615, so that the rotation of the lock member 2615 is prevented, and the safety plate 2400 is slipped out from the first sensor 21, and thereby the power to the motor 2610 is cut off. That is, the motorized latch unit 2000 is locked. Due to this, the opening of the door panel due to the electrical malfunction of the motorized latch unit 2000 is prevented.

However, as described above, in order for the safety plate 2400 to return to its original state, the motor 2610 of the motorized latch unit 2000 is rotated in the opposite direction to when the door panel is opened, or the process of returning the locking member 2615 and the open lever 2350 to the original state due to the restoring force of the return spring of the pivoting member 2370 should be preceded.

Embodiment 2

Hereinafter, a second preferred embodiment according to the present invention will be described.

A detailed description of the same configuration that has been previously described in the first embodiment will be omitted.

Figure 38:
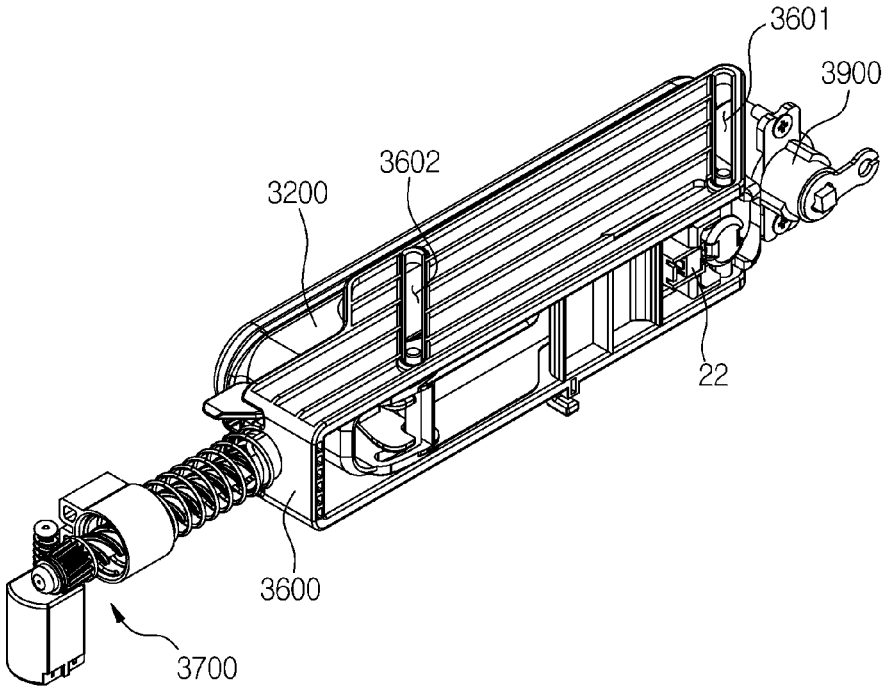
FIG. 38 is a rear perspective view of a flush handle for a vehicle door according to a second preferred embodiment of the present invention (excluding the housing and blocking plate).

As illustrated in FIG. 38, a flush handle for a vehicle door of the second embodiment comprises: a slider 3600; a handle unit 3200 accommodated in slider 3600; and a linear motion conversion mechanism, sliding the handle unit 3200 in the front-to-rear direction in accordance with a sliding of the slider 3600 in the left-to-right direction, or sliding the slider 3600 in the left-to-right direction in accordance with a sliding of the handle unit 3200 in the front-to-rear direction.

The linear motion conversion mechanism comprises: a linear motion conversion unit supporting the relative sliding between the slider 3600 and the handle unit 3200; and a driving unit 3700, sliding the slider 3600.

The linear motion conversion unit comprises: first and second inclined long holes 3601 and 3602 formed in the slider 3600; and first and second pins 3301 and 3302 installed on the handle unit 3200 to be slid along the first and second inclined long holes 3601 and 3602.

<Housing>

Figure 39:
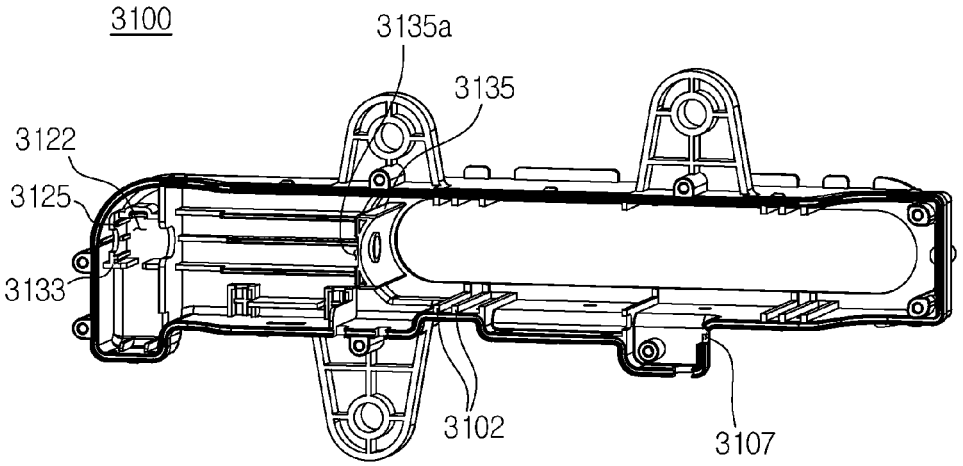
FIG. 39 is a rear perspective view of a housing of a flush handle for a vehicle door according to a second preferred embodiment of the present invention.

A housing 3100 in which the slider 3600 is installed is illustrated in detail in FIG. 39.

The housing 3100 is generally similar to the housing 1100 of the first embodiment, but has the following differences.

The first guide portion 3102, which is formed to be protruded inward in the upper and lower portions of the circumferential portion of the housing 3100, is composed of two straight lines continuous in the front-to-rear direction.

In the first guide portion 3102, a portion of the first and second pins 3301 and 3302 is inserted, and it is moved along the first guide portion 3102 only in the front-to-rear direction.

In the left side surface of the portion formed to be protruded downward in the left side of the housing 3100, a wire penetrating groove 3107 is formed to be penetrated through the left-to-right direction.

Unlike the first embodiment in which a portion of the wire 20 is connected to each sensor of the handle unit 1200 through the blocking plate 1500, in the second embodiment, a portion of the wire 20 is connected to each sensor of the handle unit 3200 through the wire penetrating groove 3107 of the housing 3100.

In the lead screw installation portion 3133 formed on the upper right portion of the housing 3100, a bush installation portion 3125 is formed to be protruded leftward. The bush installation portion 3125 is formed in the front-to-rear direction, and consists of 3 straight lines disposed in parallel in the up-down direction.

The upper, lower and front ends of a bush 3762 installed in the right side of a lead screw 3724, which will be described later, are in contact with the bush installation portion 3125.

In the right side surface of a lead screw installation portion 3135, a bush installation groove 3135*a* into which the bush 3762 installed on the left side of the lead screw 3724, which will be described later, is fitted is further formed. In the bush installation groove 3135*a*, a groove into which a portion of the bush 3762 is inserted is formed to be penetrated through the left-to-right direction. The diameter of the groove is formed smaller than the width of the bush installation groove 3135*a*.

<Handle Unit>

Figure 40:
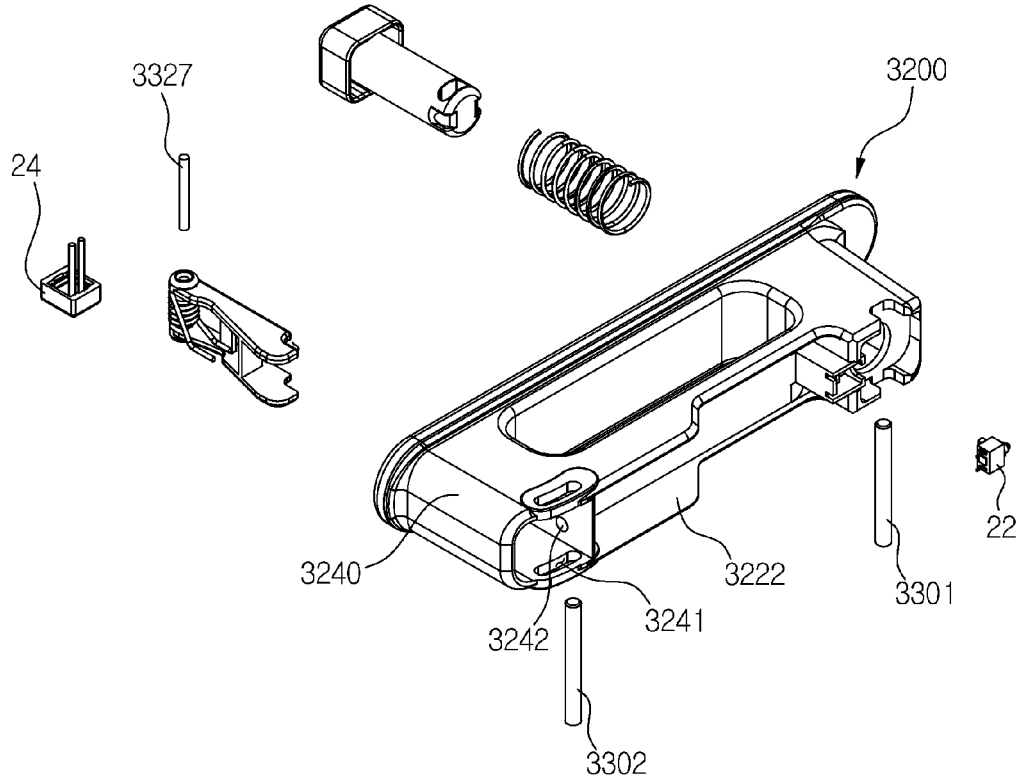
FIG. 40 is a rear exploded perspective view of a handle unit of a flush handle for a vehicle door according to a second preferred embodiment of the present invention.

A handle unit 3200 is illustrated in detail in FIG. 40.

The handle unit 3200 is generally similar to the handle unit 1200 of the first embodiment, but has the following differences.

A second pin installation groove 3241 formed in the right rear direction of the handle unit 3200 has a shape of an arc centered around a pivot pin 3327 installed in the handle unit 3200. Due to this, the handle unit 3200 can be rotated centered around the pivot pin 3327 without moving the second pin 3302 when the right side of the handle unit 3200 is pressed from the outside.

That is, the second pin 3302 is not moved toward the left-to-right direction when the handle unit 3200 is rotated, but it is moved in the front-to-rear direction along the first guide portion 3102 of the housing 3100 only when the handle unit 3200 is slid in the front-to-rear direction.

Unlike a wire installation portion 1222 is formed in the rear surface of the handle unit 1200 of the first embodiment, no separate wire installation portion is formed in the rear surface of the handle unit 3200.

Instead, reinforcing portions 3222 are formed in the upper and lower portions in the right side of the rear direction of the handle unit 3200, respectively. The reinforcement portion 3222 is formed in the left side of the second pin installation groove 3241, and thereby reinforces the strength of the second pin installation groove 3241. In addition, it plays a role of supporting the wire 20 connected through the wire penetrating groove 3107 and the wire penetrating groove 3242 of the left side of the rear direction of the handle unit 3200 and the right side portion 3240 of the handle unit so as not to be drooping downward.

<Driving Unit>

Figure 41:
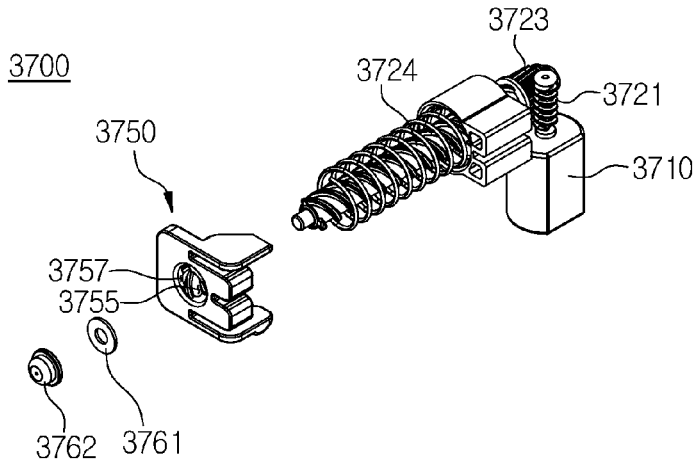
FIG. 41 is a front exploded perspective view of a driving unit of a flush handle for a vehicle door according to a second preferred embodiment of the present invention.
Figure 42:
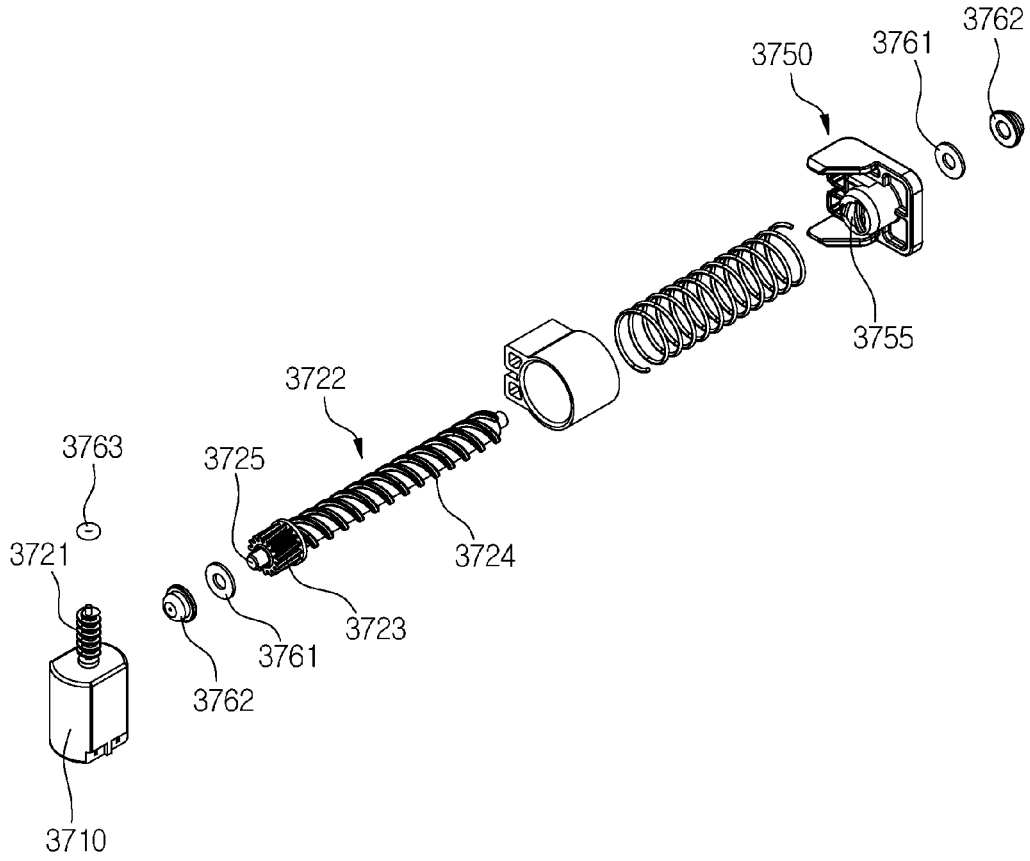
FIG. 42 is a rear exploded perspective view of a driving unit of a flush handle for a vehicle door according to a second preferred embodiment of the present invention.
Figure 43:
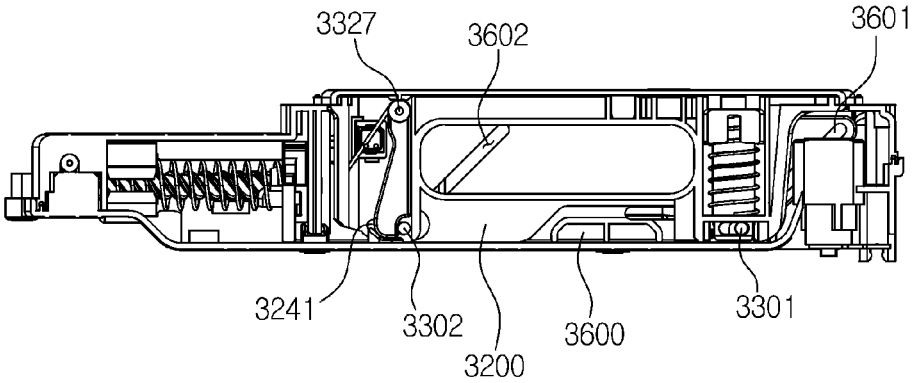
FIG. 43 is a cross-sectional view of a flush handle for a vehicle door according to a second preferred embodiment of the present invention in a state of being entered.
Figure 44:
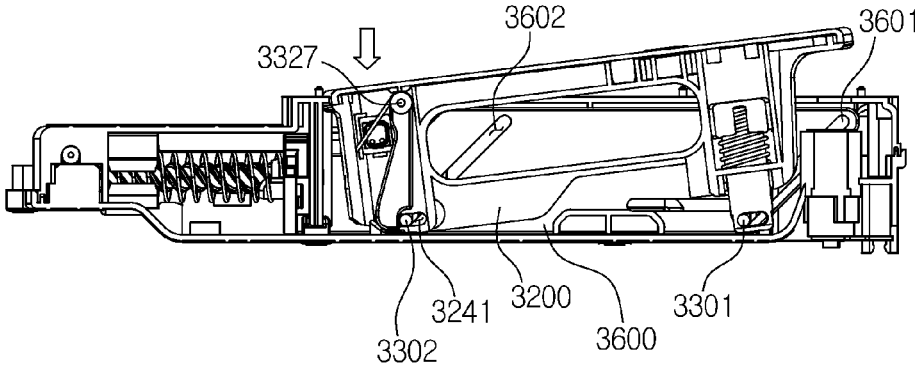
FIG. 44 is a cross-sectional view of a flush handle for a vehicle door according to a second preferred embodiment of the present invention in a state where the handle is being lifted.

A driving unit 3700 is illustrated in detail in FIGS. 41 to 42.

The driving unit 3700 is generally similar to the driving unit 1700 of the first embodiment, but has the following differences.

A shaft bumper 3763 is further installed on an upper end of a worm 3721 formed in a motor 3710. The noise generated when the worm 3721 is rotated due to the shaft bumper 3763 in friction with a worm gear installation groove 3122 of the housing 3100 is reduced.

A double gear 3722 comprises: a worm wheel 3723; a lead screw 3724 disposed on the left side of the worm wheel 3723; and a double gear shaft 3725 penetrating the worm wheel 3723 and the lead screw 3724. The worm wheel 3723 and the lead screw 3724 are connected into one and rotated at the same time. Between the worm wheel 3723 and the lead screw 3724, a plate in the shape of a donut whose one surface is connected to the worm wheel 3723 and the other surface is connected to the lead screw 3724 is formed.

The double gear shaft 3725 is formed to be protruded further outward than the worm wheel 3723 and the lead screws 3724.

In the left side of the moving nut 3750, a washer installation groove 3757 is formed to be recessed rightward. The washer installation groove 3757 is in communication with a lead screw insertion portion 3755.

In both sides of the double gear shaft 3725, washers 3761 and a bush 3762 are further fitted. The bush 3762 is disposed at the outer side than the washer 3671. Due to the washer 3761 and the bush 3762, the noise generated when the double gear 3722 is rotated in friction with the housing 3100 is reduced.

The washer 3761 is formed of a plate in the shape of a donut, and the bush 3762 is formed in a shape in which a hemispherical cover is connected to a plate in the shape of a donut. The diameter of the donut portion of the bush 3762 is formed to be larger than the diameter of the hemisphere portion.

The washer 3761 and bush 3762 installed on the left side of the double gear shaft 3725 are installed on the left side of the moving nut 3750 installed on the double gear 3722. Due to this, the moving nut 3750 will not be separated leftward of the lead screw 3724. In addition, the bush 3762 is inserted into the bush installation groove 3135*a* of the housing 3100 so that it will not be separated leftward of the lead screw installation portion 3135.

The operation method of the flush handle for a vehicle door according to the second embodiment is the same as the operation method of the first embodiment.

Embodiment 3

Hereinafter, a third preferred embodiment according to the present invention will be described.

Detailed description of the same configuration as the previously described embodiment will be omitted.

As illustrated in FIGS. 45 to 49, a flush handle for a vehicle door according to a third preferred embodiment of the present invention comprises: a slider 4600; a handle unit

4200 accommodated in slider 4600; and a linear motion conversion mechanism, sliding the handle unit 4200 in the front-to-rear direction in accordance with a sliding of the slider 4600 in the left-to-right direction, or sliding the slider 4600 in the left-to-right direction in accordance with a sliding of the handle unit 4200 in the front-to-rear direction.

The linear motion conversion mechanism comprises: a linear motion conversion unit supporting the relative sliding between the slider 4600 and the handle unit 4200; and a driving unit 4700, sliding the slider 4600.

The linear motion conversion unit comprises: first and second inclined long holes 4601 and 4602 formed in the slider 4600, and first and second pins 4301 and 4302 installed in the handle unit 4200 to be slid along the first and second inclined long holes 4601 and 4602.

Hereinafter, each configuration will be described in detail with reference to FIG. 45.

<First Housing>

The housing comprises a first housing 4100 and a second housing 4160 coupled to the right side of the first housing 4100.

Figure 50:
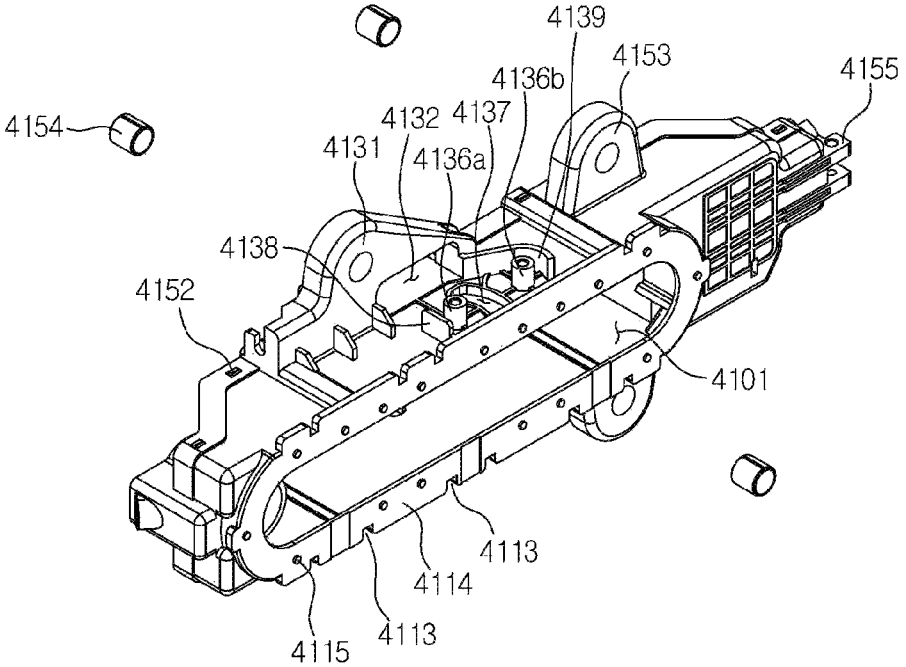
FIG. 50 is a front perspective view of a first housing of a flush handle for a vehicle door according to a third preferred embodiment of the present invention.
Figure 51:
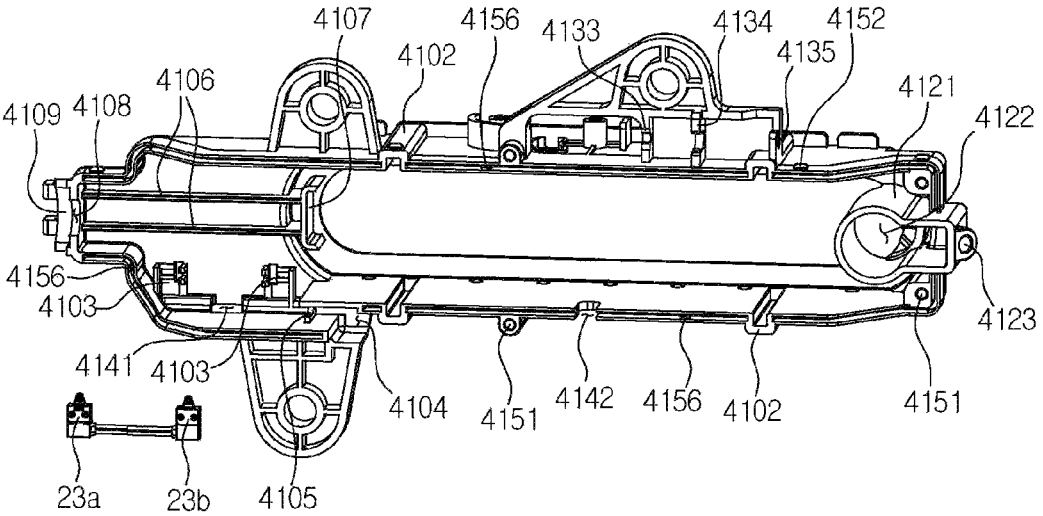
FIG. 51 is a rear perspective view of a first housing of a flush handle for a vehicle door according to a third preferred embodiment of the present invention.

The first housing 4100 is illustrated in detail in FIGS. 50 to 51.

The first housing 4100 is formed, on the whole, in the shape of a cuboid to have an open rear side.

That is, the first housing 4100 is composed of a front surface portion and a circumferential portion formed to be protruded rearward in the circumferential portion.

In the central portion of the first housing 4100, a handle unit 4200 and a slider 4600 are disposed; in a right side portion of the first housing 4100, a portion of the driving unit 4700 is disposed; and a key lock unit 4900 is disposed on the left side portion of the first housing 4100.

In the first housing 4100, a handle unit through hole 4101 is formed in length from the central portion toward the left side portion of the first housing 4100.

The handle unit through hole 4101 is formed along the shape of the front surface portion of the handle unit 4200, and in the third embodiment, it has a shape of a rectangle having arc-shaped left and right sides and to be penetrated through the front-rear direction. The handle unit through hole 4101 is formed to be larger than the front portion of the handle unit 4200, thereby preventing interference between the handle unit through hole 4101 and the handle unit 4200.

In the upper and lower portions of the circumferential portion of the first housing 4100, a first guide portion 4102 is formed to be protruded outward.

The first guide portion 4102 is disposed at the left and right sides of the handle unit through hole 4101 to guide sliding of the first and second pins 4301 and 4302 inserted into the handle unit 4200 and the slider 4600.

The first guide portion 4102 is formed in the front-to-rear direction, and a groove into which the first and second pins 4301 and 4302 can be inserted is formed inside the first guide portion 4102. Due to this, both ends of the first and second pins 4301 and 4302 can be inserted into the groove and slid in the front-to-rear direction.

In the lower right side of the first housing 4100, two third sensor installation grooves 4103 are formed to be spaced apart from each other in the left-to-right direction. The third sensor installation groove 4103 is formed to be protruded with open upper portion and rear side. Third sensors 23*a* and 23*b* are installed from the rear direction toward the front direction in the third sensor installation groove 4103, and pressed through the upper portion of the third sensor installation groove 4103.

The lower right end of the first housing 4100 is formed lower than the lower end of the central portion of the first housing 4100. Due to this, a step is formed in the lower right end of the first housing 4100 and the lower end of the central portion of the first housing 4100, and a door latch connection portion penetrating groove 4104 is formed to be open in the left-to-right direction in a portion where the step is formed.

A portion of the door latch connection portion 30 is disposed in the door latch connection portion penetrating groove 4104.

In the right side of the door latch connection portion penetrating groove 4104, a door latch connection portion installation groove 4105 is formed to be open rearward.

In the door latch connection installation groove 4105 a tube 32 of the door latch connection portion 30 is installed, so that the position of the tube 32 is fixed.

In the right center of the first housing 4100, two third guide portions 4106 are formed to be protruded rearward. The third guide portion 4106 is disposed at the right side of the handle unit through hole 4101.

The third guide portion 4106 is formed to be long in the left-to-right direction.

In the left side of the third guide portion 4106, a moving nut blocking portion 4107 is formed in the up-down direction.

The moving nut blocking portion 4107 is formed to be protruded further upward and downward than the left end of the third guide portion 4106.

The left side of the third guide portion 4106 is blocked by the moving nut blocking portion 4107, and the right side of the third guide portion 4106 is blocked by the right side of the circumferential portion of the first housing 4100.

By the third guide portion 4106, a moving nut 4750 and a moving nut bumper 4760 of a driving unit 4700, which will be described later, can be slid in the left-to-right direction within a predetermined range.

In the right circumferential portion of the first housing 4100, a first lead screw penetrating groove 4108 is formed to be open rearward and to be penetrated through the left-to-right direction.

The first lead screw penetrating groove 4108 has a shape of a semicircle.

In the right circumferential portion of the first housing 4100, a second housing installation portion 4109 is formed to be protruded rightward.

The second housing installation portion 4109 has a shape of a semicircle. The diameter of the second housing installation portion 4109 is formed to be larger than the diameter of the first lead screw penetrating groove 4108, and the second housing installation portion 4109 is disposed at the front direction of the first lead screw penetrating groove 4108, and thereby a partition wall is formed between the second housing installation portion 4109 and the first lead screw penetrating groove 4108.

A second housing 4160, which will be described later, is installed between the first lead screw penetrating groove 4108 and the second housing installation portion 4109.

The outer side of the front surface of the first housing 4100 is coupled with a bumper member 4500, which will be described later.

In the circumference of the handle unit handle unit through hole 4101, a plurality of first, second, and third bumper fastening portions 4113, 4114, and 4115 is formed.

The second bumper fastening portion 4114 is formed to be protruded further outward than the front surface portion of the first housing 4100. The first bumper fastening portion

4113 is formed in the second bumper fastening portion 4114 in the form of a groove recessed toward the handle unit through hole 4101.

Due to the first and second bumper fastening portions 4113 and 4114, the bumper member 4500 may be fit-coupled toward the inner side from the outer side of the front surface portion of the first housing 4100.

The third bumper fastening portion 4115 has a shape of a cylindrical column protruded forward.

Due to the third bumper fastening portion 4115, the bumper member 4500 can be fit-coupled from the front direction toward the rear direction of the first housing 4100.

Due to this, the first housing 4100 and the bumper member 4500 can be more firmly coupled.

In the left circumferential portion of the first housing 4100, a key cylinder installation portion 4121 is formed to be protruded rearward.

The key cylinder installation portion 4121 has a shape of a circle for the right side, and a rectangle for the left side. In the key cylinder installation portion 4121, a key cylinder installation groove 4122 is formed to be penetrated through the front-to-rear direction.

In the left side of the key cylinder installation portion 4121, a key cylinder fastening portion 4123 is formed. In the key cylinder fastening portion 4123, a hole through which a bolt can be fastened is formed.

In the upper circumferential portion of the first housing 4100, a fourth fastening portion 4131 is formed to be protruded upward.

In the lower portion of the fourth fastening portion 4131, a lever penetrating groove 4132 is formed to be penetrated through the front-to-rear direction.

The lever penetrating groove 4132 is formed to be long in the left-to-right direction according to the rotation radius of the lever 4950, which will be described later.

In the left side of the fourth fastening portion 4131, a cable installation groove 4133, an engaging protrusion installation groove 4134, and a tube installation groove 4135 are formed to be protruded rearward.

The cable installation groove 4133 is formed in the left side of the lever penetrating groove 4132. The cable installation groove 4133 is formed to be open rearward and left-to-right direction.

The engaging protrusion installation groove 4134 is formed on the left side of the cable installation groove 4133. The engaging protrusion installation groove 4134 is formed to be open rearward and left-to-right direction.

A tube installation groove 4135 is formed in the left side of the engaging protrusion installation groove 4134. The tube installation groove 4135 is formed to be open upward and left-to-right direction.

The cable installation groove 4133, the engaging protrusion installation groove 4134, and the tube installation groove 4135 are located on the same line in the left-to-right direction.

In the upper circumferential portion of the first housing 4100, a lever installation protrusion 4136*a* and a weight balance installation protrusion 4136*b* are formed to be protruded upward.

The lever installation protrusion 4136*a* and the weight balance installation protrusion 4136*b* are disposed further forward than the fourth fastening portion 4131.

The lever installation protrusion 4136*a* and the weight balance installation protrusion 4136*b* are formed in the shape of a cylindrical column formed with holes in the up-down direction.

The lever installation protrusion 4136*a* is spacedly disposed at the left side of the weight balance installation protrusion 4136*b*.

Between the lever installation protrusion 4136*a* and the weight balance installation protrusion 4136*b*, a lever guide groove 4137 is formed to be penetrated through the up-down direction.

The lever guide groove 4137 has a shape of an arc. Due to this, an engaging portion 4954 of the lever 4950, which will be described later, can be inserted into the lever guide groove 4137 and rotated.

In the left side of the lever installation protrusion 4136*a*, a lever guide portion 4138 is formed to be protruded upward.

The lever guide portion 4138 has a shape of a rectangular plate disposed in the front-to-rear direction.

In the right side of the weight balance installation protrusion 4136*b*, a weight balance guide portion 4139 is formed to be protruded upward.

The weight balance guide portion 4139 is formed in the form of a weight balance 4960, which will be described later.

The weight balance guide portion 4139 is formed to be in contact with the rear surface of the weight balance 4960, determines the initial position of the weight balance 4960, and prevents the weight balance 4960 from being pushed rearward than the weight balance guide portion 4139.

The height of the weight balance guide portion 4139 is formed to be the same as and similar to the height of the lever guide portion 4138.

Between the third sensor installation groove 4103, a first wire penetrating groove 4141 is formed to be penetrated through the front-to-rear direction.

The wire 20 is inserted into the first housing 4100 through the first wire penetrating groove 4141 and connected to the third sensors 23*a* and 23*b*.

In the lower circumferential portion of the first housing 4100, a second wire penetrating groove 4142 is formed to be penetrated through the rear and front-to-rear directions.

The second wire penetrating groove 4142 is disposed at the center of the first housing 4100.

The wire 20 is inserted into the first housing 4100 through the second wire penetrating groove 4142 and connected to the second sensor 22, the LED 24, the button sensor 26, and the fourth sensor 27.

In the circumferential portion of the first housing 4100, a first fastening portion 4151 and a second fastening portion 4152 coupled with a first blocking plate 4800, which will be described later, are formed.

The first fastening portion 4151 is formed in a shape that comprises a groove through which the bolt can be inserted from rear to front.

A portion of the first fastening portion 4151 is formed to be protruded outward in the upper and lower side surfaces of the circumferential portion of the first housing 4100, and the remainder of the first fastening portion 4151 is formed to be protruded rearward in the left side of the first housing 4100.

The second fastening portion 4152 is formed to be protruded outward in the upper and lower side surfaces of the circumferential portion of the first housing 4100. The second fastening portion 4152 has a shape of a protrusion inclined inward of the first housing 4100 as it travels from front to rear.

In the circumferential portion of the first housing 4100, a third fastening portion 4153 to be coupled with the door panel is formed.

The third fastening portion 4153 is formed to be protruded outward in the upper and lower side surfaces of the circumferential portion of the first housing 4100. A groove is formed in the third fastening portion 4153 to be penetrated through the front-to-rear direction, and is coupled to the door panel through the groove. A metal pad 4154 in the shape of a donut is installed in the groove to prevent the coupling portion between the first housing 4100 and the door panel from being broken or loosened.

In the right circumferential portion of the first housing 4100, a second housing fastening portion 4155 is formed.

The second housing fastening portion 4155 is disposed further forward than the second housing installation portion 4109.

The second housing fastening portion 4155 is formed in the form of a cuboid protruded rightward.

The second housing fastening portion 4155 is formed such that the two cuboids are spaced apart in the up-down direction.

The second housing fastening portion 4155 is formed with a groove through which a bolt can be inserted from the upper side toward the lower side.

A first blocking plate fitting groove 4156 is formed inside the circumferential portion of the first housing 4100.

A first housing fitting protrusion 4805 of the first blocking plate 4800, which will be described later, is inserted into the first blocking plate fitting groove 4156.

<First Blocking Plate>

The first housing 4100 comprises a first blocking plate 4800 coupled to the rear of the first housing 4100.

Figure 58:
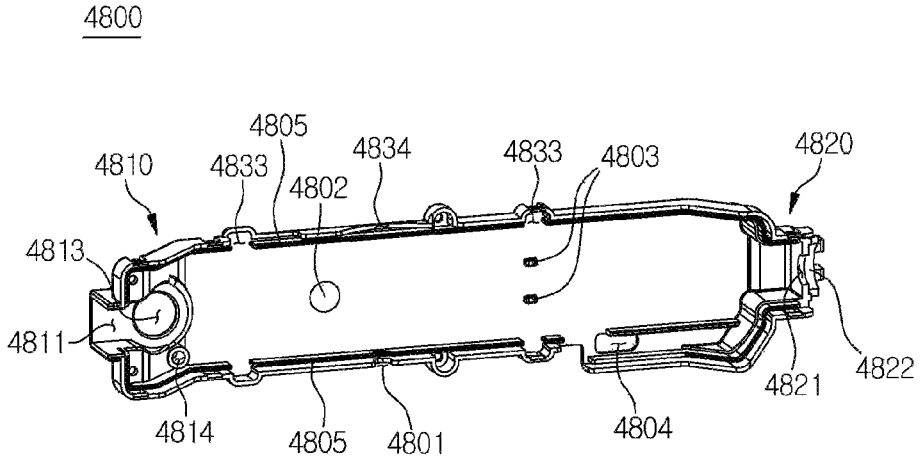
FIG. 58 is a front perspective view of a first blocking plate of a flush handle for a vehicle door according to a third preferred embodiment of the present invention.
Figure 59:
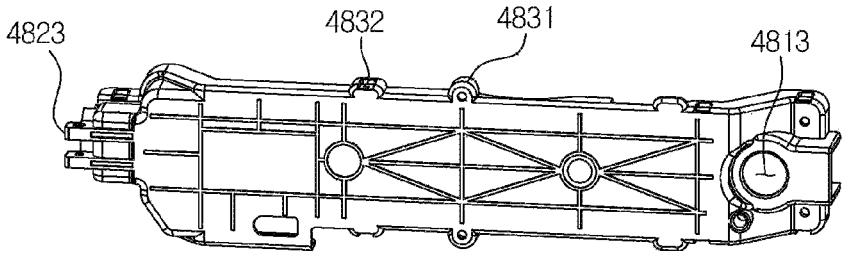
FIG. 59 is a rear perspective view of a first blocking plate of a flush handle for a vehicle door according to a third preferred embodiment of the present invention.

The first blocking plate 4800 is illustrated in detail in FIGS. 58 to 59.

The first blocking plate 4800 is formed, on the whole, in the shape of a cuboid having an open front. That is, it is composed of a rear surface portion and a circumferential portion formed to be protruded forward from the circumference of the rear surface portion.

The circumferential portion of the first blocking plate 4800 is formed to cover the rear of the circumferential portion of the first housing 4100.

The left side portion 4810 and the right side portion 4820 of the first blocking plate 4800 are formed to be protruded forward as it travels outward.

In the center lower portion of the first blocking plate 4800, a third wire penetrating groove 4801 is formed to be penetrated through the front and up-down directions.

The third wire penetrating groove 4801 is in communication with the second wire penetrating groove 4142 of the first housing 4100.

In the center of the first blocking plate 4800, a fourth sensor pressing portion 4802 and a pivot unit engaging portion 4803 are formed to be protruded forward.

The fourth sensor pressing portion 4802 is disposed further at the left side than the third wire penetrating groove 4801, and the pivot unit engaging portion 4803 is disposed further at the right side than the third wire penetrating groove 4801.

The fourth sensor pressing portion 4802 has a shape of a flat hemisphere.

The fourth sensor pressing portion 4802 is located rear side of the fourth sensor 27 installed in the handle unit 4200. The fourth sensor pressing portion 4802 is formed so that the fourth sensor pressing portion 4802 does not press the fourth sensor 27 in an initial state.

The pivot unit engaging portion 4803 is formed to be protruded in the shape of a rectangle in the upper and lower portions of the first blocking plate 4800, respectively.

The pivot unit engaging portion 4803 is disposed further at the left side than the rear of the rotating portion 4322 of the pivot unit 4320. Due to this, when the user presses the right side of the handle unit 4200, and thereby the pivot unit 4320 receives a force, the pivot unit 4320 is not pushed leftward due to the pivot unit engaging portion 4803.

In the lower right of the first blocking plate 4800, a groove 4804 is formed to be penetrated through the front-to-rear direction.

Inside the circumferential portion of the first blocking plate 4800, a first housing fitting protrusion 4805 is formed.

The first housing fitting protrusion 4805 is formed to be spaced apart from the circumferential portion of the first blocking plate 4800. The separation distance is similar to the thickness of a first blocking plate fitting groove 4156 of the first housing 4100.

The first blocking plate fitting groove 4156 of the first housing 4100 can be inserted between the circumferential portion of the first blocking plate 4800 and the first housing fitting protrusion 4805.

Due to this, the gap between the first housing 4100 and the first blocking plate 4800 may be filled without a separate sealing member, and thus waterproof and dustproof are possible.

In the left side portion 4810, a key cylinder installation groove 4811 is formed to be open leftward and rearward.

A key cylinder installation portion 4121 of the first housing 4100 is fitted into the key cylinder installation groove 4811.

In the key cylinder installation groove 4811, a key cylinder penetrating groove 4813 is formed to be penetrated through the front-to-rear direction. The diameter of the key cylinder penetrating groove 4813 is the same as or larger than the diameter of the key cylinder 4930.

In the left side portion 4810, a second gear installation groove 4814 is formed to be penetrated through the front-to-rear direction.

The second gear installation groove 4814 is located in the lower portion of the key cylinder installation groove 4811.

In the right side portion 4820, a third lead screw penetrating groove 4821, a second blocking plate installation portion 4822, and a second blocking plate fastening portion 4823 are formed.

The third lead screw penetrating groove 4821 is formed have an open front and to be penetrated through the left-to-right direction.

The third lead screw penetrating groove 4821 has a shape of a semicircle.

The third lead screw penetrating groove 4821 is formed symmetrically in the front-to-rear direction with the first lead screw penetrating groove 4108 of the first housing 4100, and in communication with the first lead screw penetrating groove 4108.

A second blocking plate installation portion 4822 has a shape of a semicircle. The diameter of the third blocking plate installation portion 4822 is formed to be larger than the diameter of the third lead screw penetrating groove 4821, and the second blocking plate installation portion 4822 is disposed at the rear side further than the third lead screw penetrating groove 4821, and thereby a partition wall is formed between the second blocking plate installation portion 4822 and the third lead screw penetrating groove 4821.

A second blocking plate 4170, which will be described later, is installed between the third lead screw penetrating groove 4821 and the second blocking plate installation portion 4822.

In the right side portion 4820, a second blocking plate fastening portion 4923 is formed.

The second blocking plate fastening portion 4923 is disposed at the rear side further than the second blocking plate installation portion 4822.

The second blocking plate fastening portion 4823 has a shape of a cuboid protruded rightward.

The second blocking plate fastening portion 4823 is formed such that the two cuboids are spaced apart in the up-down direction.

In the second blocking plate fastening portion 4823, a groove through which a bolt can be inserted from the upper side toward the lower side is formed.

In the circumferential portion of the first blocking plate 4800, a first fastening portion 4831 and a second fastening portion 4832 that are coupled to the first housing 4100 are formed.

The first fastening portion 4831 is formed in a shape comprising a groove through which the bolt can be inserted from rear to front. A portion of the first fastening portion 4831 is formed to be protruded outward in the upper and lower side portions of the circumferential portion of the first blocking plate 4800, and the remainder of the first fastening portion 4831 is formed to be penetrated through the front-to-rear direction in the upper left and lower portions.

The second fastening portion 4832 is formed to be protruded outward in the upper and lower side surfaces of the circumferential portion of the first blocking plate 4800. A groove penetrating in the up-down direction is formed in the central portion of the second fastening portion 4832, and the second fastening portion 4152 of the first housing 4100 is inserted into the groove.

Due to this, the first blocking plate 4800 and the first housing 4100 may be more firmly combined.

Inside the second fastening portion 4832, a pin interference preventing groove 4833 is formed.

The pin interference preventing groove 4833 is formed on the left and right sides, respectively, so that the front and inner directions are open.

The pin interference preventing groove 4833 is in communication with the groove of the first guide portion 4102 of the first housing 4100.

Due to the pin interference preventing groove 4833, the first pin 4301 and the second pin 4302 can be slid in the front-to-rear direction without interfering with the first blocking plate 4800.

In the upper circumferential portion of the first blocking plate 4800, a lever interference preventing groove 4834 is formed.

The lever interference preventing groove 4834 is formed between the left pin interference preventing groove 4833 and the right pin interference preventing groove 4833.

The lever interference preventing groove 4834 is formed to be open forward, upward, and downward with a concave arc-shaped rear side. The arc is formed according to the rotation radius of the lever 4950.

When the first housing 4100 and the first blocking plate 4800 are coupled, a circumferential portion of the first housing 4100 is positioned in the lower portion of the lever interference preventing groove 4834.

<Second Housing>

Figure 60:
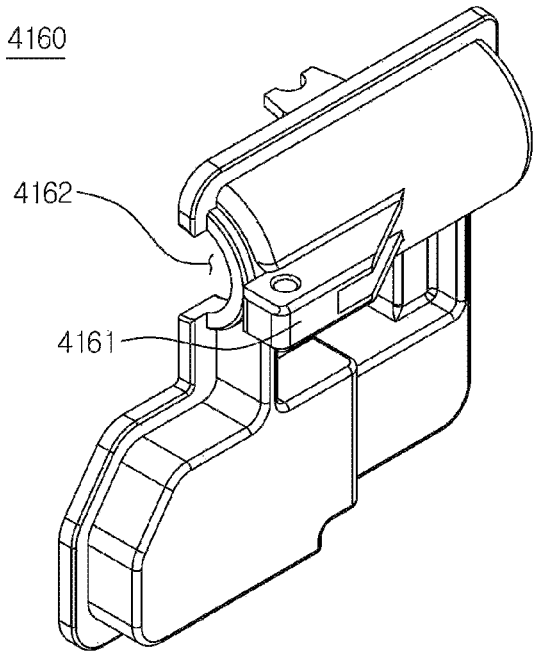
FIG. 60 is a front perspective view of a second housing of a flush handle for a vehicle door according to a third preferred embodiment of the present invention.
Figure 61:
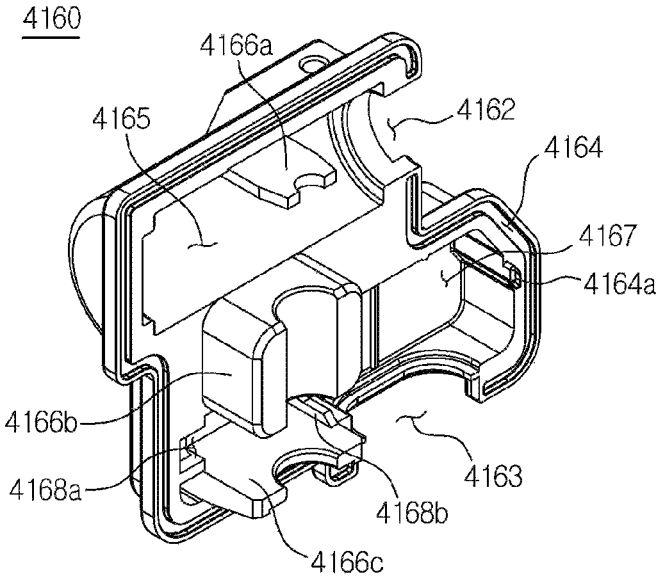
FIG. 61 is a rear perspective view of a second housing of a flush handle for a vehicle door according to a third preferred embodiment of the present invention.

A second housing 4160 is illustrated in detail in FIGS. 60 to 61.

The second housing 4160 is formed, on the whole, in the shape of a cuboid to have an open rear side.

That is, the first housing 4100 is composed of a front surface portion and a circumferential portion formed to be protruded rearward in the circumference of the front surface portion.

The second housing 4160 is formed in a shape in which the lower portion is protruded leftward.

In the second housing 4160, a first housing fastening portion 4161 is formed to be protruded forward.

The first housing fastening portion 4161 has a shape of a cuboid so that it can be fitted between the two second housing fastening portions 4155 of the first housing 4100.

The first housing fastening portion 4161 is formed with a groove through which a bolt can be inserted from the upper side toward the lower side.

Due to this, the first housing fastening portion 4161 of the second housing 4160 and the second housing fastening portion 4155 of the first housing 4100 can be coupled to each other by bolts.

In the left side of the second housing 4160, a second lead screw penetrating groove 4162 is formed to be penetrated through the rear side and front-to-rear direction.

The first lead screw penetrating groove 4108 and the second lead screw penetrating groove 4162 are disposed on the same line in the front-to-rear direction.

In the lower portion of the second housing 4160, a first encoder connector installation groove 4163 is formed to be penetrated through the rear side and up-down directions.

In the circumferential portion of the second housing 4160, a second blocking plate engaging groove 4164 is formed to be recessed from rear to front.

The second blocking plate coupling groove 4164 is formed in the remaining section of the circumferential portion of the second housing 4160 except for the section in which the second lead screw penetrating groove 4162 and the first encoder connector installation groove 4163 are formed.

In the left side of the circumferential portion of the second housing 4160, a second blocking plate engagement protrusion **4164*a*** is formed to be protruded rearward.

The second blocking plate engaging protrusion **4164*a* is formed further inside the second housing 4160 than the second blocking plate engaging groove 4164**.

The second blocking plate engaging protrusion **4164*a* is located at the edge of the second housing 4160**.

The left side surface of the second blocking plate engaging protrusion **4164*a* is in contact with the inner surface of the circumferential portion of a second blocking plate 4170**, which will be described later.

Due to this, the second blocking plate engaging protrusion **4164*a* may play the role of guiding the coupling position when the second housing 4160 and the second blocking plate 4170** are coupled.

In the upper portion of the second housing 4160, a first lead screw installation groove 4165 is formed to have an open rear side.

The first lead screw installation groove 4165 has a shape of a semi-cylinder.

A first double gear installation portion **4166*a* is formed on the upper portion of the second housing 4160** to be protruded rearward.

The first double gear installation portion **4166*a* is formed in the upper portion of the first lead screw installation groove 4165**.

In the first double gear installation portion **4166*a*, a semi-circular groove in which the upper portion of the shaft of a first double gear 4472**, which will be described later, can be installed is formed.

In the center of the second housing 4160, a second double gear installation portion **4166*b*** is formed to be protruded rearward.

The second double gear installation portion 4166*b* is formed further in the lower portion than the first lead screw installation groove 4165.

In the second double gear installation portion 4166*b*, a groove in the shape of a semi-cylinder in which the central portion of the shaft of the first double gear 4472 may be installed is formed.

In the lower portion of the second housing 4160, a third double gear installation portion 4166*c* is formed to be protruded rearward.

In the third double gear installation portion 4166*c*, a groove in the shape of a semi-circle in which a lower portion of the shaft of the first double gear 4472 can be installed is formed.

The first, second and third double gear installation portions 4166*a*, 4166*b*, and 4166*c* are located on the same line in the up-down direction.

In the lower left portion of the second housing 4160, a first motor installation groove 4167 is formed to have an open rear.

The first motor installation groove 4167 has a shape of a cuboid.

In the right side of the first motor installation groove 4167, a first motor shaft installation groove 4168*a* and a second motor shaft installation portion 4168*b* are formed.

The first motor shaft installation groove 4168*a* is formed in the lower right portion of the second housing 4160.

The first motor shaft installation groove 4168*a* is formed to have an open rear side.

In the first motor shaft installation groove 4168*a*, the right side of the shaft of a first worm 4472, which will be described later, is installed.

The second motor shaft installation portion 4168*b* is formed in the left upper end of the third double gear installation portion 4166*c*.

In the second motor shaft installation groove 4168*a*, a groove in which the left side of the shaft of the motor 4710, which will be described later, can be installed is formed to have an open rear side.

<Second Blocking Plate>

The second housing 4160 comprises a second blocking plate 4170 coupled to the rear side of the second housing 4160.

Figure 62:
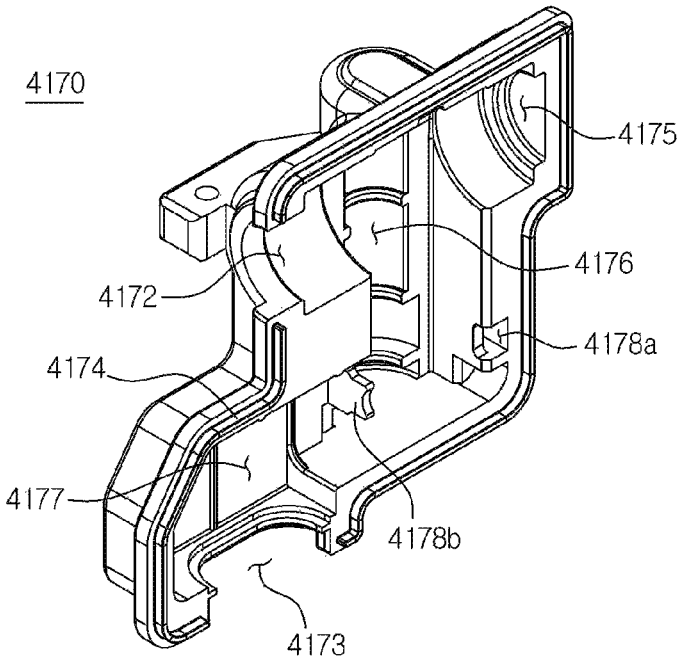
FIG. 62 is a front perspective view of a second blocking plate of a flush handle for a vehicle door according to a third preferred embodiment of the present invention.
Figure 63:
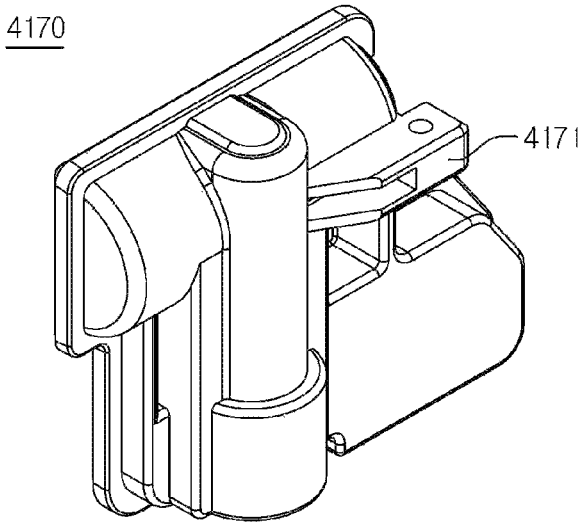
FIG. 63 is a rear perspective view of a second blocking plate of a flush handle for a vehicle door according to a third preferred embodiment of the present invention.

The second blocking plate 4170 is illustrated in detail in FIGS. 62 to 63.

The second blocking plate 4170 has a shape of a cuboid having an open front.

That is, the second blocking plate 4170 is composed of a rear surface portion and a circumferential portion formed to be protruded forward from the circumference of the rear surface portion.

The second blocking plate 4170 is formed in a shape in which the lower portion is protruded leftward.

In the second blocking plate 4170, a first blocking plate fastening portion 4171 is formed to be protruded rearward.

The first blocking plate fastening portion 4171 has a shape of a cuboid so that it can be fitted between the two second blocking plate fastening portions 4823 of the first blocking plate 4800.

In the first blocking plate fastening portion 4171, a groove through which a bolt can be inserted from the upper side toward the lower side is formed.

Due to this, the first blocking plate fastening portion 4171 of the second blocking plate 4170 and the second blocking plate fastening portion 4923 of the first blocking plate 4800 may be coupled to each other by bolts.

In the left side of the second blocking plate 4170, a fourth lead screw penetrating groove 4172 is formed to be penetrated through the front and front-to-rear directions.

The third lead screw penetrating groove 4821 is formed symmetrically in the front-to-rear direction with the second lead screw penetrating groove 4162 of the second housing 4160, and is in communication with the second lead screw penetrating groove 4162.

The third lead screw penetrating groove 4821 and the fourth lead screw penetrating groove 4172 of the second blocking plate 4170 are disposed on the same line in the left-to-right direction.

That is, the first, second, third and fourth lead screw penetrating grooves 4108, 4162, 4821, and 4172 are in communication with one another.

In the lower portion of the second blocking plate 4170, a second encoder connector installation groove 4173 is formed to be penetrated through the front and up-down directions.

The second encoder connector installation groove 4173 is formed symmetrically in the front-to-rear direction with the first encoder connector installation groove 4163 of the second housing 4160, and in communication with the first encoder connector installation groove 4163.

In the circumferential portion of the second blocking plate 4170, a second housing coupling protrusion 4174 is formed to be protruded forward.

The second housing coupling protrusion 4174 is formed in the remaining section of the circumferential portion of the second blocking plate 4170 except the section in which the fourth lead screw penetrating groove 4172 and the second encoder connector installation groove 4173 are formed.

The second housing coupling protrusion 4174 is inserted into the second blocking plate coupling groove 4164 of the second housing 4160.

Due to this, the gap between the second housing 4160 and the second blocking plate 4170 can be filled without a separate sealing member, and waterproof and dustproof are possible. In addition, since the second housing 4160 is spatially separated from the first housing 4100 in which the handle unit 4200 being entered and withdrawn from the vehicle door is installed, thereby enhancing the water tightness of the driving unit 4700 installed in the second housing 4160. There is also an advantage that the amount of noise of the driving unit 4700 exposed outside through the handle unit 4200 is reduced.

In the upper portion of the second housing 4160, a second lead screw installation groove 4175 is formed to have an open front side.

The second lead screw installation groove 4175 has a shape of a semi-cylinder.

In the right side of the second blocking plate 4170, a double gear installation groove 4176 is formed in the up-down direction. The double gear installation groove 4176 has a shape of a semi-cylinder.

Inner side of the double gear installation groove 4176, a plurality of protrusions capable of supporting the shaft of the first double gear 4722 is formed.

In the lower left portion of the second blocking plate 4170, a second motor installation groove 4177 is formed to have an open front side.

The second motor installation groove 4177 is formed in shape of a cuboid.

In the right side of the second motor installation groove 4177, a second motor shaft installation groove 4178*a* and a second motor shaft installation portion 4178*b* are formed.

The second motor shaft installation groove 4178*a* is formed in the lower right portion of the second blocking plate 4170.

The second motor shaft installation groove 4178*a* is formed to have an open front.

In the second motor shaft installation groove 4178*a*, the right side of the shaft of a first worm 4472, which will be described later, is installed.

In the upper left of the double gear installation groove 4176, the second motor shaft installation portion 4178*b* is formed to be protruded forward.

In the second motor shaft installation portion 4178*b*, a groove in which the left side of the shaft of the motor 4710, which will be described later, can be installed is formed to have an open front side.

<Handle Unit>

Figure 52:
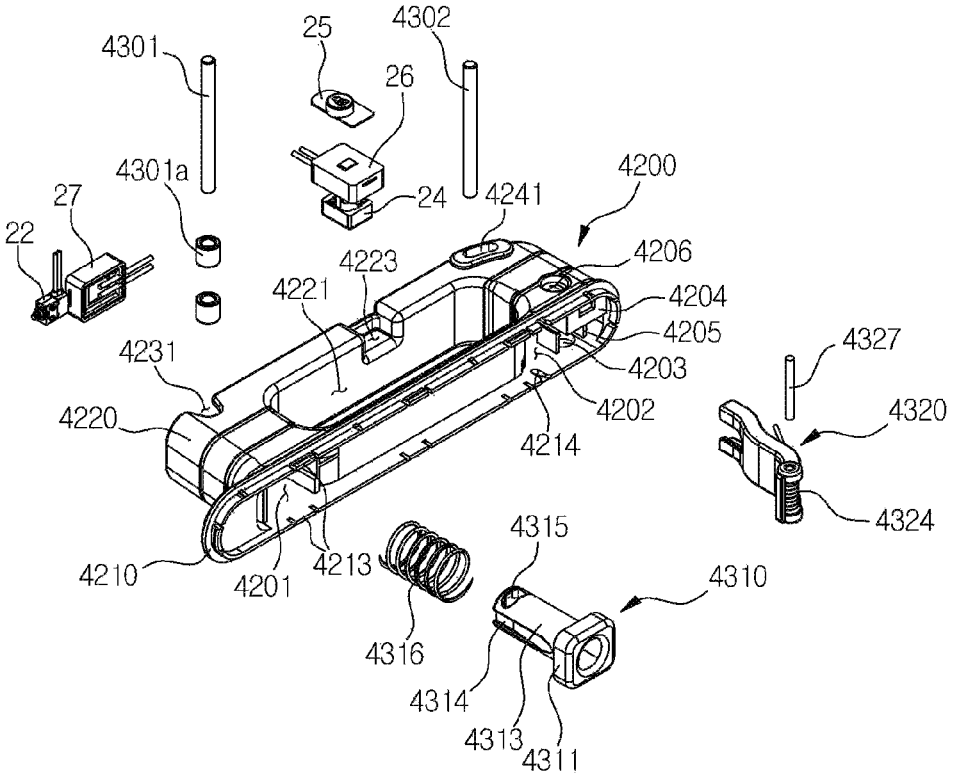
FIG. 52 is a front exploded perspective view of a flush handle for a vehicle door according to a third preferred embodiment of the present invention.
Figure 53:
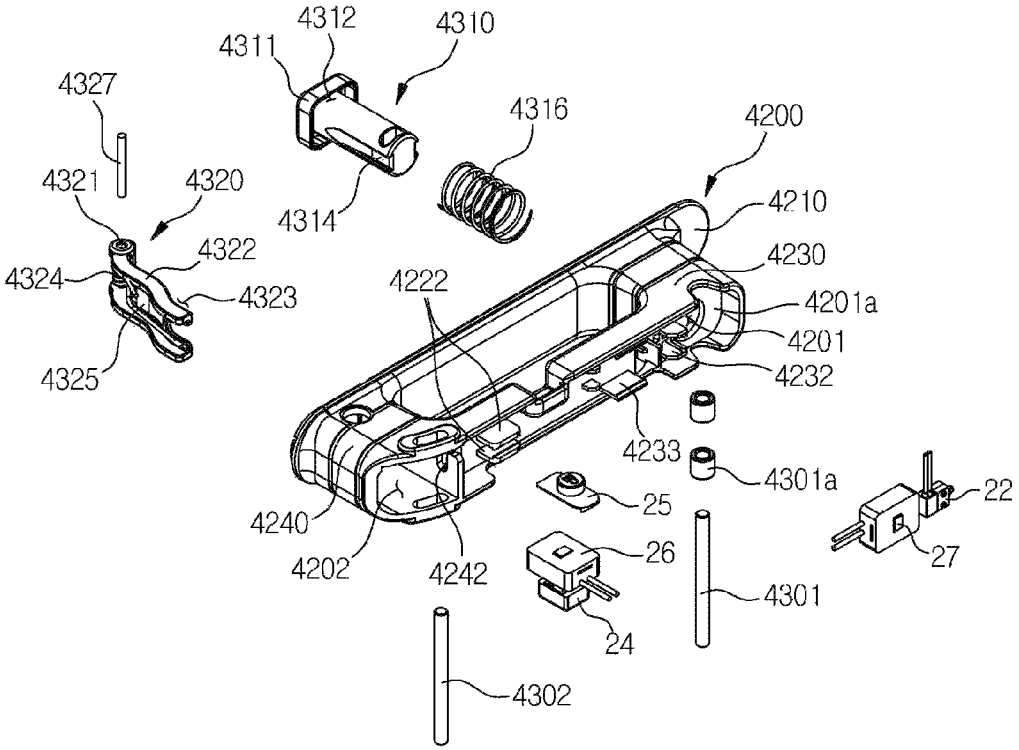
FIG. 53 is a rear exploded perspective view of a handle unit of a flush handle for a vehicle door according to a third preferred embodiment of the present invention.

A handle unit 4200 is illustrated in detail in FIGS. 52 to 53.

The handle unit 4200 is formed, on the whole, in a shape in which left and right sides of a rectangle are protruded rearward. The handle unit 4200 comprises a handle unit main body 4220 corresponding to the rectangle, a left side portion 4230 of the handle unit corresponding to the protruded portion, and a right side portion 4240 of the handle unit.

In the left side portion of the handle unit 4200, an extension portion installation groove 4201 has a shape of a rectangle to be penetrated through the front-to-rear direction, and in the right side portion of the handle unit 4200, a pivot unit installation groove 4202 has a shape of a rectangle to be penetrated through the front-to-rear direction.

The left and right and up and down directions of the extension portion installation groove 4201 and the pivot unit installation groove 4202 are blocked by the handle unit 4200. Due to this, the extension portion 4310, which will be described later, is moved along the extension portion installation groove 4201 within the extension portion installation groove 4201, and the pivot unit 4320 is rotated centered around a pivot pin 4327 within the pivot unit installation groove 4202.

In the rear of the extension portion installation groove 4201, an extension portion engaging plate 4201*a* is installed.

The extension portion engaging plate 4201*a* is formed in the middle in the front-to-rear direction within the extension portion installation groove 4201.

The extension portion engaging plate 4201*a* comprises a circular groove formed to have a diameter equal to or larger than the diameter of the rear portion of the extension portion 4310, which will be described later.

In the lower front portion of the pivot unit installation groove 4202, an LED installation groove 4203 is formed to be penetrated through the up-down direction. In the LED installation groove 4203, a lower portion of the LED 24, which will be described later, is inserted, so that when the handle unit 4200 is withdrawn, a user can check the light of the LED 24 from the outside of the handle unit 4200.

In the left and right sides of the LED installation groove 4203, an LED installation portion 4205 is formed.

The lower end of the LED installation portion 4205 is connected to the lower inner surface of the pivot unit installation groove 4202.

In the upper portion of the LED installation portion 4205, a protrusion protruded toward the LED installation groove 4203 is formed, and thereby the LED 24 may be hook-coupled to the LED installation portion 4205.

In the upper portion of the LED installation unit 4205, a button sensor installation portion 4204 is formed.

The button sensor installation portion 4204 has a shape of a cuboid having an open rear side, so that the button sensor 26 can be inserted from rear to front of the button sensor installation portion 4204.

The upper end of the button sensor installation portion 4204 is connected to the inner surface of the upper portion of the pivot unit installation groove 4202.

In the upper portion of the button sensor installation portion 4204, a button penetrating groove 4206 is formed to be penetrated through the up-down direction.

The button penetrating groove 4206 is formed to be penetrated through the right side portion of the handle unit 4200.

The button 25 is installed in the upper portion of the button sensor 26, and a portion of the button 25 is exposed to the outside through the button penetrating groove 4206. Due to this, when the handle unit 4200 is withdrawn, the user can press the button 25. When the button 25 is pressed, the button sensor 26 is pressed, and the button sensor 26 transmits a signal to a control unit (not shown).

In the left rear side of the pivot unit installation groove 4202, a wire penetrating groove 4242 is formed to be penetrated through the left-to-right direction. The upper portion of the wire penetrating groove 4242 is formed to have an open rear side, so that the wire 20 can be inserted into the wire penetrating groove 4242 through the open portion.

The wire 20 connected to the outside through the third wire penetrating groove 4801 of the first blocking plate 4800 is connected to each sensor of the handle unit 4200 through the wire penetrating groove 4242, and some of them are connected to LED 24 and the button sensor 26.

In the front surface of the handle unit main body 4220, a handle cover installation portion 4210 is formed. The handle cover installation portion 4210 is formed to be extended leftward of the handle unit main body 4220. The handle cover installation portion 4210 comprises a rear plate formed in the shape of a rectangle having arc-shaped left and right sides in accordance with the shape of the handle unit through hole 4101, and a circumferential portion formed to be protruded rearward spaced apart in a predetermined interval inward from the circumference of the rear plate.

In the up, down, left, and right sides of the circumferential portion of the handle cover installation portion 4210, a handle cover fastening portion 4213 in the shape of a hook is formed to be protruded outward. The handle cover fastening portion 4213 comprises: a protrusion formed in a shape inclined further outward of the handle cover installation portion 4210 as it travels from front to rear; and grooves formed penetrating inward and outward in both sides of the protrusion enabling the elastic deformation of the protrusion.

Due to this, a handle cover 4400, which will be described later, is installed on the outer surface of the circumferential portion of the handle cover installation portion 4210.

In the upper and lower portions of the right side of the circumferential portion of the handle cover installation portion 4210, a pivot pin installation groove 4214 is formed to have an open front and to be penetrated through the up-down direction.

In the center of the handle unit main body 4220, a first through hole 4221 is formed to be penetrated through the up-down direction. The first through hole 4221 has a shape of a rectangle with rounded corners. The first through hole 4221 is formed large enough to allow a user's hand to be inserted, so that the user can pull the handle unit 4200 by putting a hand in the first through hole 4221. At this time, due to the shape of the first through hole 4221, the user's grip feeling is enhanced.

In the upper rear of the first through hole 4221, a lever engaging groove 4223 is formed to be open forward and upward. In the lever engaging groove 4223, a portion of the lever 4950 which can be installed in the upper surface of the first housing 4100 is inserted. Due to this, the handle unit 4200 and the lever 4950 can be interlocked with each other.

In the rear surface of the handle unit main body 4220, a wire installation portion 4222 is formed to be protruded rearward. The wire installation portion 4222 is formed in the form of two rectangular plates spaced apart from each other to be facing each other in the up-down direction.

The wire 20 connected to the outside through the third wire penetrating groove 4801 of the first blocking plate 4800 is connected to the second sensor 22 and the fourth sensor 27 installed in the left rear side of the handle unit 4200 through the wire installation portion 4222.

The left side portion of the handle unit 4230 is formed to be open rearward.

The left side portion 4230 of the handle unit comprises a first pin installation groove 4231 formed to be penetrated through the up-down direction.

The first pin installation groove 4231 is disposed in the upper portion and the lower portion of the extension portion installation groove 4201.

In the right side of the handle unit left portion 4230, a second sensor installation groove 4232 is formed to be protruded rearward. In the left side of the second sensor installation groove 4232, a groove is formed to be recessed forward, and thereby the second sensor 22 installed in the second sensor installation groove 4232 is pressed by an extension portion 4310, which will be described later, through the groove.

A fourth sensor installation portion 4233 is formed in the further right side than the second sensor installation groove 4232.

The fourth sensor installation portion 4233 is formed in the form of two rectangular plates spaced apart from each other to be facing each other in the up-down direction.

In the rear side of the fourth sensor installation portion 4233, protrusions are formed in the directions in which the rectangular plates facing each other. Due to this, the fourth sensor 27 is hook-coupled to the fourth sensor installation portion 4233.

The right side portion 4240 of the handle unit is formed to be inclined further forward as the rear side travels from the left side rightward. Due to this, when the handle unit 4200 is rotated counterclockwise centered around the right side portion 4240 of the handle unit, the mutual interference between the handle unit 4200 and the first blocking plate 4800 installed in the rear surface of the first housing 4100 is prevented.

In the left side of the right side portion 4240 of the handle unit, a second pin installation groove 4241 is formed to be penetrated through the up-down direction. The second pin installation groove 4241 is formed in the upper and lower portions of the pivot unit installation groove 4202, and in communication with the pivot unit installation groove 4202.

The handle unit 4200 is connected to the slider 4600 by a second pin 4302 inserted into the second pin installation groove 4241.

<Extension Portion>

Figure 54:
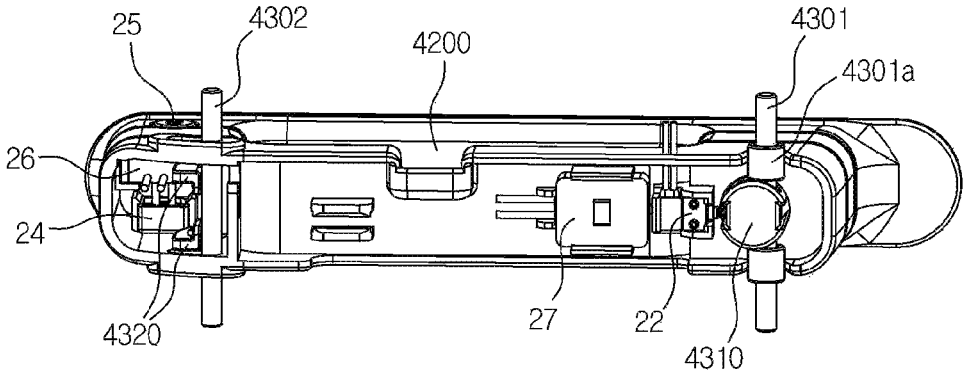
FIG. 54 is a rear perspective view of a handle unit of a flush handle for a vehicle door according to a third preferred embodiment of the present invention.

An extension portion 4310 is illustrated in detail in FIGS. 52 to 54.

The extension portion 4310 is installed in the left side of the handle unit 4200 to be adjustable in length with respect to the first pin 4301.

The extension portion 4310 comprises a head portion 4311 formed in the shape of a rectangular column with rounded corners, and a length portion 4313 formed in the shape of a cylindrical column in the rear side of the head portion 4311. The length of the diameter of the length portion 4313 is formed to be smaller than the length of one side of the head portion 4311.

The head portion 4311 is formed in a shape having an open rear, and an extension portion return spring insertion groove 4312 is formed between the inner surface of the head portion 4311 and the outer surface of the length portion 4313.

In the left and right side surfaces of the length portion 4313, a second sensor anti-pressing portion 4314 is formed to be inclined further toward the center of the length portion 4313 as it travels from front to rear. The second sensor 22 is in contact with only one of the two second sensor anti-pressing portions 4314, but can further enhance the assemblability by forming the second sensor anti-pressing portions 4314 at both of the left and right sides.

At the rear of the length portion 4313, a slot 4315 is formed to be penetrated through the up-down direction. The slot 4315 is formed long in the left-to-right direction.

In the outer side of the length portion 4313, an extension portion return spring 4316 is fitted.

The extension portion 4310 is fitted from front to rear of the handle unit 4200. The rear side of the extension portion 4310 is blocked by the extension portion engaging plate 4201*a* of the left side portion 4230 of the handle unit.

At this time, the front side of the extension portion return spring 4316 is fitted into the extension portion return spring insertion groove 4312, and the rear side is blocked by the extension portion engaging plate 4201*a*, and thereby it is compressed and restored in the front-to-rear direction between the spring insertion groove 4312 and the extension portion engaging plate 4201*a* in accordance with the movement of the handle unit 4200

After the assembly, the first pin 4301 is fitted into the slot 4315 of the extension portion 4310 protruded rearward of the handle unit 4200 and the first inclined long hole 4601 of the slider 4600. Due to this, the left side portion of the handle unit 4200 is connected to the slider 4600.

At this time, due to the shape of the slot 4315, the first pin 4301 is slid freely along the slot 4315 when the handle unit 4200 is rotated. Due to this, the handle unit 4200 can be rotated while keeping the width of the first inclined long hole 4601 constant.

In the upper and lower portions of the first pin 4301, a first pin bumper 4301*a* may be fitted. The first pin bumper 4301*a* has a shape of a cylinder.

The first pin bumper 4301*a* is disposed in the first pin installation groove 4231, thereby alleviating the impact between the handle unit 4200 and the first pin 4301 due to the rotation of the handle unit 4200.

<Pivot Unit>

A pivot unit 4320 is illustrated in detail in FIGS. 52 to 53.

The pivot unit 4320 is installed on the right side of the handle unit 4200 in a way that the rotation axis of the handle unit 4200 can be changed.

The pivot unit 4320 comprises: a rotating shaft 4321 formed in the shape of a letter 'C'; a rotating portion 4322 formed to be extended rearward from the upper and lower portions of the rotating shaft 4321 centered around the rotating shaft 4321; and a pivot unit return spring installation portion 4325 connecting the upper portion of the rotating portion 4322 and the lower portion of the rotating portion 4322 to each other.

The rotating shaft 4321 comprises two discs formed to be spaced apart from each other to be facing in the upward direction, and a bar connecting the discs to each other.

A groove is formed in the disc of the rotating shaft 4321 to be penetrated through the up-down direction. A pivot pin 4327 is inserted into the groove. The length in the height direction of the pivot pin 4327 is formed to be longer than the length in the height direction of the rotating shaft 4321, and after installation, a portion of the upper and lower portions of the pivot pin 4327 is protruded outward of the rotating shaft 4321.

A pivot unit return spring 4324 is installed between the two discs of the rotating shaft 4321.

In the center of the pivot unit return spring 4324, a pivot pin 4327 is inserted. Due to this, the pivot unit return spring 4324 will not be separated along the up-down direction.

The rotating portion 4322 is formed, on the whole, in the shape of a plate extended in the front-to-rear direction. The rotating portion 4322 is formed long enough so that the rear portion of the rotating portion 4322 is engaged with the right side of the pivot unit engaging portion 4803 of the first blocking plate 4800 when the handle unit 4200 is entered.

In the left side of the rear side of the rotating portion 4322, a second pin engagement prevention groove 4323 is formed concavely. When the left side surface of the rotating portion 4322 is in contact with the inner surface of the pivot unit installation groove 4202 of the handle unit 4200, the second pin 4302 is in contact with the second pin engagement prevention groove 4323.

The pivot unit return spring installation portion 4325 has a shape of a rectangular plate. The pivot unit return spring mounting portion 4325 forms a left side surface of the pivot unit 4320.

One side of the pivot unit return spring 4324 is in contact with the pivot unit installation groove 4202 of the handle unit 4200, and the other side is in contact with the right side surface of the pivot unit return spring installation portion 4325. The pivot unit return spring 4324 is wound clockwise centered around the one side. That is, due to the pivot unit return spring 4324, the pivot unit 4320 receives an elastic force in the counterclockwise direction centered around the rotating shaft 4321.

The pivot unit 4320 is installed from front to rear of the handle unit 4200. The front side of the pivot unit 4320 is then blocked by the handle cover 4400 being installed in the front side of the handle unit 4200, and will not be flowed in the rear side by the pivot pin 4327 whose upper and lower portions are installed in the third pin installation groove 4214 of the handle unit 4200.

<Handle Cover>

The handle cover 4400 is formed similarly to the handle cover 1400 of the first embodiment, as illustrated in FIGS. 10 to 11.

In the handle cover 4400 of the third embodiment, like the handle cover 1400 of the first embodiment, a third pin support portion 4402, an extension portion support portion 4403, and a handle fastening portion 4404 are formed, but a configuration similar to the button installation groove 1401 illustrated in FIG. 10 is not formed.

<Bumper Member>

Figure 55:
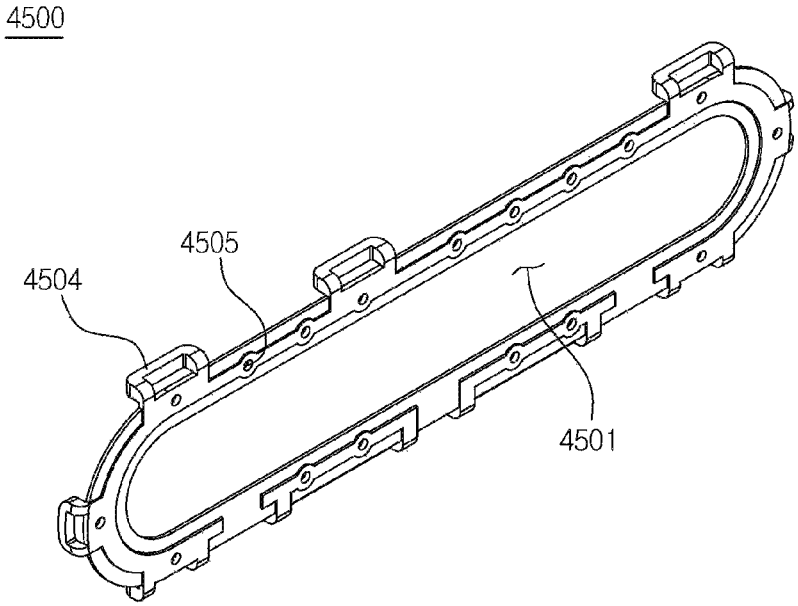
FIG. 55 is a front perspective view of a bumper member of a flush handle for a vehicle door according to a third preferred embodiment of the present invention.

A bumper member 4500 is illustrated in detail in FIG. 55. In the center portion of the bumper member 4500, a handle through hole 4501 through which the handle unit 4200 and the handle cover 4400 are slid is formed to be penetrated through the front-to-rear direction. The handle through hole 4501 has a shape of a rectangle having an arc-shaped left and right sides in accordance with the shape of the front side of the handle unit 4200 and the shape of the handle cover 4400.

The rear side of the bumper member 4500 is coupled with the front surface of the first housing 4100.

In the circumference of the handle through hole 4501, a plurality of first and second housing fastening portions 4504 and 4505 are formed.

The first housing fastening portion 4504 is formed to be extended rearward from the rim of the bumper member 4500, and in the central portion, a groove through which the second bumper fastening portion 4114 of the first housing 4100 can be inserted is formed to be penetrated through the up-down direction.

The second housing fastening portion 4505 is disposed between the first housing fastening portion 4504 and the handle through hole 4501.

The second housing fastening portion 4505 is formed to be penetrated through the front-to-rear direction so that the third bumper fastening portion 4115 of the first housing 4100 can be inserted.

Due to this, the bumper member 4500 and the first housing 4100 can be more firmly coupled.

Due to the bumper member 4500, the first housing 4100 is not directly in contact with the door panel and is protected from an external impact, and also performs a function of dustproofing and waterproofing to prevent contaminants or moisture from entering the housing 1100 from the outside.

<Slider>

Figure 56:
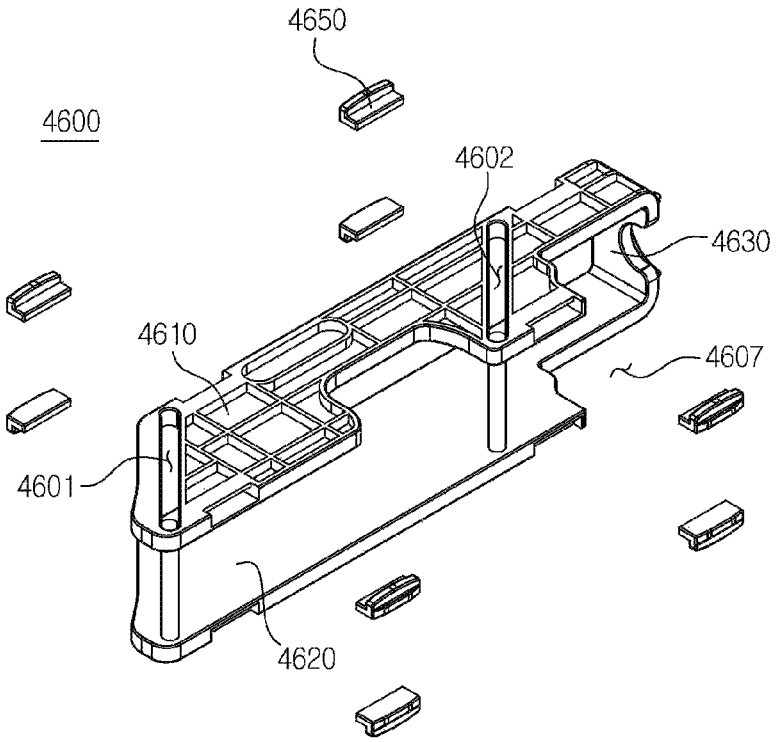
FIG. 56 is a front exploded perspective view of a slider of a flush handle for a vehicle door according to a third preferred embodiment of the present invention.
Figure 57:
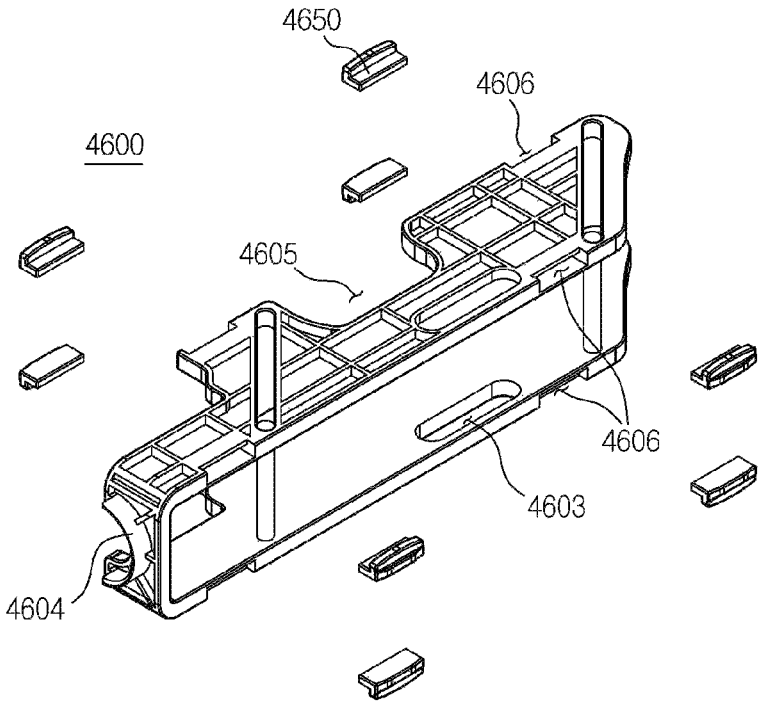
FIG. 57 is a rear exploded perspective view of a slider of a flush handle for a vehicle door according to a third preferred embodiment of the present invention.

A slider 4600 is illustrated in detail in FIGS. 56 to 57.

The slider 4600 comprises an upper surface 4610 and a lower surface 4620 formed to be extended leftward from both upper and lower ends of a right surface 4630 and a right surface 4630. That is, the slider 4600 is formed to be open leftward, forward, and rearward, so that the handle unit 4200 can be accommodated.

The upper surface 4610 and the lower surface 4620 are formed, on the whole, in the form of a rectangular plate. The left side of the upper surface 4610 and the lower surface 4620 is formed to be inclined further rightward as they travel from the front side toward the rear side, and in the right side, a housing interference prevention portion 4607 is formed to have an open front and right side.

Due to this, a space is secured to the left rear side and right front side of the slider 4600, so that it becomes easy to install in the vehicle door panel.

In addition, when the slider 4600 is slid rightward, in the line where the slider 4600 and the first housing 4100 are not interfered, the front-to-rear gap of the right side of the first housing 4100 can be formed as compact as possible.

The first and second inclined long holes 4601 and 4602 are formed in the up-down directions in the left and right sides of the upper surface 4610 and the lower surface 4620.

The first and second inclined long holes 4601 and 4602 are formed parallel to the left side surfaces of the upper surface 4610 and the lower surface 4620.

The first inclined long hole 4601 is formed on the left side of the slider 4600, and the second inclined long hole 4602 is formed on the right side of the slider 4600.

The first inclined long hole 4601 and the second inclined long hole 4602 are formed to have the same width from the front direction up to the rear direction. The width is formed similar to or slightly larger than the size of the diameter of the first pin 4301 and the second pin 4302.

In the rear end portion of the first inclined long hole 4601 and the second inclined long hole 4602, a groove into which the first pin 4301 and the second pin 4302 can be inserted is formed to be extended rearward.

In the upper surface 4610, a lever guide groove 4605 is formed to be penetrated through the front side and up-down direction.

In the rear side of the lower surface 4620, a wire penetrating groove 4603 is formed to be penetrated through the up-down direction. The wire penetrating groove 4603 is formed long in the left-to-right direction so that the wire 20 is not affected by the sliding of the slider 4600.

In the front and rear of the upper surface 4610 and the lower surface 4620, a slider bumper insertion groove 4606 is formed. The slider bumper insertion groove 4606 has a shape of a letter 'L'.

The slider bumper insertion groove 4606 formed in the upper surface 4610 is formed such that a portion of the upper portion and the front side or rear side are open.

The slider bumper insertion groove 4606 formed in the lower surface 4620 is formed such that a portion of the lower portion and the front side or rear side are open.

A slider bumper 4650 is inserted into the slider bumper insertion groove 4606.

In the third embodiment, a total of eight slider bumpers 4650 are inserted.

The slider bumper 4650 has a shape of an 'L'.

The slider bumper 4650 installed in the front side of the upper surface 4610 is described as an example as follows.

The slider bumper 4650 comprises a vertical portion and a horizontal portion, and the horizontal portion is connected to a rear side of the lower portion of the vertical portion. The upper surface and the lower portion of the front surface of the vertical portion are formed to be protruded convexly.

When the slider bumper 4650 is inserted into the slider bumper insertion groove 4606, the upper surface and the lower portion of the front surface of the vertical portion of the slider bumper 4650 is protruded further outward than the slider 4600.

Since the slider bumper 4650 is installed in the front and rear sides of the upper surface 4610 and the lower surface 4620 of the slider 4600, the front and rear surfaces and the upper and lower surfaces of the slider 4600 are spaced apart from the first housing 4100 and the first blocking plate 4800.

The slider bumper 4650 may be provided with a rubber material. Due to this, when the slider 4600 is slid, noise due to the friction can be reduced.

The right surface 4630 is formed, on the whole, in the shape of a rectangular plate.

The right surface 4630 comprises a return spring bumper installation portion 4604 formed to be protruded rightward.

The return spring bumper installation portion 4604 has a shape of a semicircle in which the concave portion is formed rearward. In the inner side of the return spring bumper installation portion 4604, a return spring bumper 4740, which will be described later, is fitted.

<Driving Unit>

Figure 64:
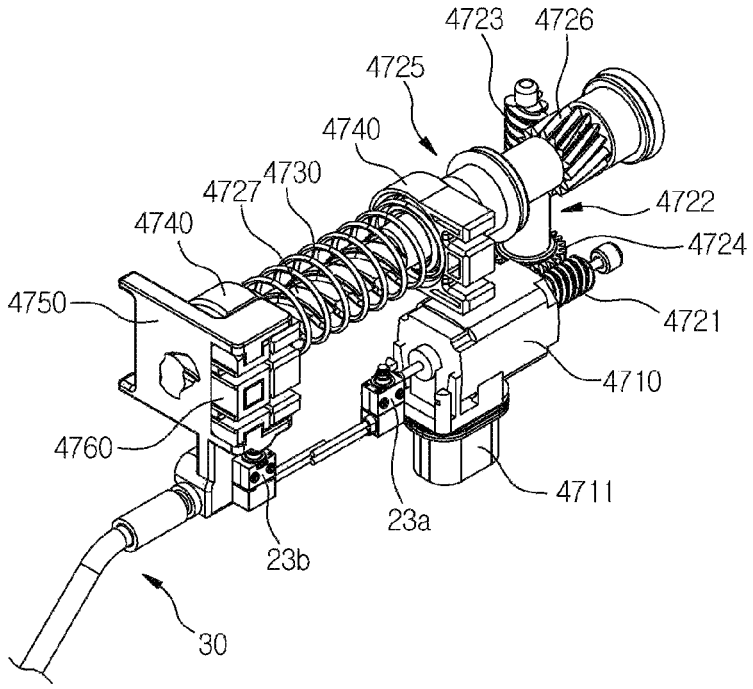
FIG. 64 is a front perspective view of a driving unit of a flush handle for a vehicle door according to a third preferred embodiment of the present invention.
Figure 65:
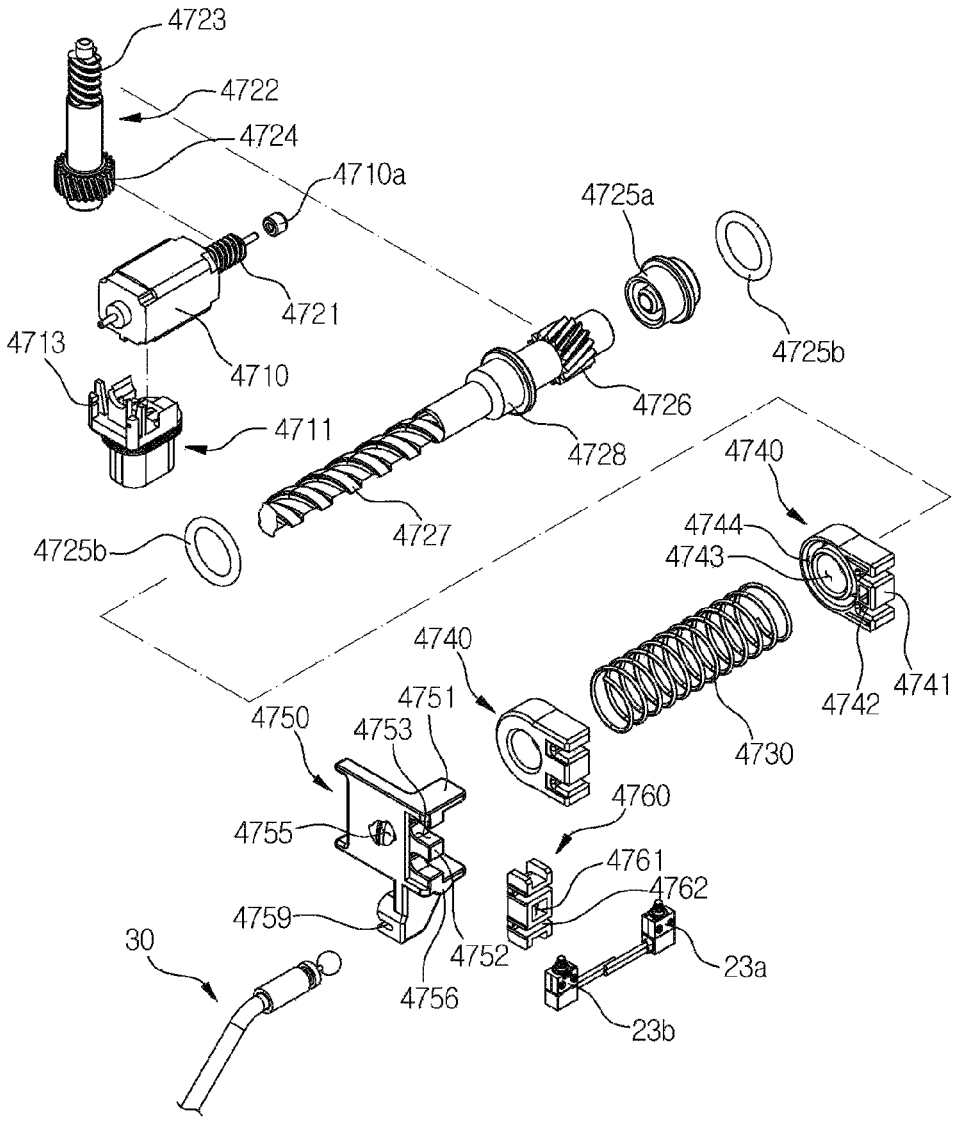
FIG. 65 is a front exploded perspective view of a driving unit of a flush handle for a vehicle door according to a third preferred embodiment of the present invention.
Figure 66:
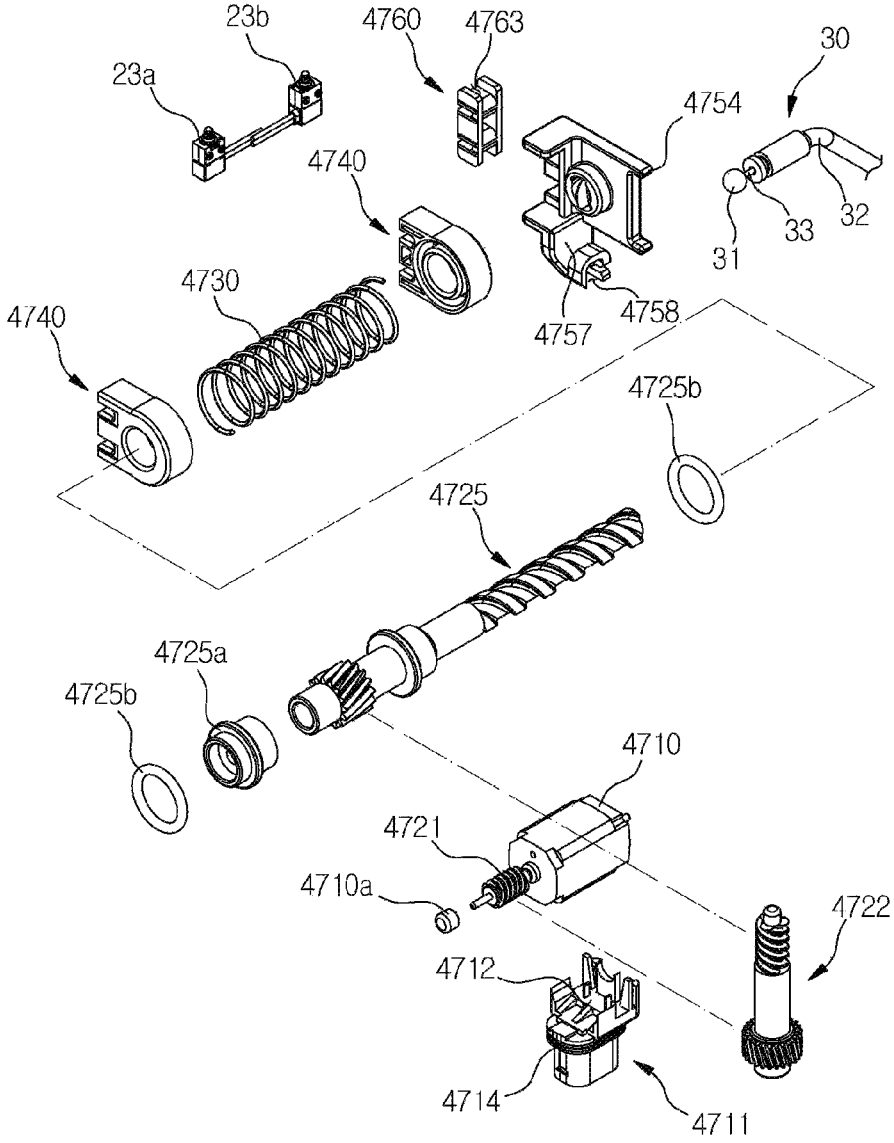
FIG. 66 is a rear exploded perspective view of a driving unit of a flush handle for a vehicle door according to a third preferred embodiment of the present invention.

A driving unit 4700 is illustrated in detail in FIGS. 64 to 66.

The driving unit 4700 comprises a power delivery unit, a first worm 4721 rotated by the power delivery unit, a first double gear 4722 rotated by the first worm 4721, a moving nut 4750 being slid in the left-to-right direction by the first double gear 4722 and the housing 4100.

The power delivery unit may be provided with a motor 4710.

The driving unit 4700 is disposed between the second housing 4160 and the second blocking plate 4170.

The motor 4710 is installed in the left-to-right direction between the first motor installation groove 4167 of the second housing 4160 and the second motor installation groove 4177 of the second blocking plate 4170.

The motor 4710 is operated or stopped by the control unit.

The first worm 4721 is installed in the shaft of the motor 4710.

In the end portion of the motor 4710 shaft, a motor shaft bumper **4710*a*** is installed.

The motor shaft bumper **4710*a* has a shape of a cylindrical column formed with grooves in one side. The motor shaft bumper 4710*a* is fitted between the first motor shaft installation groove 4168*a* of the second housing 4160 and the second motor shaft installation groove 4178*a* of the second blocking plate 4170**.

In the lower portion of the motor 4710, an encoder connector 4711 may be installed.

The central portion of the encoder connector 4711 is installed between the first encoder connector installation groove 4163 of the second housing 4160 and the second encoder connector installation groove 4173 of the second blocking plate 4170, a lower portion of the encoder connector 4711 is protruded toward the lower portion of the second housing 4160 and the second blocking plate 4170.

In the central portion of the encoder connector 4711, an encoder connector bumper 4714 is installed. The encoder connector bumper 4714 is made of a rubber material, and enhances the water tightness of the inner space formed between the second housing 4160 and the second blocking plate 4170.

In the upper portion of the encoder connector 4711, a motor installation portion 4712 is formed to be open upward and rightward.

The encoder connector 4711 is formed to cover a portion of the left side surface and lower surface of the motor 4710 installed in the motor installation portion 4712.

In the left side of the encoder connector 4711, an encoder installation portion 4713 is formed to be protruded upward.

The encoder installation portion 4713 is formed in the front and rear sides of the encoder connector 4711, respectively.

In the upper portion of the encoder mounting portion 4713, a groove is formed to be open inward and to be penetrated through the left-to-right direction. The groove is disposed further lower than the shaft of the motor 4710 installed in the motor installation portion 4712, and an encoder 4715 may be installed.

The first double gear 4722 comprises a second worm 4723 and a first worm wheel 4724 disposed in the second worm 4723 and the lower portion of the second worm 4723.

The second worm 4723 and the first worm wheel 4724 are connected with a single shaft and rotated simultaneously, and the second worm 4723 and the first worm wheel 4724 are spaced apart from each other, and thereby a portion of the shaft is formed between the second worm 4723 and the first the worm wheel 4724.

The first double gear 4722 is disposed in the up-down direction in the rear side of the first worm 4721, and the first worm 4721 is teeth-coupled with the first worm wheel 4724.

The upper portion of the shaft of the first double gear 4722 is fitted to the first double gear installation portion **4166*a* of the second housing 4160, and the central portion of the shaft of the first double gear 4472 is connected to the second double gear installation portion 4166*b*, and the lower portion of the shaft of the first double gear 4722 is fitted into the third double gear installation portion 4166*c***.

Due to this, the front side of the first double gear 4722 is blocked by the second housing 4160.

The rear side of the first double gear 4722 is blocked by the double gear installation groove 4176 of the second blocking plate 4170.

The upper and lower ends of the first double gear 4722 are in contact with the inner surfaces of the second blocking plate 4170, and thereby the first double gear 4722 does not flow in the up-down direction.

The second double gear 4725 comprises a second worm wheel 4726 and a lead screw 4727 disposed at the left side of the second worm wheel 4726.

The second worm wheel 4726 and the lead screw 4727 are connected with a single shaft and rotated simultaneously, and the second worm wheel 4726 and the lead screw 4727 are spaced apart from each other, and thereby a portion of the shaft is formed between the second worm wheel 4726 and the lead screw 4727.

The second double gear 4725 is disposed in the left-to-right direction in the front side of the second worm 4723, and the second worm 4723 is teeth-coupled with the second worm wheel 4726.

A housing engaging plate 4728 is formed between the second worm wheel 4726 and the lead screw 4727.

The diameter of the housing engaging plate 4728 is formed to be larger than the diameter of the shaft of the second double gear 4725. An engaging step is formed in the right side of the housing engaging plate 4728.

The left side of the housing engaging plate 4728 is inserted between the second lead screw penetrating groove 4162 of the second housing 4160 and the fourth lead screw penetrating groove 4172 of the second blocking plate 4170.

The diameter of the engaging step of the housing engaging plate 4728 is formed to be larger than the diameter of the second and fourth lead screw penetrating grooves 4162 and 4172.

Due to this, the right side of the housing engaging plate 4728 is engaged with the inner side of the second housing 4160 and the second blocking plate 4170 and does not flow leftward.

In the right side of the second double gear 4725, a second double gear head 4725*a* is installed.

In the left side of the second double gear head 4725*a*, a groove in which the right side of the second double gear 4725 can be fitted is formed.

In the right side of the second double gear head 4725*a*, an engaging step is formed.

A second double gear bumper 4725*b* may be further installed between the engaging step of the housing engaging plate 4728 and the inner surfaces of the second housing 4160 and the second blocking plate 4170. The second double gear bumper 4725*b* may be made of a rubber material. Due to this, the inner space formed between the second housing 4160 and the second blocking plate 4170 is sealed separately from the inner space formed between the first housing 4100 and the first blocking plate 4800, thereby enhancing water tightness. The vibration and noise are also reduced.

Between the engaging step of the second double gear head 4725*a* and the inner surfaces of the second housing 4160 and the second blocking plate 4170, a second double gear bumper 4725*b* may be further installed.

The diameter of the second double gear bumper 4725*b* is formed to be larger than the diameter of the engaging step of the housing engaging plate 4728 and the engaging step of the second double gear head 4725*a*. The flow in the left-to-right direction and the noise of the second double gear 4725 may be reduced by such the second double gear bumper 4725*b*.

In the outer side of the lead screw 4725, a slider return spring 4730 is installed.

In both sides of the slider return spring 4730, a return spring bumper 4740 is installed.

The return spring bumper 4740 is formed, on the whole, in the shape of a circular pipe.

In the return spring bumper 4740, a guide portion 4471 is formed to be protruded forward.

In the upper and lower portions of the guide portion 4741, a housing insertion groove 4742 is formed to be open forward and to be penetrated through the left-to-right direction.

In the housing insertion groove 4742, a third guide portion 4106 of the first housing 4100 is inserted. Due to this, the return spring bumper 4740 can be slid in the left-to-right direction and does not flow in the up-down direction.

In the return spring bumper 4740, a lead screw installation groove 4743 is formed to be penetrated through the left-to-right direction.

In one side of the housing insertion groove 4742, a slider return spring installation groove 4744 is formed.

The slider return spring installation groove 4744 is formed to be spaced apart from the lead screw installation groove 4743 in the circumference of the lead screw installation groove 4743.

The return spring bumper 4740 installed in the left side of the slider return spring 4730 is installed in the return spring bumper installation portion 4604 of the slider 4600, and the rear side is blocked by the return spring bumper installation portion 4604.

The rear side of the return spring bumper 4740 installed in the right side of the slider return spring 4730 is blocked by the first blocking plate 4800.

Due to the return spring bumper 4740, the noise, vibration, and the like generated during the operation of the slider return spring 4730 are absorbed by the return spring bumper 4740.

The moving nut 4750 is formed, on the whole, in the shape of a rectangular plate.

The moving nut 4750 is disposed such that the wide surface thereof is disposed facing the left-to-right direction.

In the moving nut 4750, a moving nut bumper installation portion 4472 is formed to be protruded forward.

In the upper and lower ends of the moving nut bumper installation portion 4752, a return spring bumper installation portion 4751 is formed to be protruded rightward.

The inner surface of the return spring bumper installation portion 4751 is formed to be in contact with the outer surface of the return spring bumper 4740 after the return spring bumper 4740 is installed.

In the moving nut bumper installation portion 4752, a moving nut bumper insertion groove 4703 is formed to be open forward.

The moving nut bumper insertion groove 4753 is formed in a shape in which both sides of the rectangle are protruded upward and downward so that the moving nut bumper 4760, which will be described later, can be inserted.

In the upper and lower portions of the moving nut 4750, a blocking plate contact protrusion 4754 is formed to be protruded rearward.

Due to the blocking plate contact protrusion 4754, the moving nut 4750 may make a line contact with the first blocking plate 4800. Due to this, when the moving nut 4750 is slid in the left-to-right direction, the friction force between the moving nut 4750 and the first blocking plate 4800 can be minimized.

In the central portion of the moving nut 4750, a lead screw insertion groove 4755 is formed to be penetrated through the left-to-right direction. The lead screw insertion groove 4755 is formed in the form of a female screw, and may be teeth-coupled with the lead screw 4727.

In the lower portion of the moving nut 4750, a third sensor pressing portion 4756 is formed to be protruded downward over the moving nut bumper installation portion 4752 and the return spring bumper installation portion 4751.

The third sensor pressing portion 4756 is protruded sufficiently to press the upper portions of the third sensors 23*a* and 23*b* when the moving nut 4750 is slid in the left-to-right direction.

The moving nut 4750 is disposed in the slider 4600 in a way that the third sensor pressing portion 4756 is disposed further at front direction than the front surface of the slider 4600. Due to this, the interference between the slider 4600 and the third sensor pressing portion 4756 is prevented when only the slider 4600 is slid in the left-to-right direction while the moving nut 4750 remains fixed.

In the moving nut 4750, a door latch connection portion installation portion 4757 is formed to be protruded downward.

The door latch connection portion installation portion 4757 is disposed at the rear side further than the moving nut bumper installation portion 4752.

The door latch connection portion installation portion 4757 is formed to be bent rearward.

The door latch connection portion installation portion 4757 comprises an engaging protrusion insertion groove 4758 and a cable penetrating groove 4759.

The engaging protrusion insertion groove 4758 is formed to be open rearward and downward.

The cable penetrating groove 4759 is formed to be open rearward and to be penetrated through the left-to-right direction in the central portion of the engaging protrusion insertion groove 4758.

The width in the up-down direction of the cable penetrating groove 4759 is formed to be narrower than the width in the up-down direction of the insertion groove 4758.

Due to this, the locking protrusion 31 and the cable 33 of the door latch connection portion 30 can be inserted from rear to front of the door latch connection portion installation portion 4757. In addition, after installation, since the protrusion 31 does not flow in the left-to-right direction, when the moving nut 4750 is slid in the left-to-right direction, the engaging protrusion 31 is also slid along the moving nut 4750 in the left-to-right direction.

Since the tube 32 of the door latch connection portion 30 is fixed by the door latch connection portion installation groove 4105 of the first housing 4100, when the engaging protrusion 31 is slid in the left-to-right direction, only the cable 33 is slid in the left-to-right direction while the tube 32 remains fixed.

The moving nut 4750 is disposed at the left side further than the right surface 4630 of the slider 4600. Due to this, when the moving nut 4750 is moved to the right side, the slider 4600 is moved to the right side by the moving nut 4750, and when the moving nut 4750 is moved to the left side, the slider 4600 is moved to the left side by the slider return spring 4730.

As described previously, by connecting the door latch connection portion 30 to the moving nut 4750 rather than the slider 4600, safety is enhanced than the slider 4600 that can be moved by an external impact and a manual operation of the handle unit 4200.

The moving nut bumper 4760 is formed, on the whole, in shape of a cuboid.

In the central portion of the moving nut bumper 4760, a first moving nut fitting groove 4761 is formed to be penetrated through the front-to-rear direction.

The first moving nut fitting groove 4761 has a shape of a rectangle and is fitted to the moving nut bumper installation portion 4752 formed in the middle of the moving nut 4750.

In the upper and lower portions of the moving nut bumper 4760, a third guide portion insertion groove 4762 and a second moving nut fitting groove 4763 are formed.

The third guide portion insertion groove 4762 is formed to be open forward and to be penetrated through the left-to-right direction. The third guide portion insertion groove 4762 is fitted to the third guide portion 4106 of the first housing 4100.

Due to this, the moving nut bumper 4760 may be slid in the left-to-right direction along the third guide portion 4106.

The second moving nut fitting groove 4763 is formed to be open upward or downward and to be penetrated through the front-to-rear direction.

The second moving nut fitting groove 4763 is disposed at the outer side further than the third guide portion insertion groove 4762.

The second moving nut fitting groove 4763 is fitted to the moving nut bumper installation portion 4752 formed on the upper and lower portions of the moving nut 4750.

Due to this, the moving nut bumper 4760 is fitted to the moving nut 4750 so as not to flow in the left-to-right direction and up-down direction, and the moving nut 4750 is also can be slid in the left-to-right direction along the third guide portion 4106.

By the moving nut bumper 4760, the noise due to friction when the moving nut 4750 is slid in the left-to-right direction can be reduced.

The return spring bumper 4740 and the moving nut bumper 4760 can be slid in the left-to-right direction, due to the third guide portion 4106, without being rotated with the lead screw 4727 when the lead screw 4727 is rotated.

<Door Latch Connection Portion>

The door latch connection portion 30 is of the same type as the door latch connection portion 30 of the first embodiment.

One end of the door latch connection portion 30 is connected to the moving nut 4750, and the other end is connected to the motorized latch unit 5000.

A groove is formed in the circumference of one side of the tube 32. The tube 32 is fixed to the first housing 4100 by fitting the groove into the door latch connection portion installation groove 4105 of the first housing 4100.

<Key Lock Unit>

Figure 67:
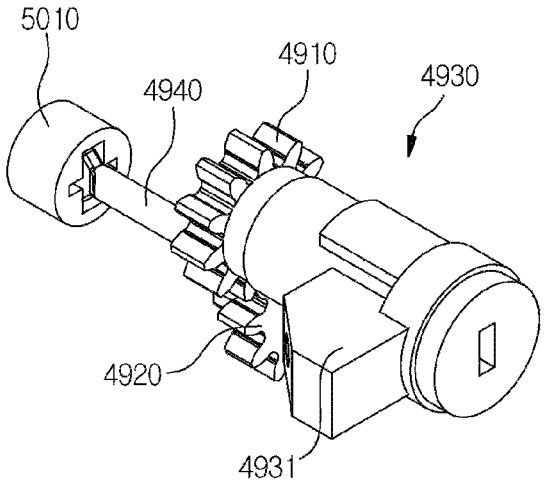
FIG. 67 is a front perspective view of a key lock unit of a flush handle for a vehicle door according to a third preferred embodiment of the present invention.
Figure 68:
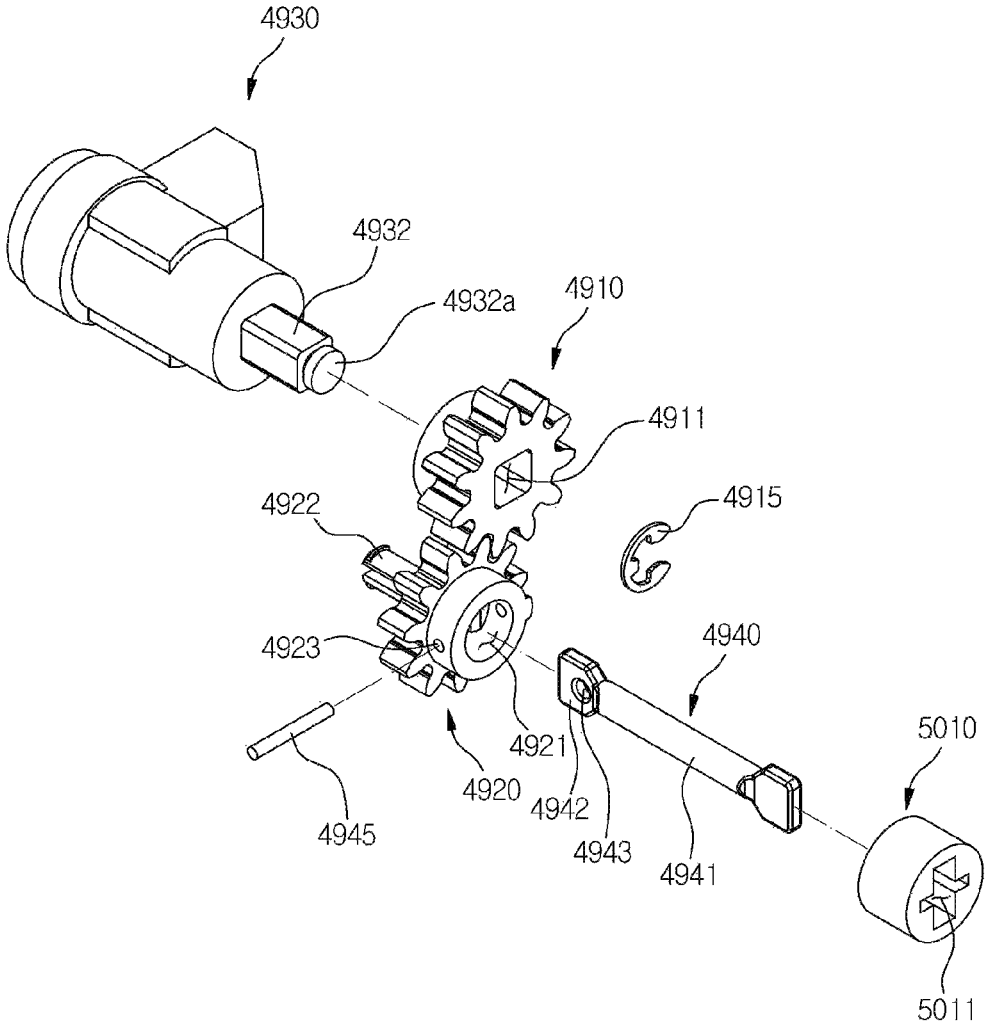
FIG. 68 is a rear exploded perspective view of a key lock unit of a flush handle for a vehicle door according to a third preferred embodiment of the present invention.

A key lock unit 4900 is illustrated in detail in FIGS. 67 to 68.

The key lock unit 4900 comprises: a key cylinder 4930 that a user can operate with a key; a first gear 4910 interlocked with the key cylinder 4930; a second gear 4920 teeth-coupled with and rotated by the first gear 4910; and a gear rod 4940 connecting the second gear 4920 and the motorized latch unit 5000.

In the key cylinder 4930, a first housing fastening portion 4831 is formed to be protruded to the left side.

In the first housing fastening portion 4931, a groove into which a bolt can be inserted is formed, and the groove is in communication with a key cylinder fastening portion 4123 of the first housing 4100. Due to this, the first housing 4100 and the key cylinder 4930 are fastened by bolts.

In front side of the key cylinder 4930, a groove that can be turned by inserting a key is formed.

In the rear side of the key cylinder 4930, a first gear installation shaft 4932 is formed.

The first gear installation shaft 4932 has a shape of a rectangular column. The first gear installation shaft 4932 is rotated in conjunction with a portion that is rotated in the key cylinder 4930 when the key is inserted and turned.

In the rear side the first gear installation shaft 4932, a first gear clip engaging portion 4932*a* is formed.

The first gear clip engaging portion 4932*a* has a shape of a circle.

The diameter of the first gear clip engaging portion 4932*a* is equal to or smaller than the length of one side of the first gear installation shaft 4932.

Due to this, the first gear 4910 may pass through the first gear clip engaging portion 4932*a* and be installed on the first gear installation shaft 4932, and due to the shape of the first gear installation shaft 4932, the first gear 4910 can be rotated in conjunction with the rotation of the key without being idle.

In the first gear clip engaging portion 4932*a*, a groove is formed in the circumference of a portion connected to the first gear installation shaft 4932.

Due to this, when the first gear clip 4915 is inserted into the groove of the first gear clip engaging portion 4932*a*, in a state in which the first gear 4910 is fitted in the first gear installation shaft 4932, the rear side of the first gear 4910 is blocked by the first gear clip 4915, so that the first gear 4910 is not slipped out from the first gear installation shaft.

The first gear 4910 and the second gear 4920 may be provided as spur gears.

In the first gear 4910, a key cylinder insertion groove 4911 is formed to be penetrated through the front-to-rear direction.

The key cylinder insertion groove 4911 has a shape of a rectangle so that the first gear 4910 can be fitted to the first gear installation shaft 4932 of the key cylinder 4930.

In the second gear 4920, a gear rod installation groove 4921 is formed to be open rearward.

In the rear side of the second gear 4920, a first installation pin insertion groove 4923 is formed to be penetrated through the left-to-right direction. The first installation pin insertion groove 4923 is in communication with the gear rod installation groove 4921.

In the front side of the second gear 4920, a second gear shaft 4922 is formed to be protruded forward.

In the upper and lower portions of the front side of the second gear shaft 4922, a protrusion is formed protruded outward, and the central portion is formed to be open forward, leftward, and rightward. Due to this, the second gear shaft 4922 is hook-coupled to the second gear installation groove 4814 of the first blocking plate 4800.

The gear rod 4940 comprises a rod 4941 and an insert portion 4942 formed in both sides of the rod 4941.

The rod 4941 has a shape of a cylindrical column, and the insert portion 4942 is formed in the form of a plate.

In the one side of the insert portion 4942, a second installation pin insertion groove 4943 is formed to be penetrated through the left-to-right direction.

Due to this, the insert portion 4942 in which the second installation pin insertion groove 4942 is formed is inserted into the gear rod installation groove 4921 of the second gear 4920, and when the installation pin 4945 is passed through the first installation pin insertion groove 4923 of the second gear 4920 and the second installation pin insertion groove 4942 of the gear rod 4940, the second gear 4920 and the gear rod 4940 are connected to each other.

The remaining other side of the insert portion 4942 of the gear rod 4940 is connected to the door latch key 5010 of the motorized latch unit 5000.

The door latch key 5010 is formed with a cross-shaped gear rod insertion groove 5011 in which the insert portion 4942 can be installed. Due to this, the first gear 4910 is rotated when the key is inserted to rotate a portion of the key cylinder 4930, the second gear 4920 engaged with the first gear 4910 is rotated, the gear rod 4940 installed in the second gear 4920 is rotated, the door latch key 5010 is rotated by the gear rod 4940, and thereby the motorized latch unit 5000 can be unlocked.

Hereinafter, a method of operating a flush handle for a vehicle door according to a third embodiment of the present invention having the previously described configuration will be described.

<Manual Operation Process>

The manual operation process of a flush handle for a vehicle door according to the third embodiment is the same as the operating method of the first embodiment.

<Motorized Operation Process>

Hereinafter, a process in which the handle unit 4200 is operated through motorized movement will be described.

Figure 45:
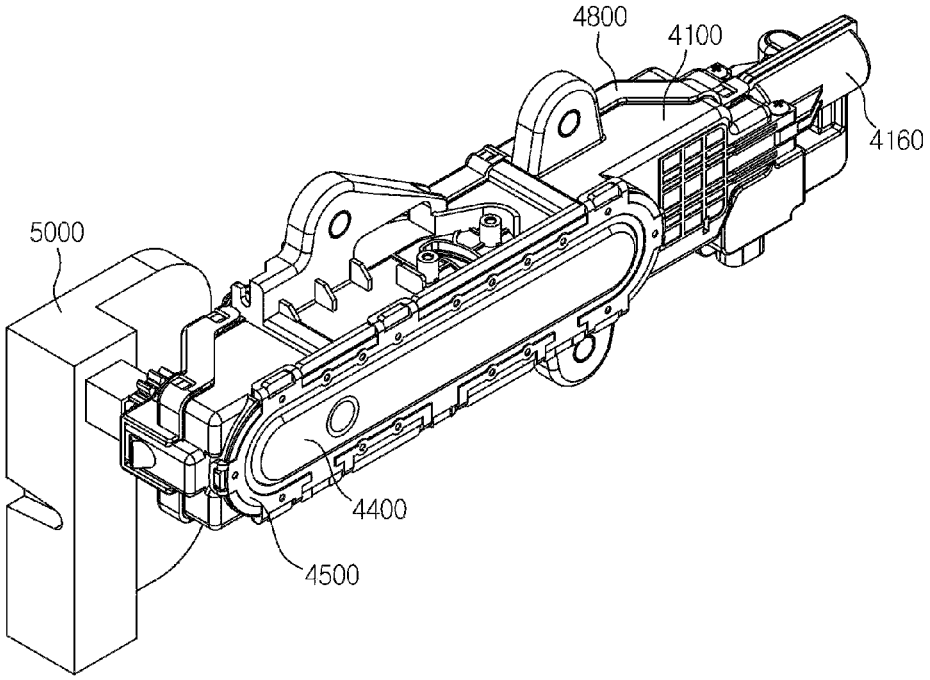
FIG. 45 is a front perspective view of a flush handle for a vehicle door according to a third preferred embodiment of the present invention.
Figure 46:
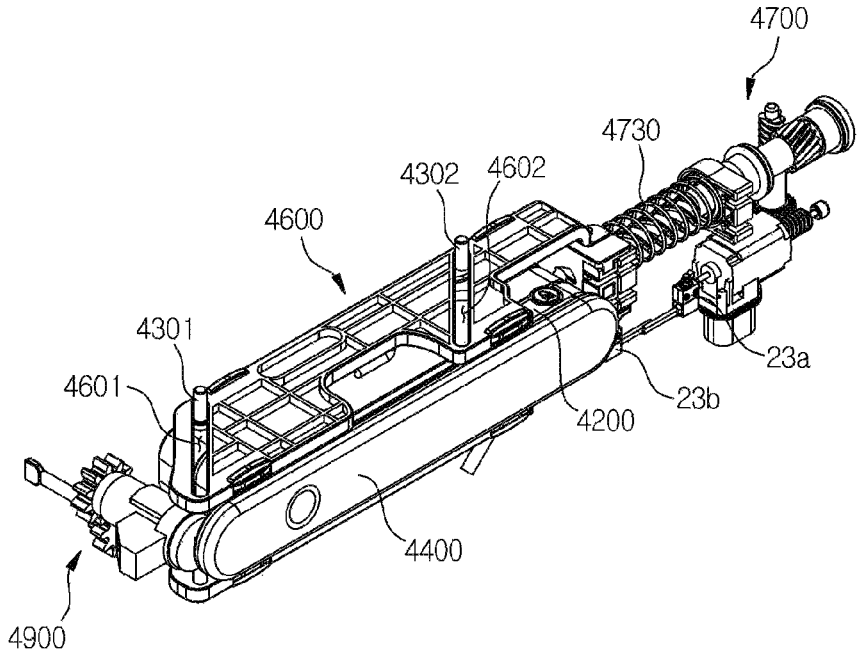
FIG. 46 is a front perspective view of a flush handle for a vehicle door according to a third preferred embodiment of the present invention (excluding the housing and blocking plate)
Figure 47:
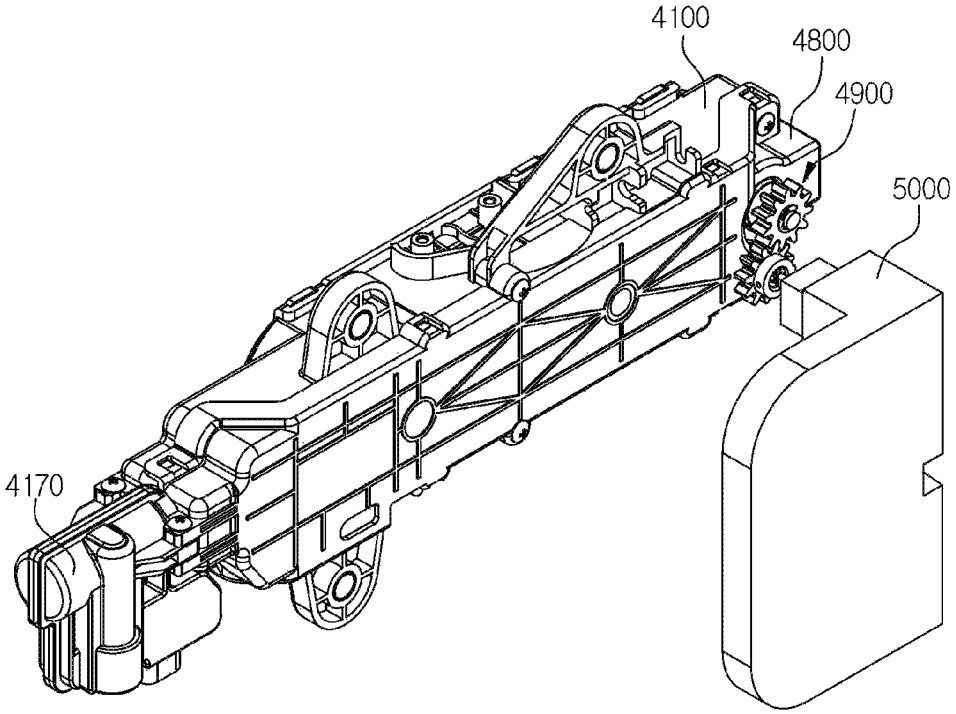
FIG. 47 is a rear perspective view of a flush handle for a vehicle door according to a third preferred embodiment of the present invention.
Figure 48:
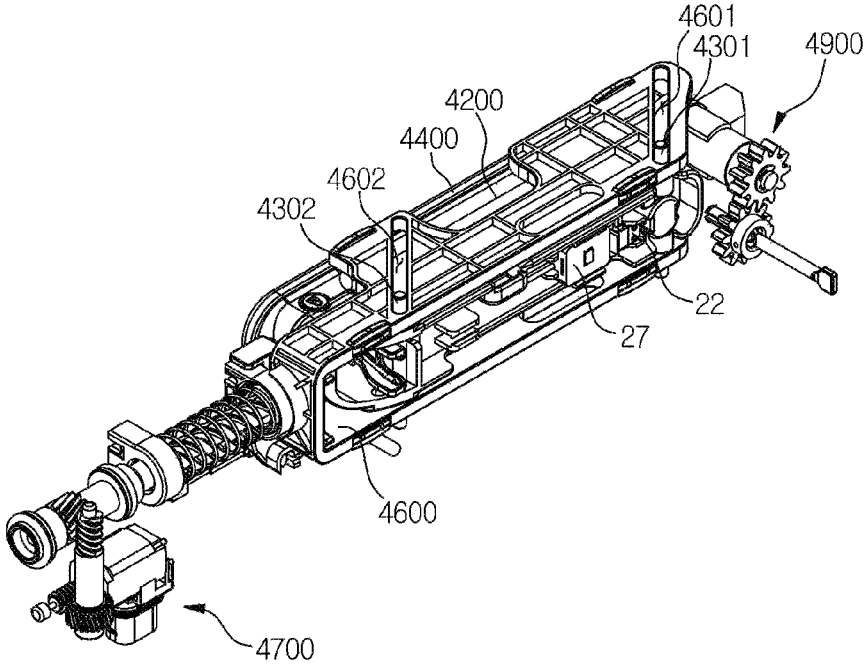
FIG. 48 is a rear perspective view of a flush handle for a vehicle door according to a third preferred embodiment of the present invention (excluding the housing and blocking plate)
Figure 49:
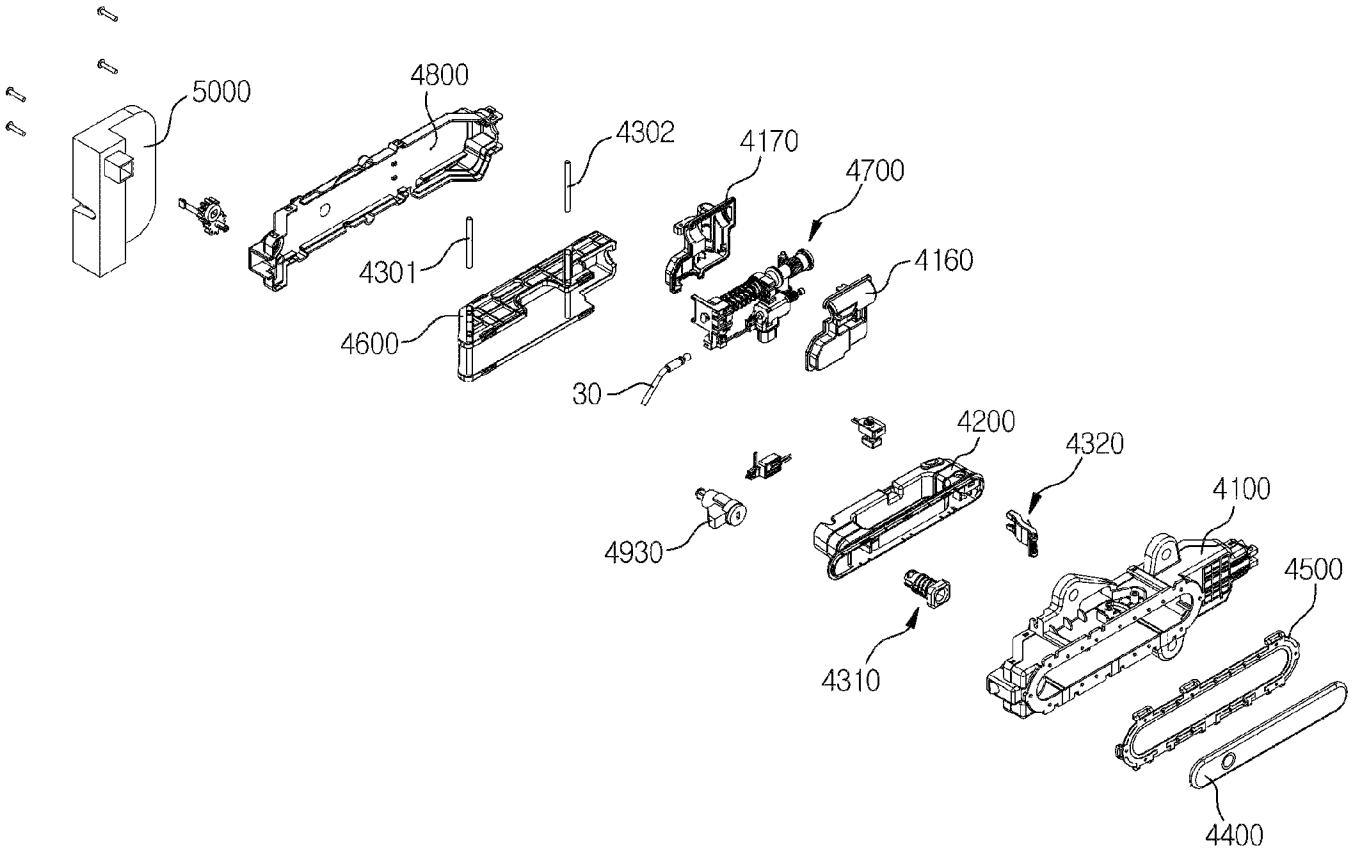
FIG. 49 is a front exploded perspective view of a flush handle for a vehicle door according to a third preferred embodiment of the present invention.

As illustrated in FIGS. 45 to 46, when the withdrawal of the handle unit 4200 is inputted through a key or a remote controller, a button, and the like while the handle unit 4200 is being entered, the motor 4710 is operated by the control unit.

Figure 74:
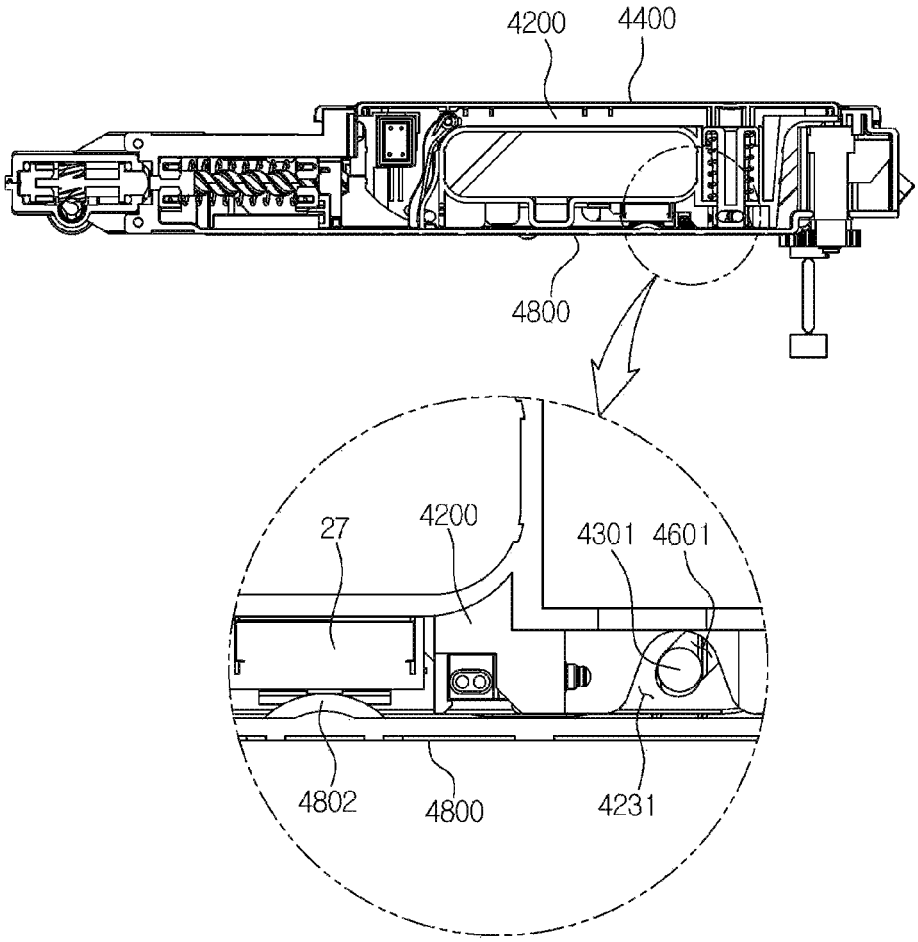
FIG. 74 is a partial cross-sectional view of a flush handle for a vehicle door according to a third preferred embodiment of the present invention.

The input of the withdrawal signal of the handle unit 4200 using a button will be described in detail with reference to FIG. 74 as follows.

When a user presses the handle unit 4200 that is entered toward the inner side of the vehicle, the first pin 4301 is inserted into the groove at the rear side of the first inclined long hole 4601 of the slider 4600, and thereby the handle unit 4200 is pushed rearward.

When the handle unit 4200 is pushed rearward, the fourth sensor 27 is pressed by the fourth sensor pressing portion 4802 of the first blocking plate 4800 and a signal is transmitted to the control unit.

When the motor 4710 is operated, the first worm 4721 is rotated; the first worm wheel 4724 of the first double gear 4722 engaged with the first worm 4721 is rotated; when the second worm 4723 is rotated with the first worm wheel 4724, the second worm wheel 4726 of the second double gear 4725 engaged with the second worm 4723 is rotated; and the lead screw 4727 is rotated together with the second worm wheel 4726.

When the lead screw 4727 is rotated, the moving nut 4750 teeth-coupled to the lead screw 4727 is moved rightward, and the slider 4600 is moved rightward by the moving nut 4750.

When the slider 4600 is moved rightward, the first pin 4301 and the second pin 4302 are moved forward along the first and second inclined long holes 4601 and 4602 of the slider 4600.

Figure 69:
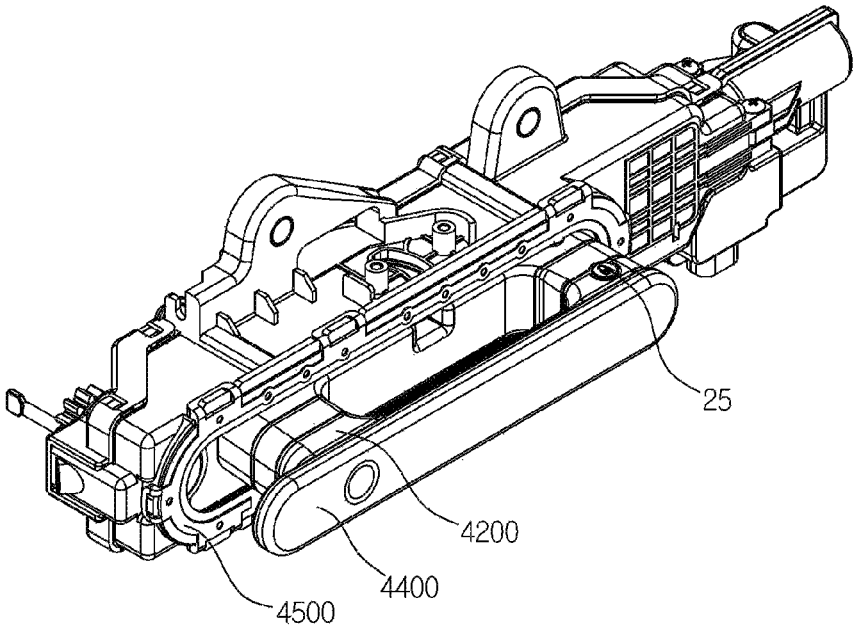
FIG. 69 is a front perspective view of a flush handle for a vehicle door according to a third preferred embodiment of the present invention.
Figure 71:
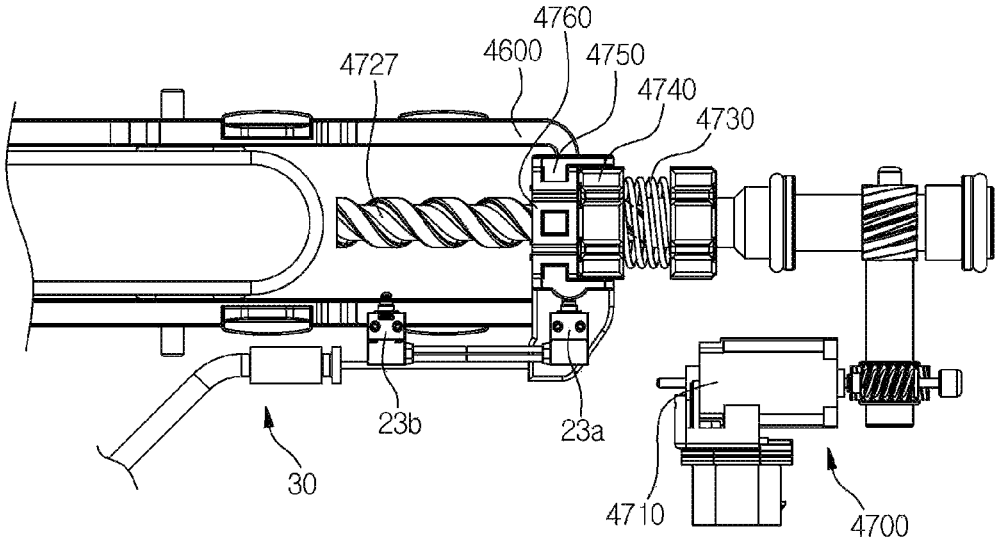
FIG. 71 is a partial front view of a flush handle for a vehicle door according to a third preferred embodiment of the present invention in a state of being withdrawn (excluding the housing and blocking plate)
Figure 72:
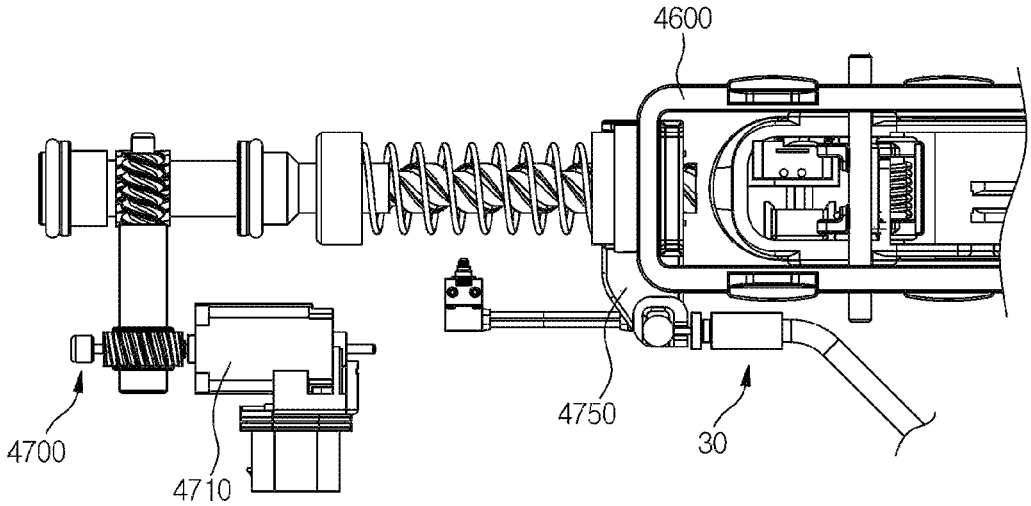
FIG. 72 is a partial rear view of a flush handle for a vehicle door according to a third preferred embodiment of the present invention in a state of being entered (excluding the housing and blocking plate)
Figure 73:
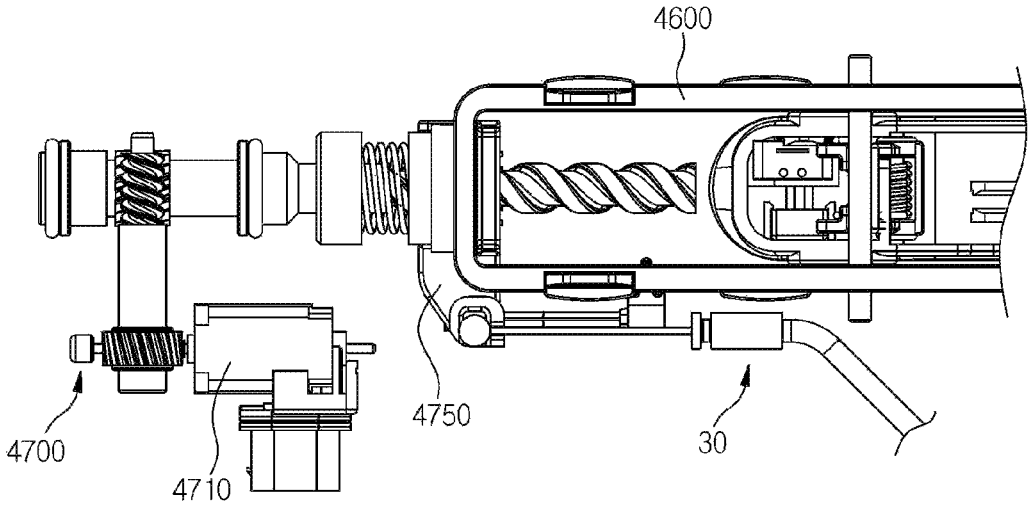
FIG. 73 is a partial rear view of a flush handle for a vehicle door according to a third preferred embodiment of the present invention in a state of being withdrawn (excluding the housing and blocking plate)

Accordingly, the handle unit 4200 is withdrawn forward and is in a state as illustrated in FIGS. 69, 71, and 73.

When the moving nut 4750 is moved to the right, the third sensor pressing portion 4756 of the moving nut 4750 presses the third sensor 23*a* on the right side as illustrated in FIG. 71. When the third sensor 23*a* is pressed, the operation of the motor 4710 is stopped.

In addition, when the moving nut 4750 is slid rightward, the door latch connection portion 30 is pulled, and thereby the motorized latch unit 5000 is unlocked.

The principle of unlocking the motorized latch unit 5000 is the same as the operating method of the first embodiment.

Figure 83:
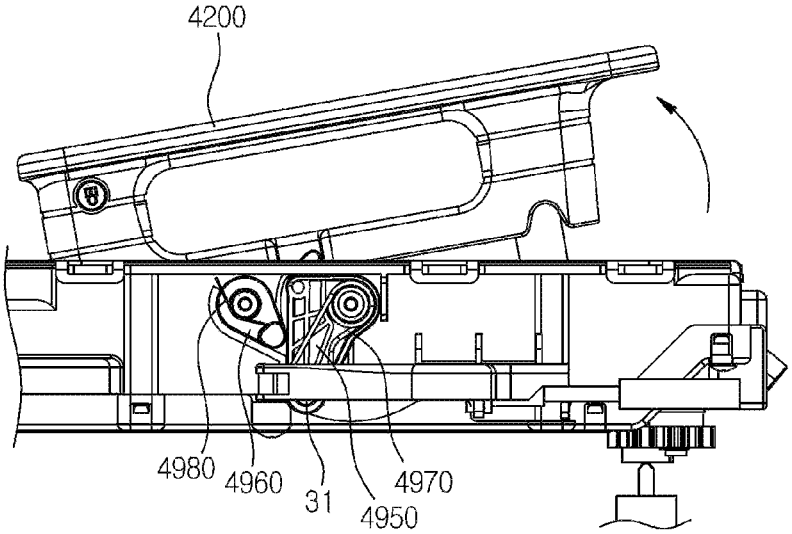
FIG. 83 is a plan view of a flush handle for a vehicle door according to a fifth preferred embodiment of the present invention in a state of being pulled after being withdrawn.

As illustrated in FIG. 83, when the left side of the handle unit 4200 is pulled forward, unlike when the handle unit 4200 is entered, since the rear side of the pivot unit 4320 is not fixed, the handle unit 4200 is rotated counterclockwise centered around the second pin 4302.

As the left side of the handle unit 4200 is rotated, the extension portion return spring 4316 in the extension portion 4310 is compressed. As the handle unit 4200 is slid forward with respect to the extension portion 4310, the second sensor 22 installed at the rear side of the handle unit 4200 is separated from the second sensor anti-pressing portion 4314 formed at the rear side of the extension portion 4310, and pressed by the outer surface of the length portion 4313 of the extension portion 4310.

When the first sensor 21 of the motorized latch unit 5000, the second sensor 22 of the handle unit 4200, and the third sensor 23*a* at the right side are all pressed, the motorized latch unit 5000 is driven, thereby opening the door panel.

When the user releases the handle unit 4200, the handle unit 4200 returns to the state as illustrated in FIG. 69 by the extension portion return spring 4316 of the extension portion 4310.

After that, when the motor 4710 is rotated in the opposite direction when the handle unit 4200 is withdrawn by a button input, as the moving nut 4750 is moved leftward, the slider 4600 is moved leftward due to the restoring force of the slider return spring 4730.

When the slider 4600 is moved leftward, the first pin 4301 and the second pin 4302 are moved toward the rear side along the first and second inclined long holes 4601 and 4602 of the slider 4600.

Figure 70:
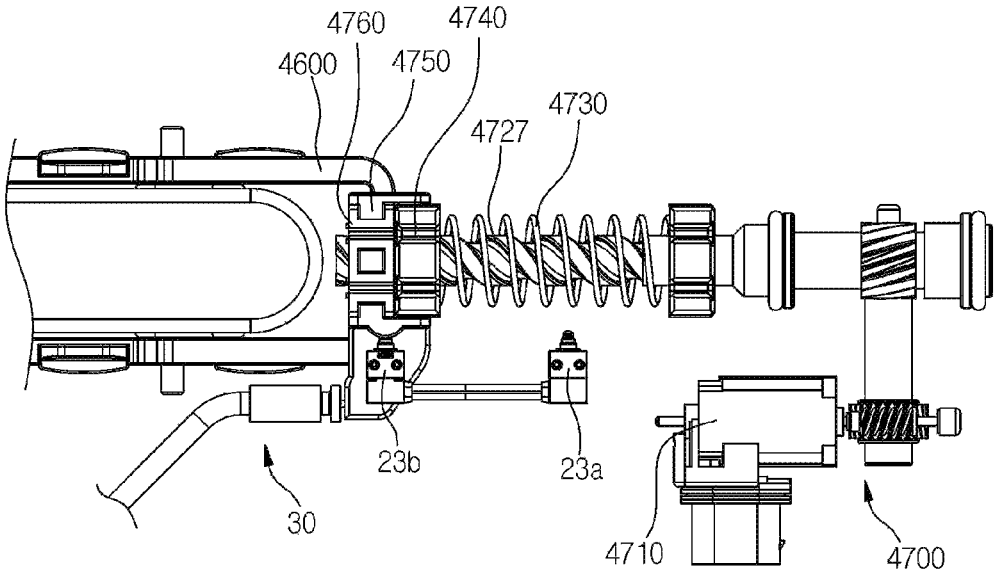
FIG. 70 is a partial front view of a flush handle for a vehicle door according to a third preferred embodiment of the present invention in a state of being entered (excluding the housing and blocking plate)

When the moving nut 4750 is moved leftward, the third sensor pressing unit 4756 of the moving nut 4750 presses the third sensor 23*b* in the left side as illustrated in FIG. 70. When the third sensor 23*b* is pressed, the operation of the motor 4710 is stopped.

When the moving nut 4750 is moved leftward, the door latch connection portion 30 is returned to its original state, and the motorized latch unit 5000 is locked. The principle that the motorized latch unit 5000 is locked is the same as the operating method of the first embodiment.

Embodiment 4

Figure 75:
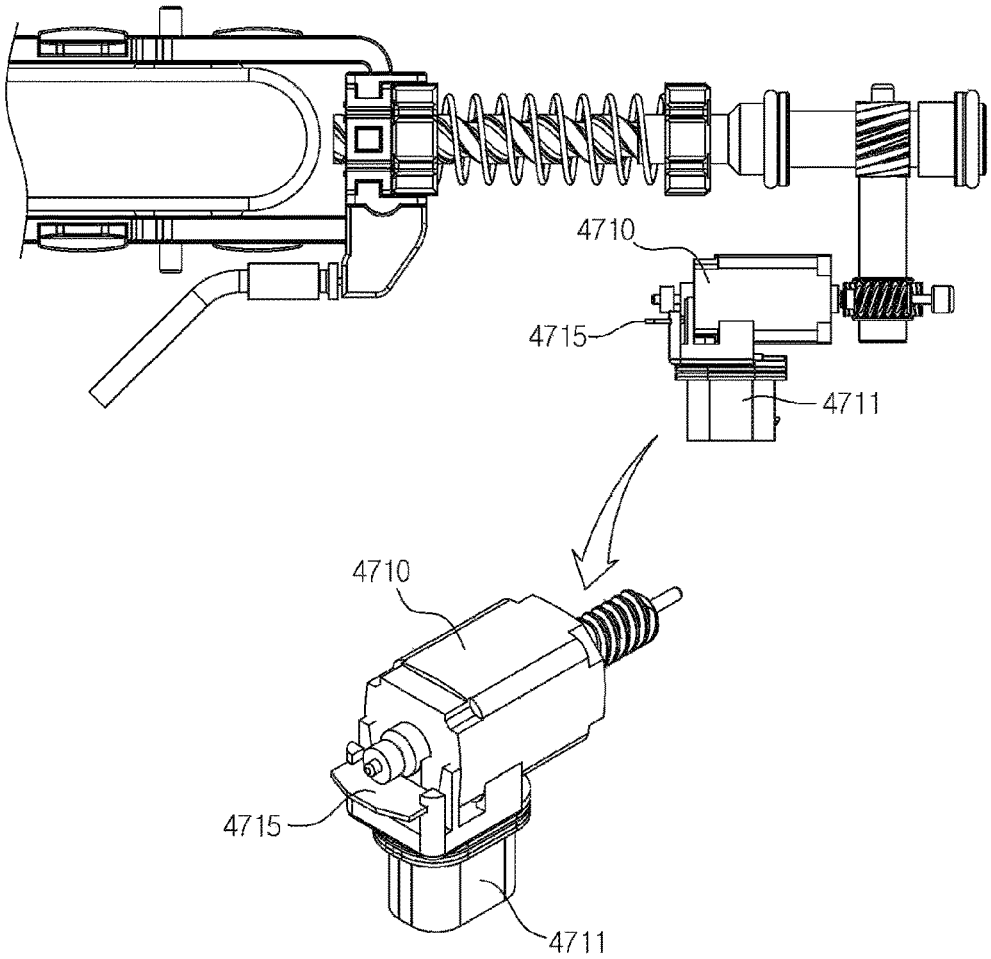
FIG. 75 is a front view and a perspective view of a motor of a flush handle for a vehicle door according to a fourth preferred embodiment of the present invention.
Figure 76:
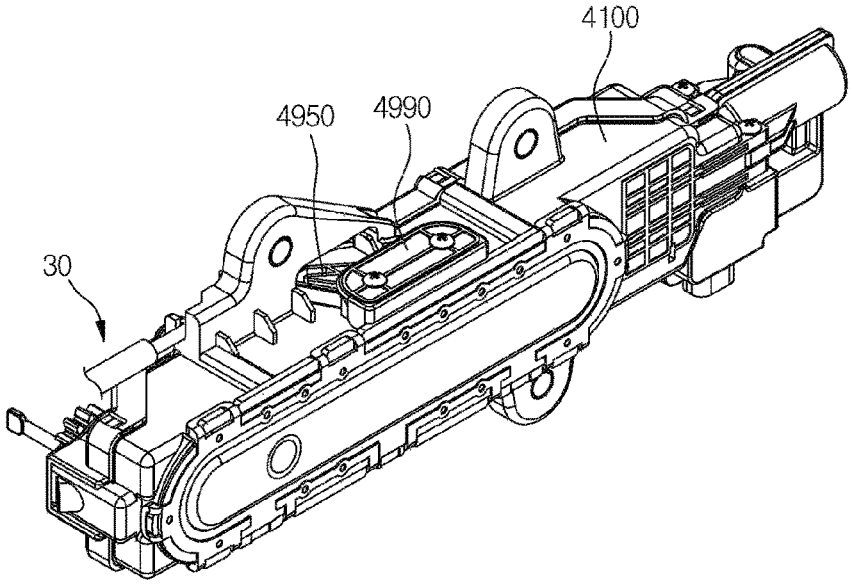
FIG. 76 is a front perspective view of a flush handle for a vehicle door according to a fifth preferred embodiment of the present invention.
Figure 77:
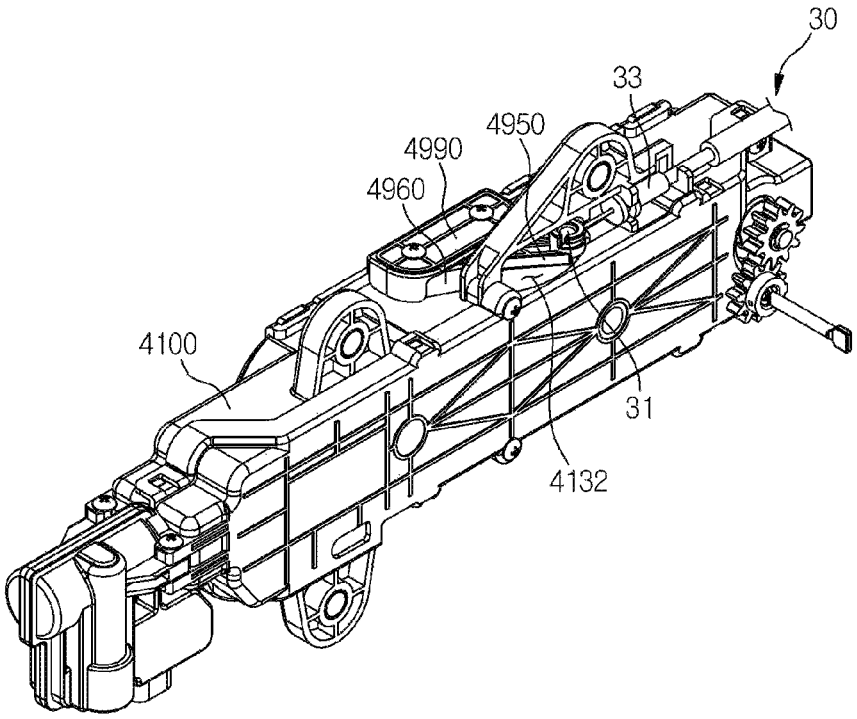
FIG. 77 is a rear perspective view of a flush handle for a vehicle door according to a fifth preferred embodiment of the present invention.
Figure 78:
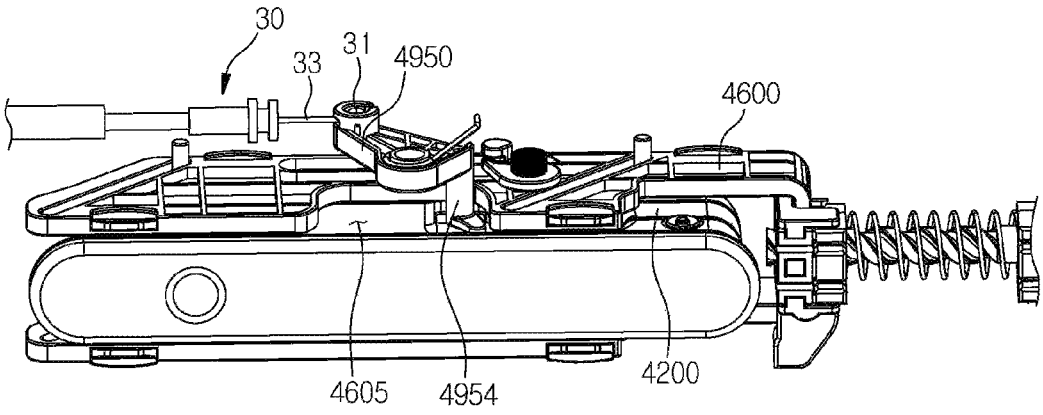
FIG. 78 is a front perspective view of a flush handle for a vehicle door according to a fifth preferred embodiment of the present invention in a state of being entered (excluding the housing, blocking plate).

Hereinafter, a fourth preferred embodiment according to the present invention will be described with reference to FIG. 75.

Detailed description of the same configuration as the previously described embodiment will be omitted.

The configuration of the fourth embodiment is almost the same as that of the third embodiment.

In the fourth embodiment, instead of using the third sensors 23*a* and 23*b* of the third embodiment, the encoder 4715 is installed in the encoder connector 4711, and the movement range of the handle unit 4200 is adjusted by the driving of the motor 4710.

After installation, the encoder 4715 is located at the lower side of the shaft of the motor 4710.

The encoder 4715 measures the number of revolutions of the shaft of the motor 4710, so that the motor 4710 is rotated by a predetermined number of revolutions. Due to this, it is possible to drive the motor 4710 as many times as necessary after calculating the distance at which the handle unit 4200 is withdrawn and entered using the number of revolutions of the motor 4710.

Embodiment 5

Hereinafter, a preferred fifth embodiment according to the present invention will be described with reference to FIGS. 76 to 84.

Detailed description of the same configuration as the previously described embodiment will be omitted.

The configuration of the fifth embodiment is almost the same as that of the third embodiment.

The fifth embodiment comprises a manual latch unit instead of the motorized latch unit of the third embodiment.

The manual latch unit may be opened by receiving the rotational force of the handle unit 4200 through a lever 4950.

The lever 4950 is formed, on the whole, in the form of a right triangle.

The lever 4950 is installed such that a right-angled portion of the right triangle is disposed at the right side.

Of the right triangle of the lever 4950, a cover coupling portion 4951 in the shape of a circular pipe is formed at a vertex formed in the front side.

The cover coupling portion 4951 is fitted into the lever installation protrusion 4136*a* of the first housing 4100, so that the lever 4950 and the first housing 4100 are fit-coupled.

The lever 4950 can be rotated centered around the lever installation protrusion 4136*a*.

At an apex formed at the rear of the right triangle of the lever 4950, a door latch connection portion insertion groove 4952 is formed to be open upward.

The door latch connection portion insertion groove 4952 is formed to be partially opened on the right side, and is formed to open about half a turn counterclockwise from the lower portion of the opened right portion, and when the door latch connection portion 30 is installed through the door latch connection portion insertion groove 4952 so that the cable 33 is positioned on the left side of the engaging protrusion 31, the engaging protrusion 31 does not escape to the left side of the door latch connection portion insertion groove 4952.

A first spring insertion groove 4953 is formed between the first cover coupling portion 4951 and the inner surface of the lever 4950.

The first spring 4970 fitted into the first spring insertion groove 4953 may be provided as a coil spring.

In both ends of the first spring 4970, a first bent portion 4970 and a second bent portion 4972 are formed, respectively.

The first bent portion 4971 is located at the left side further than the second bent portion 4972.

The first bent portion 4971 is in contact with the inner surface of the lever 4950, and the second bent portion 4972 is in contact with the inner surface of the lever penetrating groove 4132 of the first housing 4100.

Due to this, when the lever 4950 is rotated clockwise, the first spring 4970 is compressed as the first bent portion 4971 is getting closer toward the second bent portion 4972.

Of the right angle triangle of the lever 4950, at the vertex where a right angle is formed, a locking portion 4954 is formed to be protruded downward.

The engaging portion 4954 comprises: a lever protrusion 4955 in the shape of a cylindrical column; an extension portion 4956 formed to be extended rightward in the lower portion of the lever protrusion 4955; and a handle unit engaging protrusion 4957 formed to be protruded downward in the right side of the extension portion.

The lever protrusion 4955 is inserted into the lever guide groove 4137 of the first housing 4100, and is rotated along the lever guide groove 4137.

The handle unit engaging protrusion 4957 is located in front of the lever engaging groove 4223 of the handle unit 4200, and when the handle unit 4200 is withdrawn, the handle unit engaging protrusion 4957 is engaged with the lever engaging groove 4223.

Figure 79:
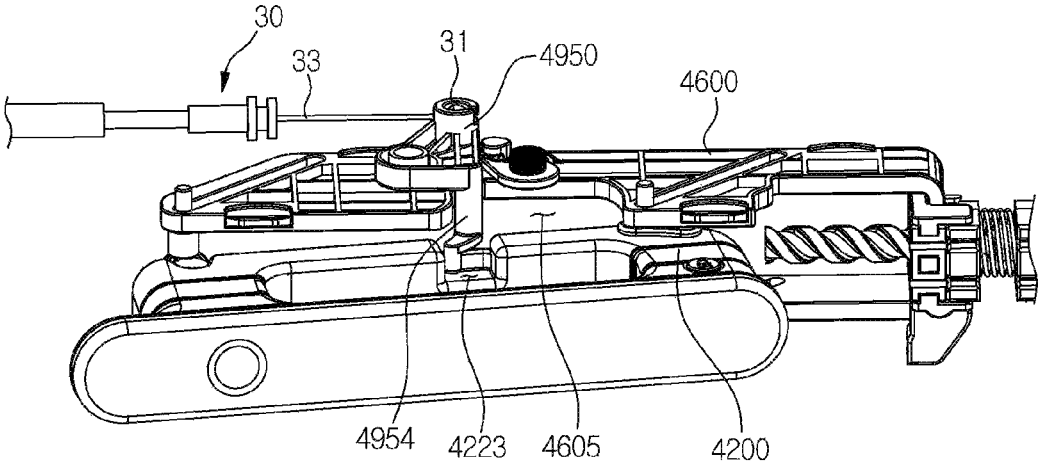
FIG. 79 is a front perspective view of a flush handle for a vehicle door according to a fifth preferred embodiment of the present invention in a state of being pulled after being withdrawn (excluding the housing, blocking plate).
Figure 80:
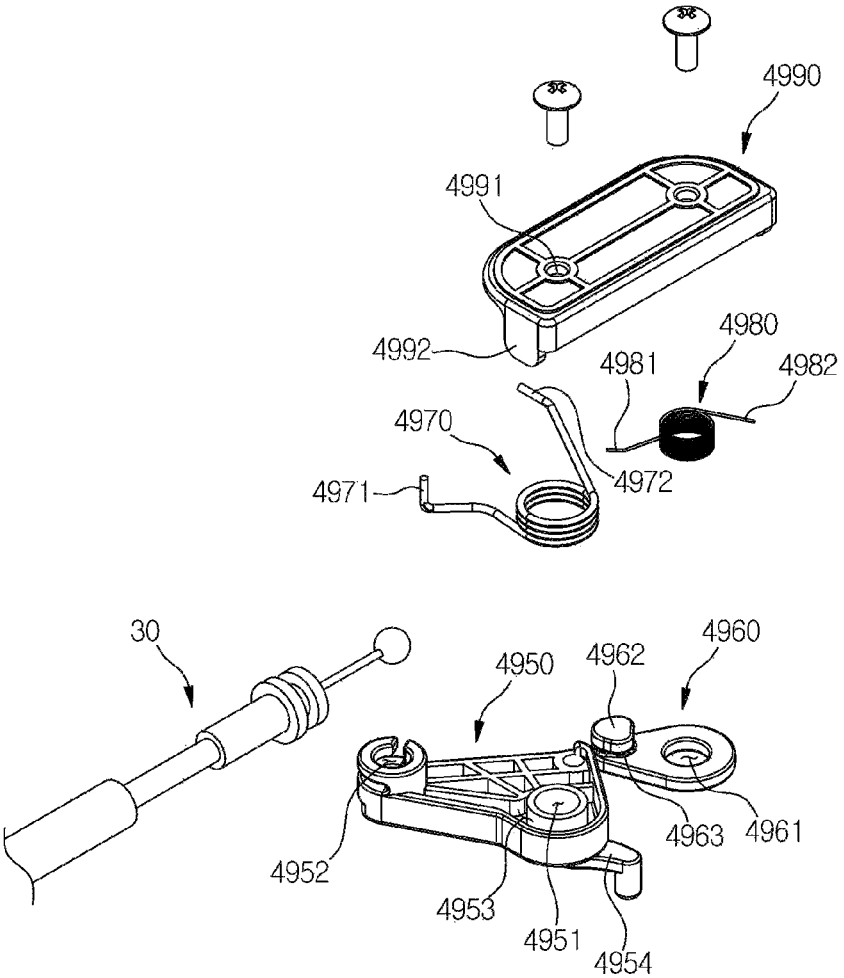
FIG. 80 is a front exploded perspective view of a lever and a weight balance of a flush handle for a vehicle door according to a fifth preferred embodiment of the present invention.
Figure 81:
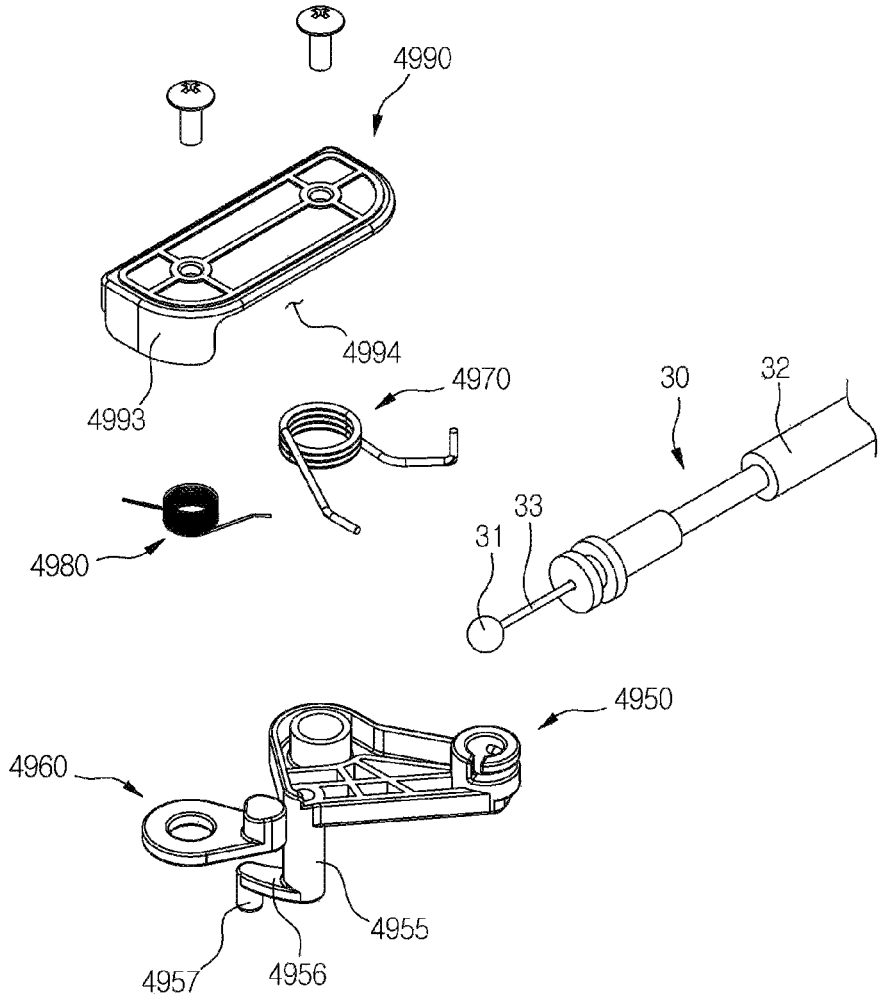
FIG. 81 is a rear exploded perspective view of a lever and a weight balance of a flush handle for a vehicle door according to a fifth preferred embodiment of the present invention.
Figure 82:
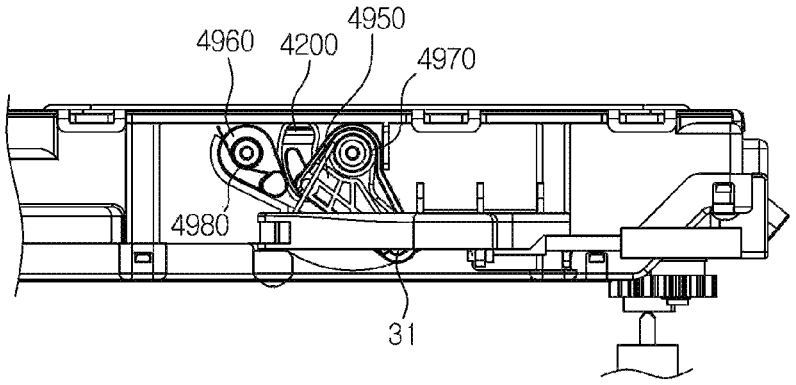
FIG. 82 is a plan view of the enter state of a flush handle for a vehicle door according to a fifth preferred embodiment of the present invention (excluding the cover).

In a state where the handle unit 4200 withdrawn, as illustrated in FIG. 79 or FIG. 83, when one side of the handle unit 4200 is pulled and rotated counterclockwise, as the lever engaging groove 4223 is rotated, the handle unit engaging protrusion 4957 engaged with the lever engaging groove 4223 is rotated clockwise by the rotation radius of the handle unit engaging protrusion 4957. That is, the lever 4950 is rotated all the way clockwise by the handle unit 4200. Due to this, the engaging protrusion 31 of the door latch connection portion 30 engaged with the lever 4950 is pulled so that the manual latch connected to the door latch connection portion 30 is opened, thereby opening the vehicle door.

In the right side of the lever 4950, a weight balance 4960 that can block the rotation of the lever 4950 by the handle unit 4200 may be installed.

The weight balance 4960 has a shape of an egg.

The weight balance 4960 is installed such that the round portion of the egg shape is located in the front side and the pointed portion is facing the left rear side.

In the weight balance 4960, a cover coupling groove 4191 is formed to be penetrated through the up-down direction in the round portion of the egg shape.

The cover engaging groove 4191 is fitted to the weight balance installation protrusion 4136*b* of the first housing 4100. Due to this, the weight balance 4960 and the first housing 4100 are fit-coupled.

The weight balance 4960 may be rotated centered around the weight balance installation protrusion 4136*b*.

In the pointed portion of the egg shape of the weight balance 4960, a second spring installation portion 4962 is formed to be protruded upward.

Due to the second spring installation portion 4962, the center of gravity of the weight balance 4960 is biased toward the second spring installation portion 4962.

In the lower portion of the second spring installation portion 4962, a second spring installation groove 4963 is formed to be open leftward.

The second spring 4980 installed in the second spring installation portion 4962 may be provided as a coil spring.

In both ends of the second spring 4980, a first bent portion 4981 and a second bent portion 4982 are respectively formed.

The first bent portion 4981 is located at the left side further than the second bent portion 4982.

The first bent portion 4981 is in contact with the second spring installation groove 4963 of the weight balance 4960, and the second bent portion 4972 is in contact with the front side of the weight balance guide portion 4139 of the first housing 4100.

Due to this, when the weight balance 4960 is rotated counterclockwise, as the first bending portion 4981 is getting closer toward the second bending portion 4982, and thereby the second spring 4980 is compressed.

A cover 4990 comprises: an upper plate; a first blocking portion 4992 formed on the lower left side of the upper plate; a second blocking portion 4993 formed on the lower right side of the upper plate; a front plate connecting the front sides of the first blocking portion 4992 and the second blocking portion 4993; and a lever penetrating groove 4994 formed between the rear side of the first blocking portion 4992 and the rear side of the second blocking portion 4993.

In the left and right sides of the upper plate of the cover 4990, a bolt penetrating groove 4991 is formed to be penetrated through the up-down direction.

The cover 4990 is bolt-coupled with the first housing 4100 by inserting a bolt into the bolt penetrating groove 4991, and fastening to the lever installation protrusion 4136*a* and the weight balance installation protrusion 4136*b* of the first housing 4100.

The first blocking portion 4992 is fitted to the left side of the lever guide portion 4138 of the first housing 4100, and the second blocking portion 4993 is fitted to the right side of the weight balance guide portion 4139 of the first housing 4100.

The rear side of the lever 4950 installed in the inner side of the cover 4990 is protruded outside the cover 4990 through the lever penetrating groove 4994 and may be connected to the door latch connection portion 30.

The weight of the weight balance 4960 is formed to react immediately by the inertia in the case of side collision of a vehicle.

Figure 84:
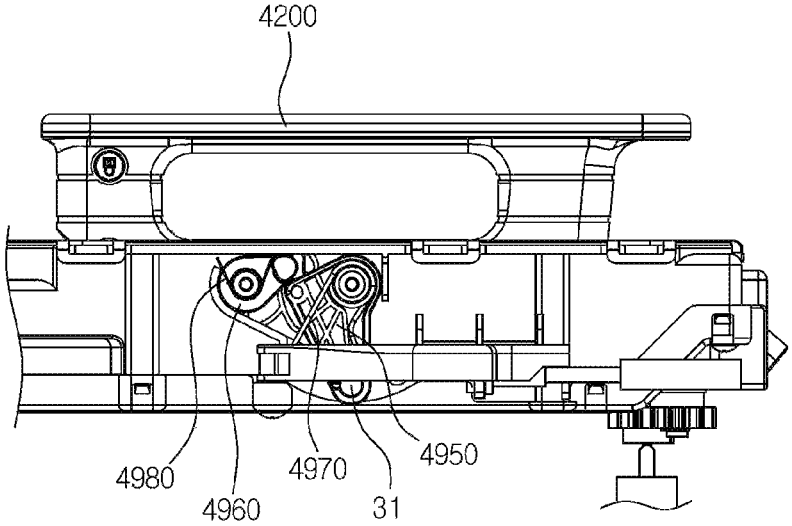
FIG. 84 is a plan view when a handle unit of a flush handle for a vehicle door according to the fifth preferred embodiment of the present invention is withdrawn due to an external impact (excluding the cover).
Figure 85:
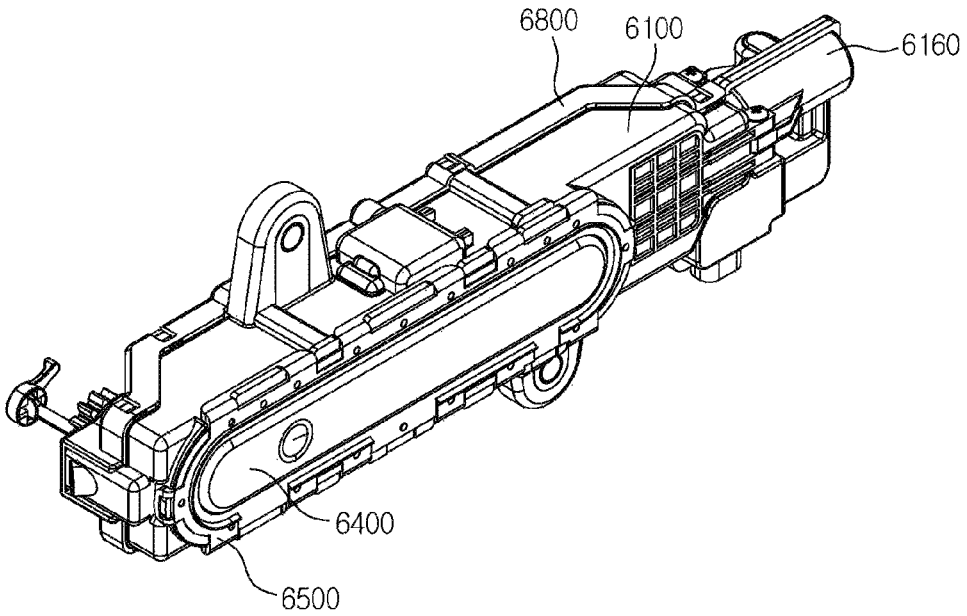
FIG. 85 is a front perspective view of a flush handle for a vehicle door according to a sixth preferred embodiment of the present invention.
Figure 86:
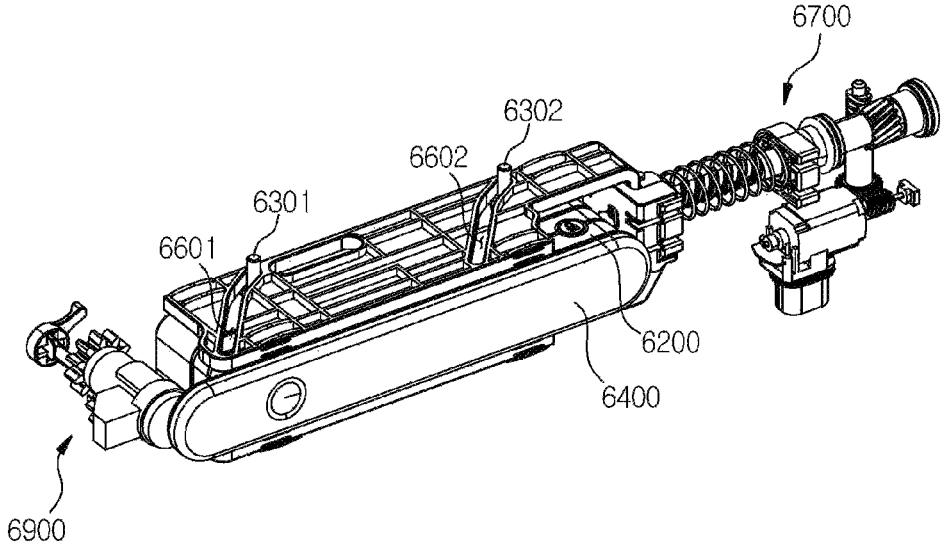
FIG. 86 is a front perspective view of a flush handle for a vehicle door according to a sixth preferred embodiment of the present invention (excluding the housing, blocking plate).
Figure 87:
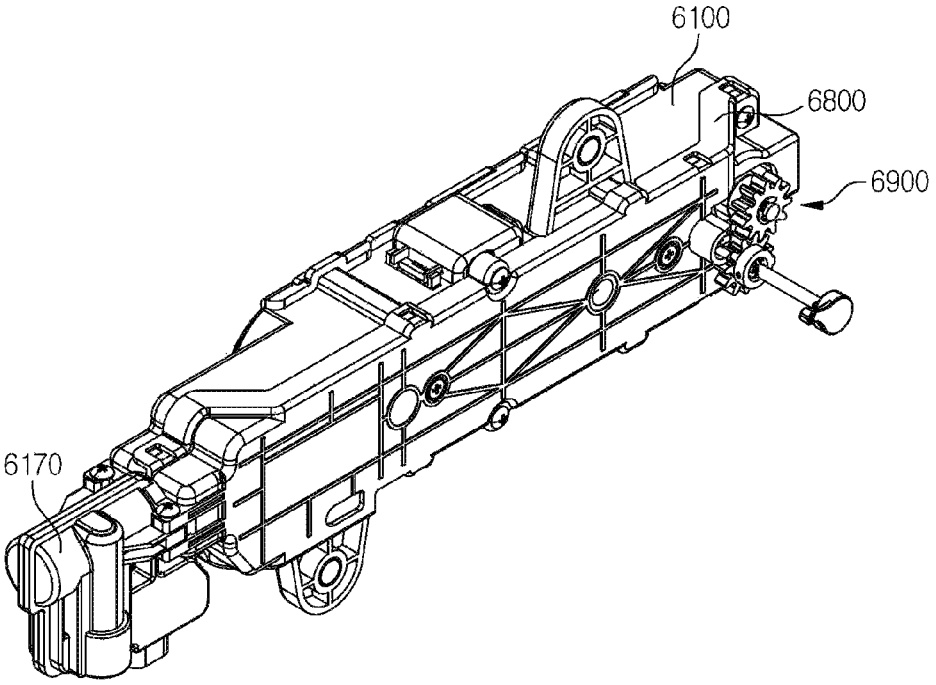
FIG. 87 is a rear perspective view of a flush handle for a vehicle door according to a sixth preferred embodiment of the present invention.
Figure 88:
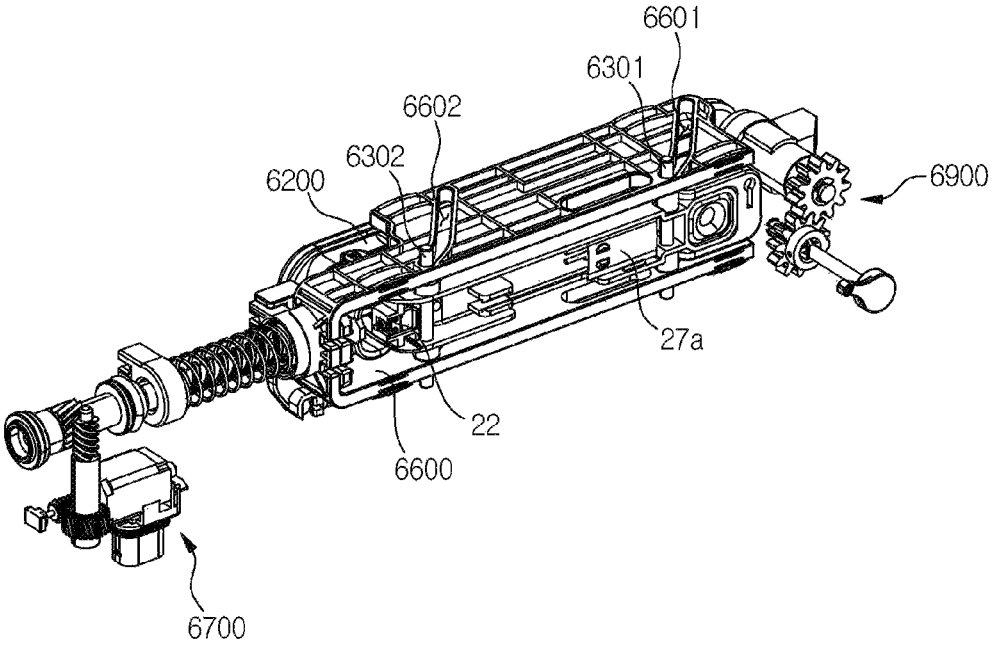
FIG. 88 is a rear perspective view of a flush handle for a vehicle door according to a sixth preferred embodiment of the present invention (excluding the housing, blocking plate).

When an impact occurs on the side of the vehicle and the handle unit 4200 is withdrawn, the weight balance 4960 is also rotated counterclockwise as illustrated in FIG. 84, so that the second spring installation portion 4962 is positioned in the front side.

Due to this, the rotated weight balance 4960 is positioned within the rotation radius of the lever 4950, and rotation of the lever 4950 is blocked. Since the lever 4950 is not rotated to the end, the door latch connection portion 30 is not fully pulled, so that the manual latch unit is not opened. That is, the safety of the manual latch unit is enhanced due to the weight balance 4960.

Embodiment 6

Hereinafter, a sixth preferred embodiment according to the present invention will be described.

Detailed description of the same configuration as the previously described embodiment will be omitted.

As illustrated in FIGS. 85 to 88, a flush handle for a vehicle door according to a sixth preferred embodiment of the present invention comprises: a slider 6600 installed in the housing; a handle unit accommodated in the slider 6600; and a linear motion conversion mechanism, sliding the handle unit in the front-to-rear direction in accordance with a sliding of the slider 6600 in the left-to-right direction, or sliding the slider 6600 in the left-to-right direction in accordance with sliding of the handle unit in the front-to-rear direction.

The linear motion conversion mechanism comprises a slider 6600; a linear motion conversion unit supporting the relative sliding between the slider 6600 and the handle unit; and a driving unit 6700 that slides.

The linear motion conversion unit comprises: first and second inclined long holes 6601 and 6602 formed in the slider 6600, and first and second pins 6301 and 6302 installed in the handle unit to be slid along the first and second inclined long holes 6601 and 6602.

Hereinafter, each configuration will be described in detail.

<First Housing>

The housing comprises a first housing 6100 and a second housing 6160 coupled to the right side of the first housing 6100.

Figure 89:
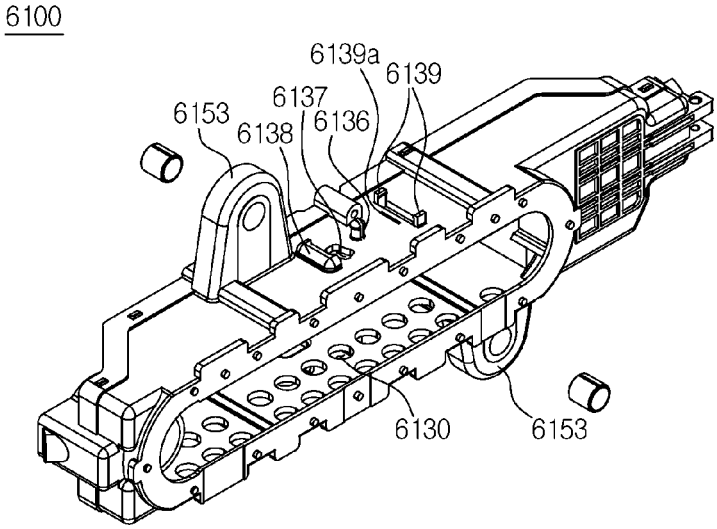
FIG. 89 is a front perspective view of a first housing of a flush handle for a vehicle door according to a sixth preferred embodiment of the present invention.
Figure 90:
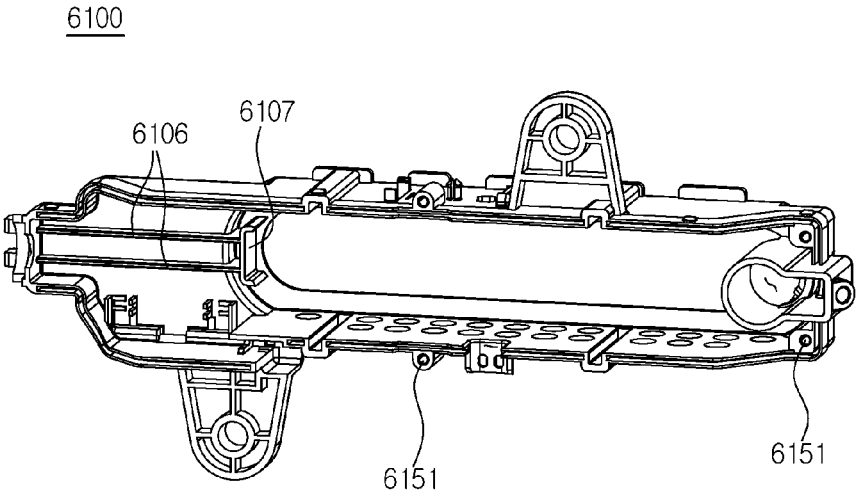
FIG. 90 is a rear perspective view of a first housing of a flush handle for a vehicle door according to a sixth preferred embodiment of the present invention.

The first housing 6100 is illustrated in detail in FIGS. 89 to 90.

The first housing 6100 is formed similarly to the first housing 4100 of a third preferred embodiment of the present invention.

The point in which the first housing 6100 is formed differently from the first housing 4100 of the third preferred embodiment of the present invention is as follows.

First, in the lower portion of the circumferential portion of the first housing 6100, a plurality of lower surface through holes 6130 is formed to be penetrated through the up-down direction.

Due to this, the first housing 6100 can be made lighter. In addition, when water flows in, drainage is smoothly performed due to the lower surface through holes 6130.

Next, there is a difference in configuration formed on the upper side surface of the circumferential portion of the first housing 6100.

In an upper side of the circumferential portion of the first housing 6100, a third fastening portion 6153 coupled to the door panel is formed.

The third fastening portion 6153 is formed in the central portion of the upper side surface of the circumferential portion of the first housing 6100.

The shape of the third fastening portion 6153 is similar to the third fastening portion 4153 of a third preferred embodiment of the present invention.

In the upper side circumferential portion of the first housing 6100, a weight balance installation protrusion 6136, a first cover fitting portion 6138, a second cover fitting portion 6139, and a cover engaging protrusion 6139*a* are formed to be protruded upward.

The weight balance installation protrusion 6136 is formed, on the whole, in the form of a cylindrical column.

The upper portion of the weight balance installation protrusion 6136 is formed to have a larger diameter than the diameter of the lower portion; and a gap is formed between the left and right side portions of the weight balance installation protrusion 6136.

Due to this, a weight balance 6960, which will be described later, may not be easily separated after being installed in the lower portion of the weight balance installation protrusion 6136.

The first cover fitting portion 6138 is disposed in the left side of the weight balance installation protrusion 6136.

The first cover fitting portion 6138 has a shape of a long cuboid in the front-to-rear direction.

The first cover fitting portion 6138 is formed to be open rightward.

Due to this, a protruded fitting plate 6991*a* of the cover 6990, which will be described later, may be inserted.

The second cover fitting portion 6139 is disposed in the right side of the weight balance installation protrusion 6136.

The second cover fitting portion 6139 is formed one on each of the front and rear sides of the upper circumferential portion of the first housing 6100, respectively.

The upper portions of the second cover fitting portions 6139 are protruded toward each other and are formed in the shape of a hook.

The space between the two second cover fitting portions 6139 is formed to be penetrated through the up-down direction.

The cover engaging protrusion 6139*a* is formed between the weight balance installation protrusion 6136 and the second cover fitting portion 6139.

The cover engaging protrusion 6139*a* is formed in the front-to-rear direction.

The height of the cover engaging protrusion 6139*a* is formed to be lower than the heights of the first cover fitting portion 6138 and the second cover fitting portion 6139.

Between the weight balance installation protrusion 6136 and the first cover fitting portion 6138, a weight balance guide groove 6137 is formed to be penetrated through the up-down direction.

The weight balance guide groove 6137 has a shape of an arc. Due to this, a first arm 6962 of the weight balance 6960, which will be described later, may be inserted into the weight balance guide groove 6137 and rotated.

<First Blocking Plate>

The first housing 6100 comprises a first blocking plate 6800 coupled to the rear of the first housing 6100.

Figure 97:
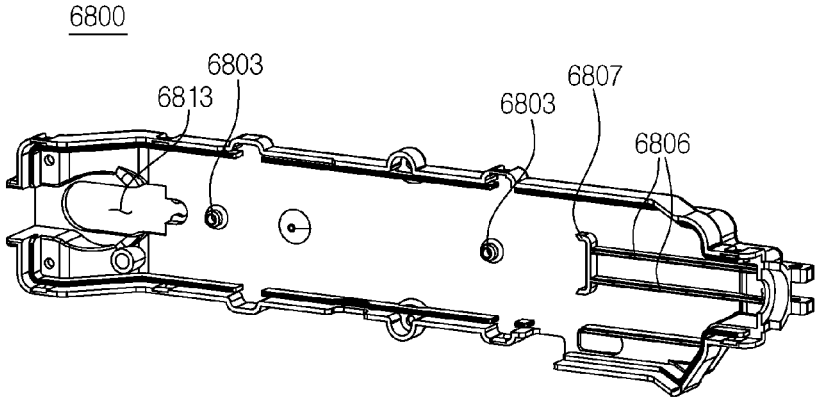
FIG. 97 is a front perspective view of a first blocking plate of a flush handle for a vehicle door according to a sixth preferred embodiment of the present invention.
Figure 98:
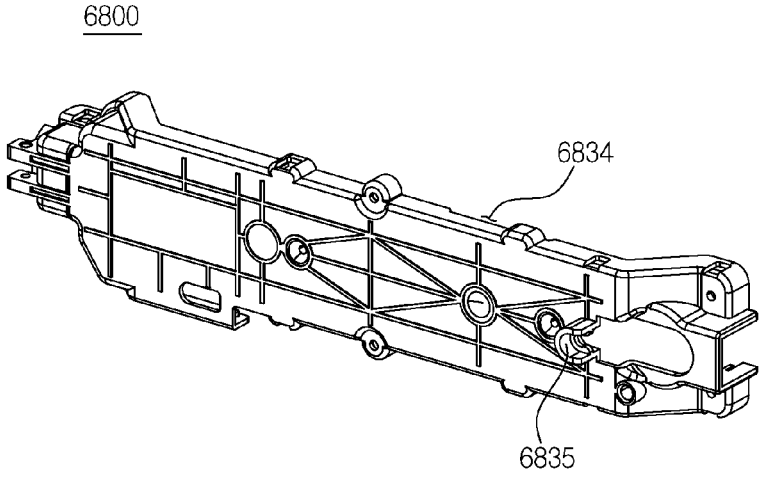
FIG. 98 is a rear perspective view of a first blocking plate of a flush handle for a vehicle door according to a sixth preferred embodiment of the present invention.

The first blocking plate 6800 is illustrated in detail in FIGS. 97 to 98.

The first blocking plate 6800 is formed similarly to the first blocking plate 4800 of the third preferred embodiment of the present invention.

The first blocking plate 6800 is formed differently from the first blocking plate 4800 of the third preferred embodiment of the present invention as follows.

In both left and right sides of the center of the first blocking plate 6800, a step adjustment boss 6803 is formed to be protruded forward.

In the step adjustment boss 6803, a step adjustment bolt 40, which will be described later, may be coupled from rear to front.

The length of the front-to-rear direction of the step adjustment boss 6803 is formed to be shorter than the length of the step adjustment bolt 40, so that the step adjustment bolt 40 may be protruded toward the front side of the step adjustment boss 6803.

In the right center of the first blocking plate 6800, two fourth guide portions 6806 are formed to be protruded forward. The fourth guide portion 6806 is disposed on the same line in the front-to-rear direction as the third guide portion 6106 of the first housing 6100, and the shape is formed to be the same and similar.

In the left side of the fourth guide portion 6806, a second moving nut blocking portion 6807 is formed in an up-down direction. The second moving nut blocking portion 6807 is disposed on the same line in the front-to-rear direction as the first moving nut blocking portion 6107 of the first housing 6100, and the shape is formed to be the same and similar.

The left side of the fourth guide portion 6806 is blocked by the second moving nut blocking portion 6807, and the right side of the fourth guide portion 6806 is blocked by the right side of the circumferential portion of the first blocking plate 6800.

Due to such the fourth guide portion 6806, a moving nut 6750 of the driving unit 6700, which will be described later, can be slid in the left-to-right direction within a predetermined range.

In the upper circumferential portion of the first blocking plate 6800, a third coupling portion interference prevention groove 6834 is formed instead of the lever interference prevention groove 4834.

The third coupling portion interference prevention groove 6834 is formed to be open forward, upward, and downward in the shape of a trapezoid in which the width is widened toward the front.

When the first housing 6100 and the first blocking plate 6800 are coupled, a circumferential portion of the first housing 6100 is positioned in the lower portion of the third coupling portion interference prevention groove 6834.

The key cylinder penetrating groove 6813 is formed to be extended rightward of the key cylinder penetrating groove 4813 of a third preferred embodiment of the present invention.

In the right side of the key cylinder penetrating groove 6813, a door outer side connection portion fixing portion 6835 is formed to be protruded rearward.

The door outer side connection portion fixing portion 6835 has a shape of a letter 'C', and the space formed in the left side of the door outer side connection portion 6835 is in communication with the key cylinder penetrating groove 6813.

In the door outer side connection fixing portion 6835, a plate formed to be protruded inward in the shape of a letter 'C' is formed. The tube 62 of the door outer side connection portion 60 is fit-coupled to the plate, and thereby it may not be flowed.

<Second Housing, Second Blocking Plate>

The second housing 6160 and the second blocking plate 6170 are formed to be the same as and similar to the second housing 4160 and the second blocking plate 4170 of a third preferred embodiment of the present invention.

<Handle Unit>

Figure 91:
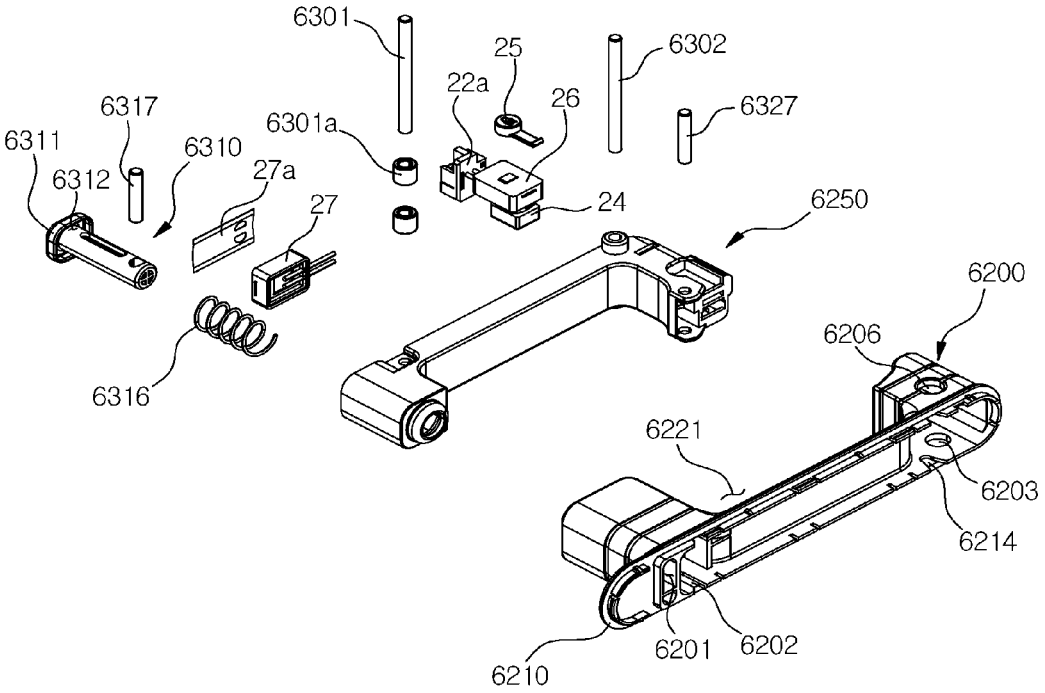
FIG. 91 is a front exploded perspective view of a handle unit of a flush handle for a vehicle door according to a sixth preferred embodiment of the present invention.
Figure 92:
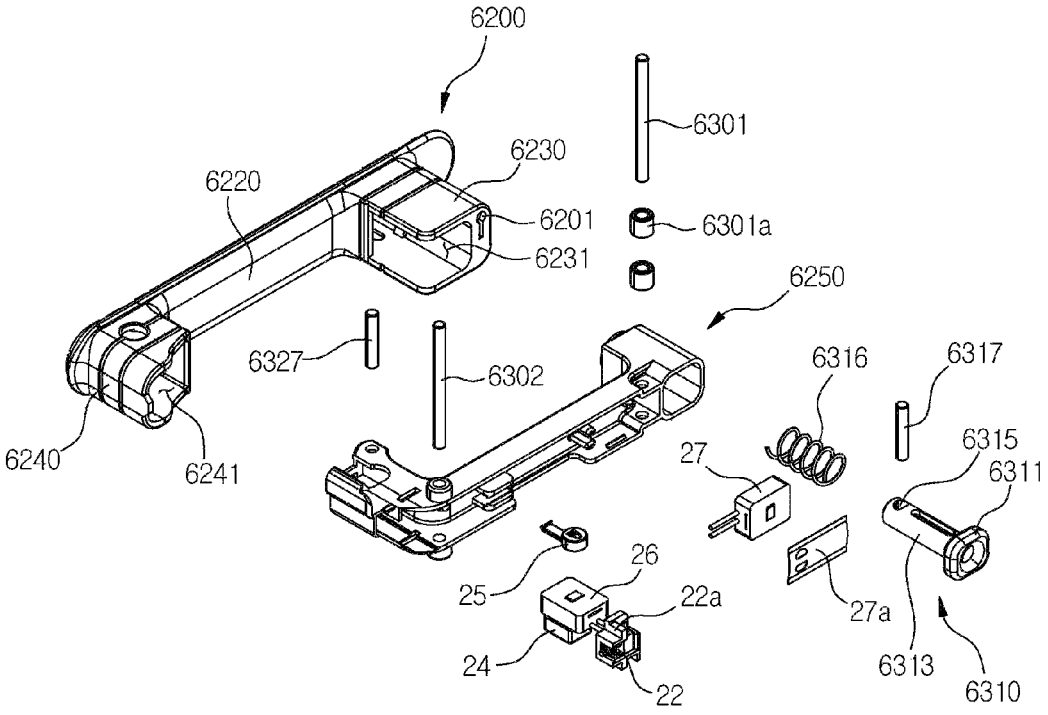
FIG. 92 is an exploded perspective view of a rear surface of a handle unit of a flush handle for a vehicle door according to a sixth preferred embodiment of the present invention.

The handle unit is illustrated in detail in FIGS. 91 to 92.

The handle unit comprises a front side handle unit 6200 and a rear side handle unit 6250 that is pin-coupled to the rear side of the front side handle unit 6200.

The front side handle unit 6200 is, on the whole, a cuboid shape in which openings are formed in the upper and lower portions and the rear side.

The front side handle unit 6200 comprises a front side handle unit main body 6220 formed in the front side, and a front side handle unit left side portion 6230 and a front side handle unit right side portion 6240 formed in the left and right sides.

In the front side handle unit left side portion 6230, a rear side handle unit left side portion insertion groove 6231 is formed to be penetrated through the front-to-rear direction, and in the front side handle unit right side portion 6240, a rear side handle unit right side portion insertion groove 6241 is formed to be penetrated through the front-to-rear direction.

The rear side handle unit left portion insertion groove 6231 is formed such that the rear side of the front side handle unit left side portion 6230 is open.

Figure 103:
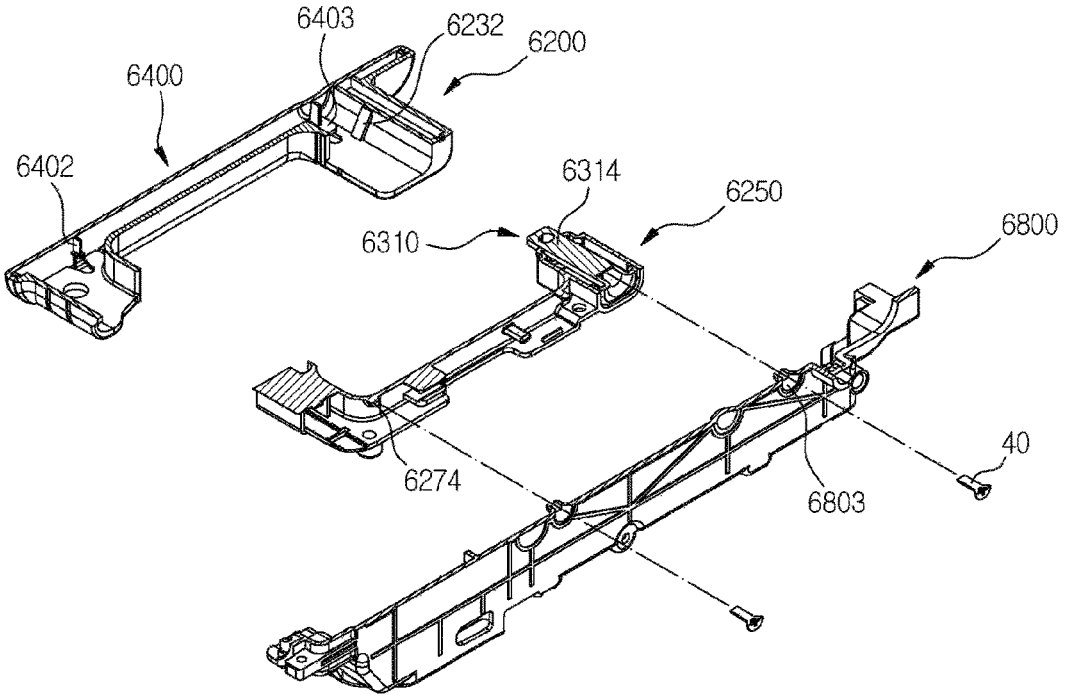
FIG. 103 is an assembly diagram of a step adjustment bolt of a flush handle for a vehicle door according to a sixth preferred embodiment of the present invention.

In the front of the rear side handle unit left side portion insertion groove 6231, as illustrated in FIG. 103, a rear side handle unit engaging member 6232 is formed.

In the upper and lower left portions of the rear side handle unit left side portion insertion groove 6231, the rear side handle unit engaging member 6232 is formed to be protruded inward.

The rear side handle unit engaging member 6232 formed in the upper portion is formed to be inclined further leftward as it travels from top to bottom, and the rear side handle unit engaging member 6232 formed in the lower portion is formed to be inclined further rightward as it travels from top to bottom.

Unlike the above description, the rear side handle unit engaging member 6232 may have any shape as long as the rear side handle unit 6250 is engaged with the rear side handle unit engaging member 6232 and cannot be moved further forward.

The width of the left-to-right direction of the rear side handle unit right side portion insertion groove 6241 is formed to be larger than the width of the left-to-right direction of the right side portion of the rear side handle unit 6250.

Due to this, when the front side handle unit 6200 is rotated relative to the right side of the front side handle unit 6200 in which the pivot pin 6327, which will be described later, is installed, the front side handle unit 6200 and the rear side handle unit 6250 are not interfered.

In the left side of the front side handle unit left side portion 6230, a door outer side connection portion installation groove 6201 is formed to be penetrated through the front-to-rear direction.

The door outer side connection portion installation groove 6201 is disposed at the left side of the rear side handle unit left side portion insertion groove 6231, and is not in communication with each other.

The door outer side connection portion installation groove 6201 is formed to be open forward, and the rear side of the door outer side connection portion installation groove 6201 has a shape of a keyhole having a circular upper portion and a rectangular lower portion. That is, the diameter of the circle is formed to be larger than the width of the rectangle in the left-to-right direction.

The engaging protrusion 61 and the cable 63 of the door outer side connection portion 60 are installed in the upper portion of the door outer side connection portion installation groove 6201 from rear to front. Thereafter, when the engaging protrusion 61 and the cable 63 are moved to the lower portion of the door outer side connection portion installation groove 6201, the engaging protrusion 61 does not separated rearward of the door outer side connection portion installation groove 6201 due to the shape of the door outer side connection portion installation groove 6201.

In the upper and lower sides of the front side of the rear side handle unit left side portion insertion groove 6231, an extension portion pin engaging groove 6202 is formed.

The extension portion pin engaging groove 6202 is formed to be open forward.

The extension portion pin engaging groove 6202 is formed to be long enough in the front-to-rear direction so that an extension portion pin 6317 can be completely inserted into the rear side handle unit left side portion insertion groove 6231.

Due to this, the extension portion pin 6317 can be installed from front to rear of the extension portion pin engaging groove 6202.

In the lower portion of the front of rear side handle unit right side portion insertion groove 6241, a first LED installation groove 6203 is formed to be penetrated through the up-down direction.

The lower portion of the LED 24 is inserted into the first LED installation groove 6203, so that when the front side handle unit 6200 is withdrawn, a user can check the light of the LED 24 from the outside of the front side handle unit 6200.

In the upper portion of the front side of the rear side handle unit right side portion insertion groove 6241, a button penetrating groove 6206 is formed to be penetrated through the up-down direction.

In the button through groove 6206, the upper portion of the button 25 is installed to be exposed to the outside. Due to this, when the front side handle unit 6200 is withdrawn, the user can press the button 25.

In the front of the front side handle unit main body 6220, a handle cover installation portion 6210 is formed. The handle cover installation portion 6210 is formed to be the same as and similar to the handle cover installation portion 4210 of a third preferred embodiment of the present invention.

In the upper and lower portions of the right side of the handle cover installation portion 6210, a first pivot pin installation groove 6214 is formed to be open forward and inward.

Between the rear side of the front side handle unit main body 6220 and the front side handle unit left side portion 6230 and the front side handle unit right side portion 6240, a first hand insert portion 6221 is formed.

The first hand insert portion 6221 is formed to be open upward, downward, and rearward.

The first hand insert portion 6221 is formed to have round corners.

That is, the corner where the front side handle unit main body 6220 and the front side handle unit right side portion 6240 meet is also formed to be round.

Figure 93:
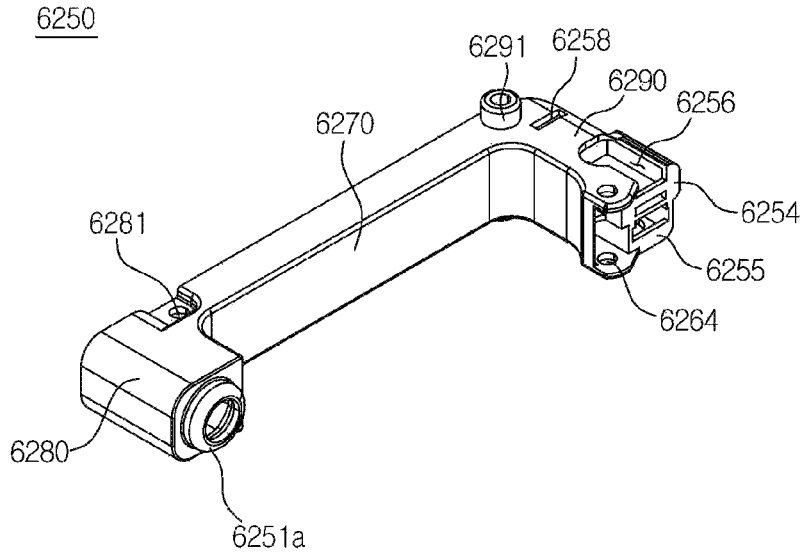
FIG. 93 is a front perspective view of a rear side handle unit of a flush handle for a vehicle door according to a sixth preferred embodiment of the present invention.
Figure 94:
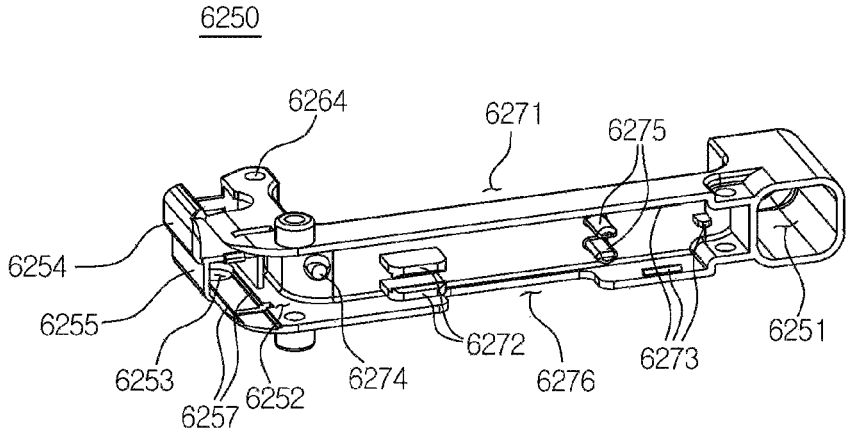
FIG. 94 is a rear perspective view of a rear side handle unit of a flush handle for a vehicle door according to a sixth preferred embodiment of the present invention.

The rear side handle unit 6250 is illustrated in more detail in FIGS. 93 to 94.

The rear side handle unit 6250 is, on the whole, a cuboid shape in which openings are formed in the upper and lower portions and the front side.

The rear side handle unit 6250 comprises a rear side handle unit main body 6270 formed at the rear, a rear side handle unit left side portion 6280, and a rear side handle unit right side portion 6290 formed on the left and right sides.

The right side of the rear side handle unit left side portion 6280 is disposed at the right side of the rear side handle unit left side portion insertion groove 6231, so that the outer surface of the rear side handle unit left side portion 6280 lies on the same line as the outer surface of the front side handle unit left side portion 6230.

That is, the front side of the right side surface of outer surface of the rear side handle unit left side portion 6280 is blocked by the right side surface of the front side handle unit left side portion 6230, and the left side surface of the rear side handle unit left side portion 6280 is blocked by the rear side handle unit engaging member 6232 of the front side handle unit left side portion 6230.

Due to this, when the rear side handle unit 6250 is withdrawn forward, the front side handle unit 6200 is also withdrawn forward.

In the rear side handle unit left side portion 6280, an extension portion installation groove 6251 has a shape of rectangle to be penetrated through the front-to-rear direction.

The extension portion installation groove 6251 is formed to be the same as and similar to the shape of the cross section of a head portion 6311 of the extension portion 6310, which will be described later.

The left and right and up and down directions of the extension portion installation groove 6251 are blocked in by the rear side handle unit 6250. Due to this, the extension portion 6310 is moved along the extension portion installation groove 6251 within the extension portion installation groove 6251.

In front side of the extension portion installation groove 6251, an extension portion engaging portion 6251*a* has a shape of a circle.

The extension portion engaging portion 6251*a* is formed to be protruded forward.

In the central portion of the extension portion engaging portion 6251*a*, a circular groove is formed to be penetrated through the front-to-rear direction.

The diameter of the groove of the extension portion engaging portion 6251*a* is formed to be smaller than the lengths of the left and right and up-down directions of the extension portion installation groove 6251.

The groove of the extension portion engaging portion 6251*a* is formed to be the same as and similar to the shape of the cross section of a length portion 6313 of an extension portion 6310, which will be described later.

Due to this, the extension portion 6310 is inserted into the extension portion installation groove 6251 from rear to front, so that it is not escaped to the front side of the extension portion installation groove 6251.

A sensor installation groove 6252 is formed over the rear side of the rear side handle unit main body 6270 and the inside of the rear side handle unit right side portion 6290.

The sensor installation groove 6252 is formed such that the rear side of the rear side handle unit main body 6270 is open, and the rear side handle unit right side portion 6290 is to be penetrated through the front-to-rear direction.

In the right front side of the sensor installation groove 6252, a button sensor installation portion 6254 and an LED installation portion 6255 are formed in the shape of a cuboid with an open rear side.

Due to this, the button sensor 26 may be inserted in the button sensor installation portion 6254 from rear to front, and the LED 24 may be inserted in the LED installation unit 6255 from rear to front.

The button sensor installation portion 6254 is disposed at the upper portion of the LED installation portion 6255.

In the back of the button sensor installation portion 6254, a protrusion protruded inward of the button sensor installation portion 6254 is formed, and thereby the button sensor 26 is hook-coupled to the button sensor installation portion 6254 so that it may not be escaped rearward.

In the upper portion of the button sensor installation portion 6254, a button installation groove 6256 is formed to be penetrated through the up-down direction.

The button installation groove 6256 is formed to be spaced apart at a predetermined interval from the circumference of the button 25.

Due to this, the button 25 may be placed from top to bottom in the button installation groove 6256.

The button 25 is disposed to be in contact with the upper surface of the button sensor 26 through the button installation groove 6256.

For this reason, when the button 25 is pressed, the button sensor 26 is pressed, and the button sensor 26 transmits a signal to a control unit (not shown).

In the lower portion of the LED mounting portion 6255, a second LED installation groove 6253 is formed to be penetrated through the up-down direction.

The second LED installation groove 6253 is formed to be the same as and similar to the first LED installation groove 6203 and are in communication with each other.

In the second LED installation groove 6253, the lower portion of the LED 24 is inserted.

In the right rear side of the sensor installation groove 6252, a second sensor housing guide portion 6257 and a second sensor housing installation groove 6258 are formed.

The second sensor housing guide portion 6257 is formed at both left and right sides of the lower portion of the sensor installation groove 6252.

The second sensor housing guide portion 6257 has a shape of a step in accordance with the shape of the lower portion of the second sensor housing 22*a*.

The second sensor housing installation groove 6258 is formed to be penetrated through the up-down direction of the sensor installation groove 6252.

The second sensor housing installation groove 6258 is formed to match the shape of a protrusion protruded in the upper and lower portions of the second sensor housing 22*a*, so that the protrusion of the second sensor housing 22*a* may be fitted into the second sensor housing installation groove 6258.

The second sensor housing 22*a* is installed at the correct position by the second sensor housing guide portion 6257 and the second sensor housing installation groove 6258.

In the second sensor housing 22*a*, the second sensor 22 is fitted from rear to front, and the second sensor 22 is disposed such that the right side thereof can be pressed by the inner wall of the front side handle unit 6200.

The front side of the rear side handle unit right side portion 6290 is formed to be protruded leftward.

The left front side of the rear side handle unit right side portion 6290 is bent in the shape an arc in accordance with the shape of the inner wall of the front side handle unit right side portion 6240.

In the curved portion in the shape of an arc, a second pivot pin installation groove 6264 is formed to be penetrated through the up-down direction.

The second pivot pin installation groove 6264 is in communication with the first pivot pin installation groove 6214.

Due to this, the rear side handle unit right side portion 6290 partially supports the front side handle unit right side portion 6240, so that when the front side handle unit 6200 is rotated centered around the pivot pin 6327 installed in the first and second pivot pin installation grooves 6214 and 6264, it guides the rotation of the front side handle unit right side portion 6240.

Between the front side of the rear side handle unit main body 6270 and the rear side handle unit left side portion 6280 and the rear side handle unit right side portion 6290, a second hand insert portion 6271 is formed.

The second hand insert portion 6171 is formed such that the up-down direction and the front are open.

The second hand insert portion 6271 is formed to have round corners.

When the rear side handle unit 6250 is coupled to the front side handle unit 6200, the first hand insert portion 6221 and the second hand insert portion 6271 form a closed curve. The closed curve is formed large enough to allow a user's hand to be inserted, so that the user can pull the front side handle unit 6200 by putting a hand in the closed curve. At this time, due to the shape of the first and second hand insert portions 6221 and 6271, the user's grip feeling is enhanced.

In the lower portion of the center of the rear side handle unit main body 6270, a wire penetrating groove 6276 is formed to be penetrated through the up-down direction and to be open rearward.

Due to the wire penetrating groove 6276, a space is formed between the rear side handle unit 6250 and the first blocking plate 6800 when the rear side handle unit 6250 is entered, and the wire 20 can be installed through the wire penetrating groove 6276.

The wires 20 connected to the outside through the wire penetrating groove 6276 are connected to each sensor of the rear side handle unit 6250.

In the right side of the rear side handle unit main body 6270, a wire installation portion 6272 and a step adjustment protrusion 6274 are formed to be protruded rearward.

The wire installation portion 6272 is formed in the form of two rectangular plates spaced apart in the up-down direction so as to be facing each other.

In the rear of the electric wire installation portion 6272, a protrusion is formed to be protruded toward the rectangular plates, and due to the protrusion, it is difficult for the wires 20 installed inside the wire installation portion 6272 to be escaped rearward.

The step adjustment protrusion 6274 has a shape of a cylindrical column, and protruded enough to be in contact with a step adjustment bolt 40, which will be described later.

The step adjustment protrusion 6274 is disposed at the right side of the wire installation portion 6272.

In the left side of the rear side handle unit main body 6270, a fourth sensor engaging step 6163 and a plate spring fitting protrusion 6275 are formed.

The fourth sensor engaging step 6273 comprises a first portion formed to be protruded inward in the upper portion and lower portion of the rear side handle unit main body 6270, and a second portion disposed at the left side further than the first portion and formed to be protruded rearward.

The first portion of the fourth sensor engaging step 6273 has a shape of a hook at the rear side of the rear side handle unit main body 6270, and prevents the fourth sensor 27 installed inside the fourth sensor engaging step 6273 from escaping rearward, and the second portion of the fourth sensor engaging step 6273 prevents the fourth sensor 27 from escaping leftward.

The plate spring fitting protrusion 6275 is disposed further at the right side than the fourth sensor engaging step 6273, and is formed to be protruded rearward, thereby preventing the fourth sensor 27 from escaping rightward.

The length of the front-to-rear direction of the plate spring fitting protrusion 6275 is formed longer than the front-to-rear direction of the fourth sensor 27.

Due to this, the plate spring fitting protrusion 6275 may be provided with a plate spring 27*a* located at the rear side of the fourth sensor 27.

The plate spring 27*a* may be provided with a metal.

The plate spring 27*a* is formed, on the whole, in the shape of a rectangular plate.

The plate spring 27*a* has a shape of an arc in which the central portion thereof is protruded rearward when viewed from the side.

The plate spring 27*a* is installed between the first portion of the fourth sensor engaging step 6273 and the fourth sensor 27.

Due to such the plate spring 27*a*, damages of the fourth sensor 27 by an excessive force is minimized, and the distinction feeling when the handle unit is pressed in the entry direction is improved.

In the left side portion of the rear side handle unit 6280, a first pin installation groove 6281 is formed to be penetrated through the up-down direction.

The first pin installation groove 6281 is formed in the upper and lower portions of the left side of the sensor installation groove 6252.

The portion where the first pin installation groove 6281 is formed is formed to be recessed inward, so that the first pin bumper 6301*a* can be installed in the recessed portion.

In the right side of the rear side handle unit 6290, a second pin installation groove 6291 is formed to be penetrated through the up-down direction.

The second pin installation groove 6291 is formed at the upper and lower portions of the right side of the sensor installation groove 6252.

The portion where the second pin installation groove 6291 is formed is formed to be protruded outward, and thus has a similar shape as if a first pin bumper 6301*a* is installed thereto.

The rear side handle unit 6250 is connected to the slider 6600 by a first pin 6301 installed in the first pin installation groove 6281 and a second pin 6302 installed in the second pin installation groove 6291.

<Extension Portion>

An extension portion 6310 is illustrated in detail in FIGS. 91 to 92.

The extension portion 6310 is installed inside the left side portion 6280 of the rear side handle unit so as to be adjustable in length with respect to the extension portion pin 6317.

The extension portion 6310 comprises: a head portion 6311 formed in the shape of a rectangular column with rounded corners;

and a length portion 6313 formed in the form of a cylindrical column in front of the head portion 6311. The length of the diameter of the length portion 6313 is formed smaller than the length of one side of the head portion 6311.

The head portion 6311 is formed to be open forward, and an extension portion return spring insertion groove 6312 is formed between the inner surface of the head portion 6311 and the outer surface of the length portion 6313.

Inner side of the length portion 6313, as illustrated in FIG. 103, the step adjustment plate 6314 is formed in the form of a rectangular plate.

The step adjustment plate 6314 is formed such that when the rear side handle unit 6250 is in the entry state, the rear surface of the step adjustment plate 6314 is placed on the same line as the rear surface of the step adjustment protrusion 6274 of the rear side handle unit 6250.

In the front side of the length portion 6313, a slot 6315 is formed to be penetrated through the up-down direction. The slot 6315 is formed long in the left-to-right direction.

In the outer side of the length portion 6313, an extension portion return spring 6316 is fitted.

The extension portion 6310 is fitted from rear to front in the rear side handle unit 6250. The rear portion of the extension portion 6310 is blocked by the extension portion engaging portion 6251*a*.

At this time, the front side of the extension portion return spring 6316 is blocked by the extension portion engaging portion 6251*a*, the rear side is inserted into the extension portion return spring insertion groove 6312, the extension portion pin 6317 is fitted into the slot 6315 of the extension portion 6310 and the extension portion pin engaging groove 6202 of the front side handle unit 6200.

Due to this, the extension portion return spring 6316 is compressed and restored in the front-to-rear direction between the extension portion return spring insertion groove 6312 and the extension portion engaging portion 6251*a* in accordance with the movement of the front side handle unit 6200.

<Handle Cover>

A handle cover 6400 is formed similarly to the handle cover 1400 of a first preferred embodiment of the present invention.

The handle cover 6400 is illustrated in FIG. 103.

In the right side of the handle cover 6400, a pivot pin support portion 6402 is formed to be protruded rearward.

The pivot pin support portion 6402 blocks the front side of the pivot pin 6327 to prevent the pivot pin 6327 from being escaped forward, and thereby blocking the pivot pin 6327 from being separated from the front side handle unit 6200.

In the left side of the handle cover 6400, an extension portion pin support portion 6403 is formed to be protruded rearward.

The extension portion pin support portion 6403 blocks the front side of the extension portion pin 6317 to prevent the extension portion pin 6317 from being escaped forward, and thereby blocking the extension portion pin 6317 from being separated from the front side handle unit 6200.

<Bumper Member>

A bumper member 6500 is formed similarly to the bumper member 4500 of a third preferred embodiment of the present invention.

<Slider>

Figure 95:
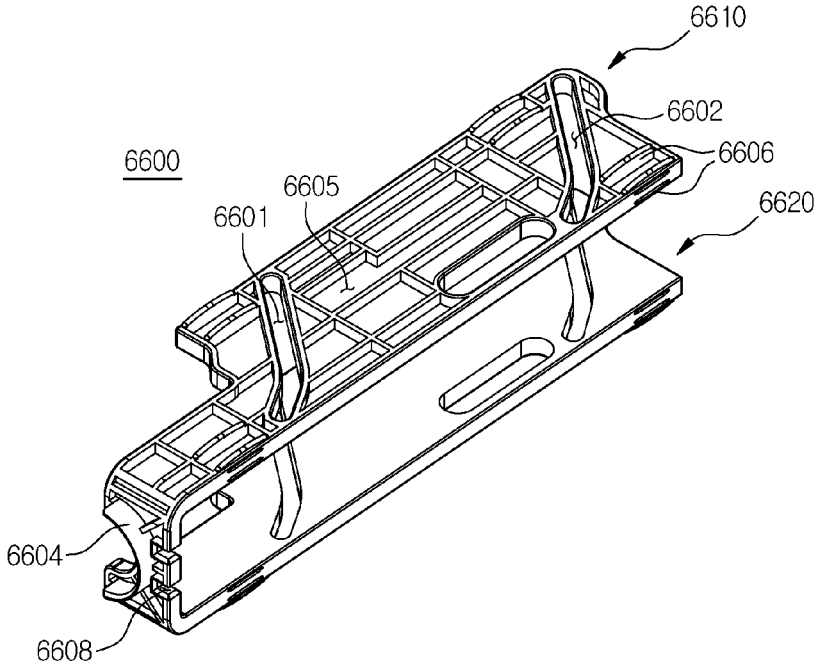
FIG. 95 is a rear perspective view of a slider of a flush handle for a vehicle door according to a sixth preferred embodiment of the present invention.
Figure 96:
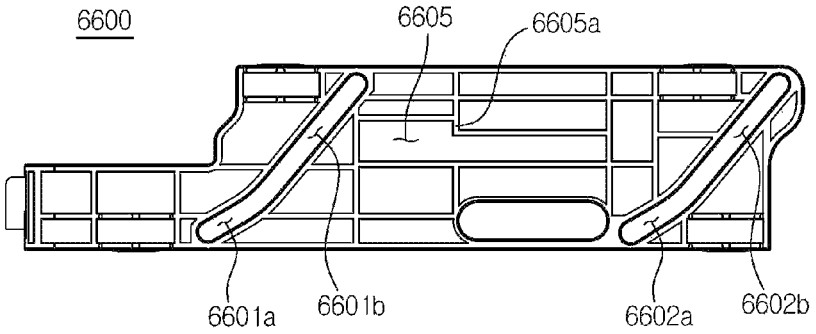
FIG. 96 is a plan view of a slider of a flush handle for a vehicle door according to a sixth preferred embodiment of the present invention.

A slider 6600 is illustrated in detail in FIGS. 95 to 96.

The slider 6600 is formed, on the whole, similarly to the slider 4600 of the third preferred embodiment of the present invention.

The point that the slider 6600 is formed differently from the slider 4600 of the third preferred embodiment of the present invention is as follows.

A first inclined long hole 6601 comprises, when the handle unit is withdrawn, a first inclined long hole first section 6601*a* where the first pin 6301 passes in the first half, and a first inclined long hole second section 6601*b* where the first pin 6301 passes in the second half.

That is, the first inclined long hole first section 6601*a* is formed at the rear side of the slider 6600, and the first inclined long hole second section 6601*b* is formed in the front side of the slider 6600.

The slope of the first inclined long hole first section 6601*a* is formed to be less steep than that of the first inclined long hole second section 6601*b*.

It may be formed such that the slope of the first inclined long hole first section 6601*a* is 30 degrees, and the slope of the first inclined long hole second section 6601*b* is 50 degrees.

The first inclined long hole first section 6601*a* and the first inclined long hole second section 6601*b* are curvedly connected.

A second inclined long hole 6602 also comprises a second inclined long hole first section 6602*a* and a second inclined long hole second section 6602*b*, and is formed in the same manner as the first inclined long hole 6601.

Due to such the shape of the first and second inclined long holes 6601 and 6602, since the resistance according to the angle decreases at the initial stage of withdrawal of the handle unit, the handle unit can be more smoothly withdrawn.

In the outer surfaces of the upper surface 6610 and the lower surface 6620 of the slider 6600, ribs are formed in the shape of a grid to enhance the strength of the slider 6600.

Among the grooves formed by the ribs, a groove into which a weight balance 6960, which will be described later, is inserted is a weight balance insertion groove 6605.

The weight balance insertion groove 6605 comprises: a guide groove formed in the left-to-right direction; and an engaging groove formed to be protruded forward in the right side of the guide groove.

In the right side of the engaging groove of the weight balance insertion groove 6605, a weight balance engaging plate 6605*a* is formed.

When the weight balance 6960 is located in the engagement groove of the weight balance insertion groove 6605, the weight balance 6960 comes into contact with the weight balance engaging plate 6605*a*, and the slider 6600 is no longer moved to the right side.

In the preferred sixth embodiment of the present invention, the slider bumper 6606 is formed on the slider 6600 itself without separately installing the slider bumper 4650 described in a third preferred embodiment of the present invention.

The slider bumper 6606 formed in the upper surface 6610 is formed to be protruded upward and forward or rearward.

The slider bumper 6606 formed in the lower surface 6620 is formed to be protruded downward and forward or rearward.

The slider bumper 6606 is protruded in the shape of an arc, and the noise caused by the friction when the slider 6600 is slid may be reduced.

A guide groove 6608 is further formed in the rear side of the return spring bumper installation portion 6604 formed in the right surface of the slider 6600.

The guide groove 6608 is formed, in the right surface of the slider 6600, to be penetrated through the left-to-right direction and to be open rearward.

The guide groove 6608 is formed in two spaced apart from each other in the up-down direction.

The fourth guide portion 6806 of the first blocking plate 6800 is inserted into the guide groove 6608.

<Driving Unit>

Figure 99:
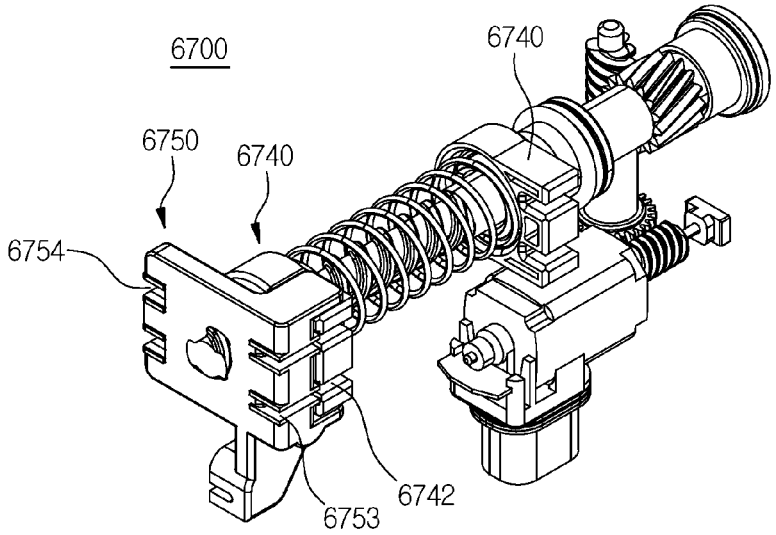
FIG. 99 is a front perspective view of a driving unit of a flush handle for a vehicle door according to a sixth preferred embodiment of the present invention.

A driving unit 6700 is illustrated in detail in FIG. 99.

The driving unit 6700 is formed, on the whole, similarly to the driving unit 4700 of the third preferred embodiment of the present invention.

The point that the driving unit 6700 is formed differently from the driving unit 4700 of the third preferred embodiment of the present invention is as follows.

The moving nut 6650 of the preferred sixth embodiment of the present invention is formed in the form of a combination of the moving nut 4750 and the moving nut bumper 4760 of the third preferred embodiment of the present invention.

In front of the moving nut 6750, a first housing guide groove 6753 is formed to be penetrated through the left-to-right direction, and to be open forward.

A first housing guide groove 6753 is formed one at each of the upper and lower portions of the front side of the moving nut 6750.

The first housing guide groove 6753 is formed on the same line as the first housing insertion groove 6742 of the return spring bumper 6740 installed in the right side of the moving nut 6750.

In the first housing guide groove 6753 and the first housing insertion groove 6742, a third guide portion 6106 of the first housing 6100 is inserted.

In the rear side of the moving nut 6750, a first blocking plate guide groove 6754 is formed to be penetrated through the left-to-right direction and to be open rearward.

The first blocking plate guide groove 6754 is formed one at each of the upper and lower portions of the rear side of the moving nut 6750.

In the first blocking plate guide groove 6754, a fourth guide portion 6806 of the first blocking plate 6800 is inserted.

That is, the left-to-right direction sliding of the moving nut 6750 is guided by the third guide portion 6106 and the fourth guide portion 6806.

<Door Latch Connection Portion>

The door latch connection portion 30 is of the same type as the door latch connection portion 30 of the third preferred embodiment of the present invention.

One end of the door latch connection portion 30 is connected to the moving nut 6750 and the other end is connected to the motorized latch unit 5000, so that the motorized latch unit 5000 may be unlocked by the movement of the moving nut 6750.

<Door Outer Side Connection Portion>

As illustrated in FIGS. 107 to 110, the door outer side connection portion 60 is inserted into the door outer side connection portion installation groove 6201 of the front side handle unit 6200, and the other end is connected to the motorized latch unit 5000.

The tube 62 of the door outer side connection portion 60 is inserted into and fixed to the door outer side connection portion 6835 of the first blocking plate 6800, and when the engaging protrusion 61 inserted into the door outer side connection portion installation groove 6201 according to the position of the tube 62 is lowered downward, the engaging protrusion 61 is in a state where it cannot be escaped rearward of the door outer side connection portion installation groove 6201.

Figure 108:
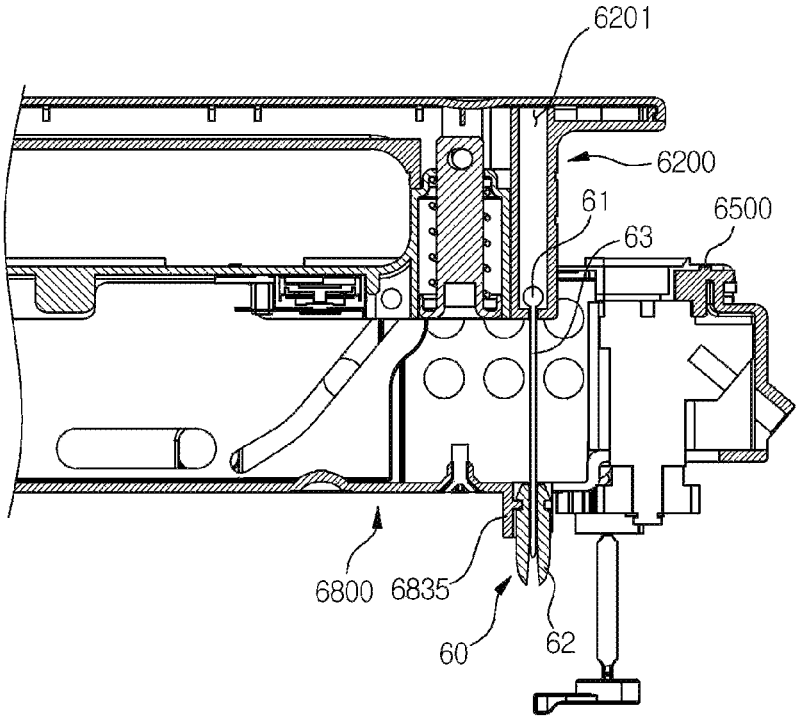
FIG. 108 is a cross-sectional view of a flush handle for a vehicle door according to a sixth preferred embodiment of the present invention in a state of being withdrawn.

As illustrated in FIG. 108, when the front side handle unit 6200 is withdrawn, the engaging protrusion 61 is disposed in the front side of the door outer side connection portion installation groove 6201 so that engaging protrusion 61 is not engaged with the rear side of the door outer side connection portion installation groove 6201.

Figure 107:
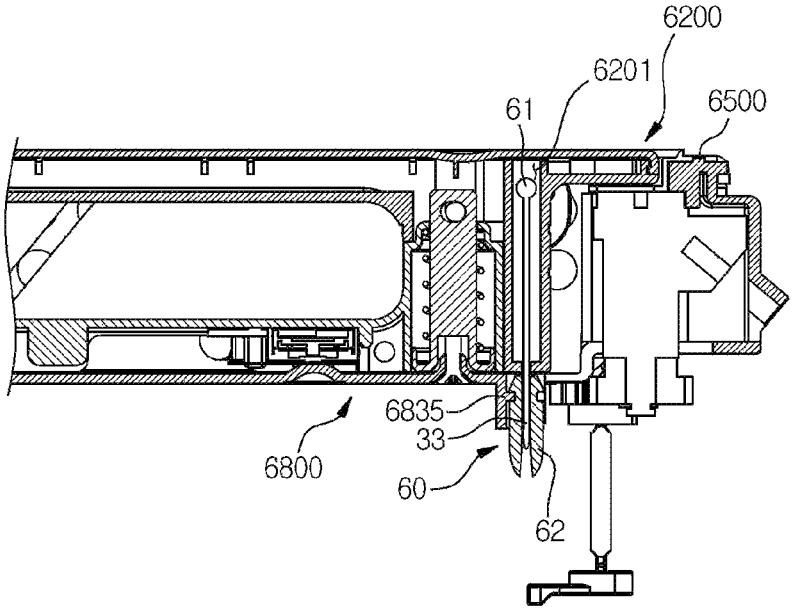
FIG. 107 is a cross-sectional view of a flush handle for a vehicle door according to a sixth preferred embodiment of the present invention in a state of being entered.

In the state as illustrated in FIG. 107, if the front side handle unit 6200 is withdrawn, and becomes a state as illustrated in FIG. 108, the motorized latch 5000 is unlocked by the door latch connection portion 30.

Figure 106:
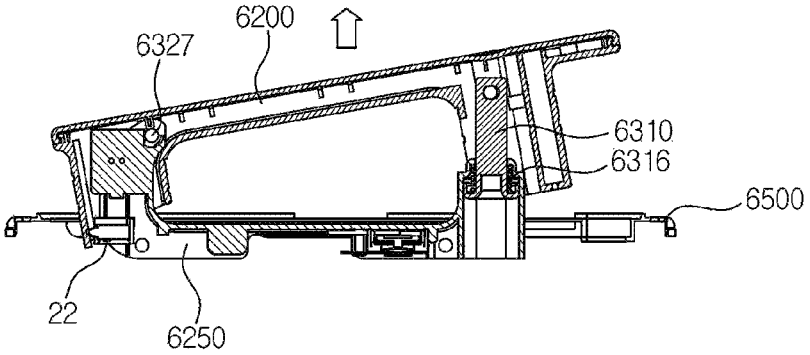
FIG. 106 is a cross-sectional view of a flush handle for a vehicle door according to a sixth preferred embodiment of the present invention in a state of being pulled after being withdrawn.
Figure 109:
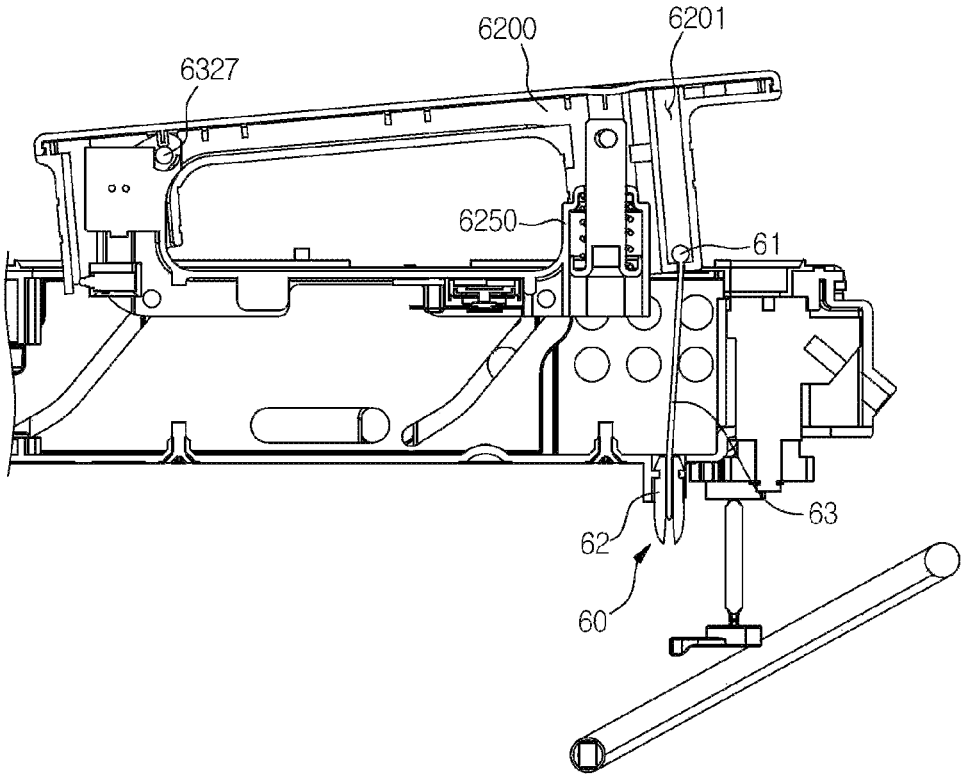
FIG. 109 is a sectional view of a flush handle for a vehicle door according to a sixth preferred embodiment of the present invention in a state of being pulled 5 degrees.

In this state, as illustrated in FIG. 109, when the front side handle unit 6200 is pulled about 5°, as illustrated in FIG. 106, the second sensor 22 is pressed, and the power is applied to the motorized latch 5000, and thereby the vehicle door is opened electrically.

At this time, although the engaging protrusion 61 of the door outer side connection portion 60 is pulled by the rear side of the door outer side connection portion installation groove 6201, it has little effect on the motorized latch 5000.

Figure 110:
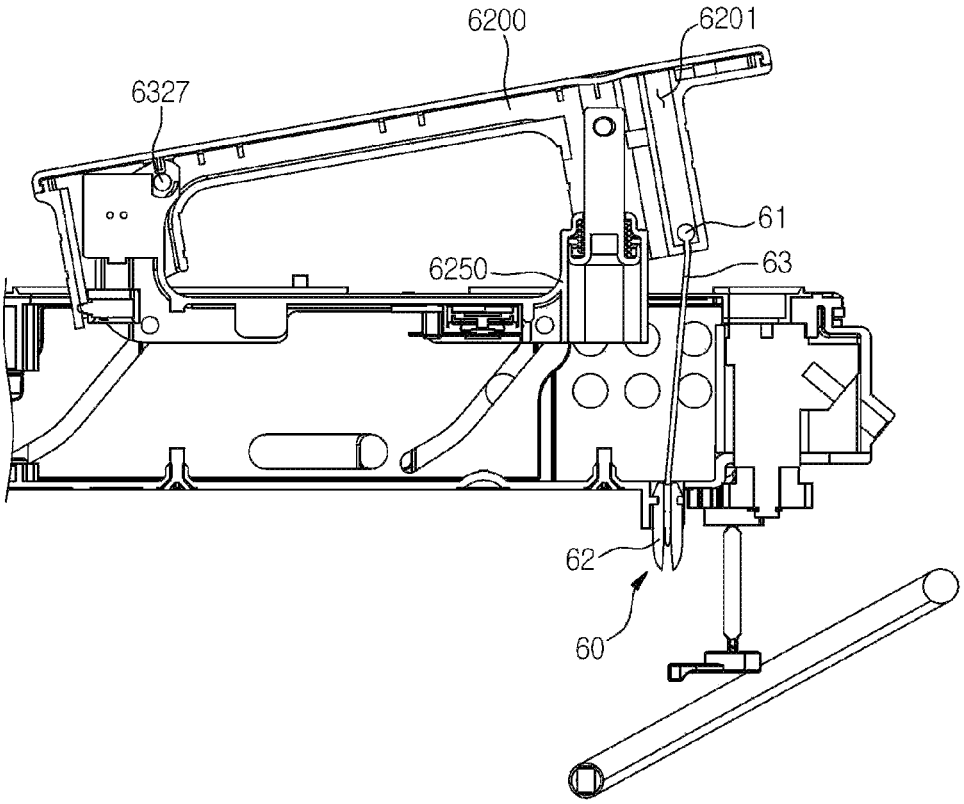
FIG. 110 is a cross-sectional view of a flush handle for a vehicle door according to a sixth preferred embodiment of the present invention in a state of being pulled 10 degrees.

As illustrated in FIG. 110, when the front side handle unit 6200 is pulled about 10 degrees, the engaging protrusion 61 of the door outer side connection portion 60 is further pulled by the rear of the door outer side connection portion installation groove 6201, and the motorized latch 5000 is mechanically operated to open the vehicle door.

That is, when the power is not normally applied to the motorized latch 5000, the user can mechanically open the vehicle door by pulling the front side handle unit 6200 completely.

<Key Lock Unit>

A key lock unit 6900 is the same type as the key lock unit 4900 of a third preferred embodiment of the present invention.

<Weight Balance>

Figure 100:
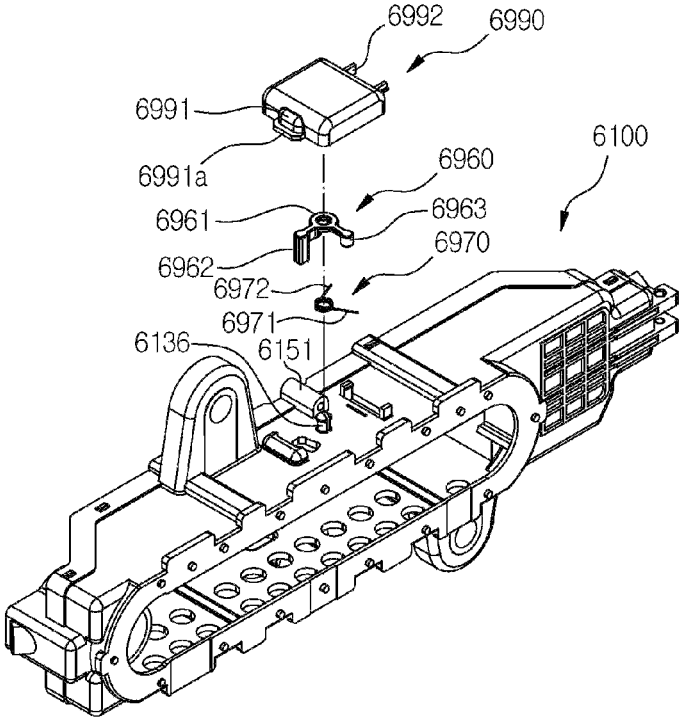
FIG. 100 is an exploded perspective view of a weight balance of a flush handle for a vehicle door according to a sixth preferred embodiment of the present invention.
Figure 101:
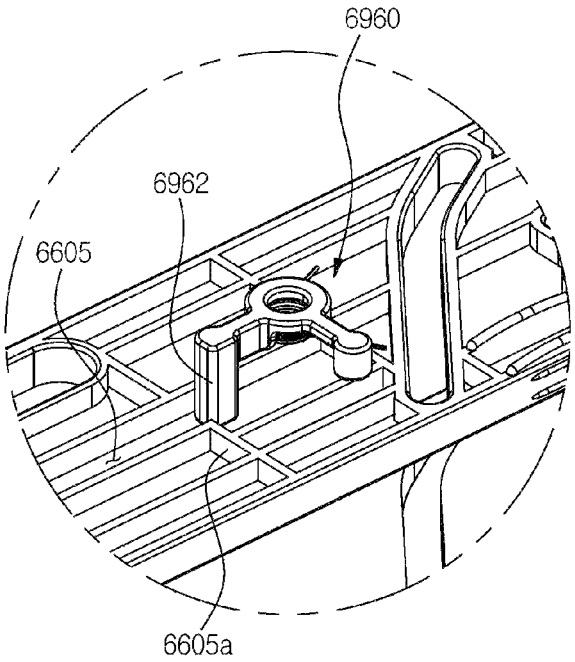
FIG. 101 is a state diagram when a weight balance of a flush handle for a vehicle door according to a sixth preferred embodiment of the present invention is in the first position.
Figure 102:
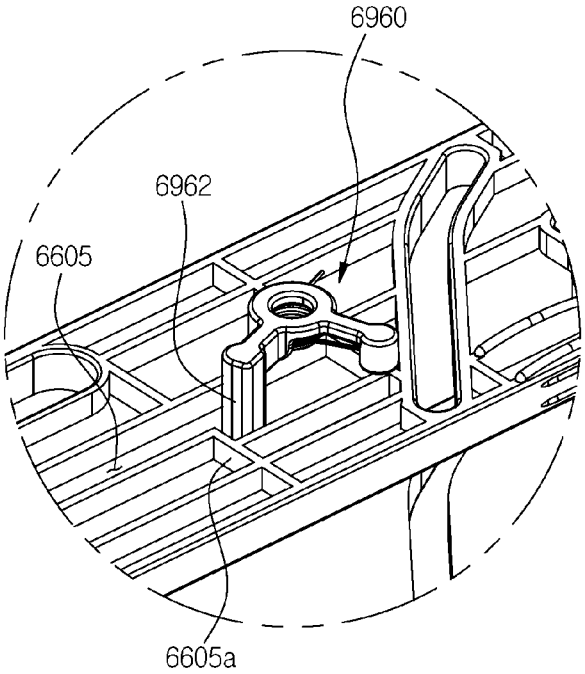
FIG. 102 is a state diagram when a weight balance of a flush handle for a vehicle door according to the sixth preferred embodiment of the present invention is in the second position.

The weight balance 6960 is illustrated in detail in FIGS. 100 to 102.

The weight balance 6960 comprises a first housing fitting portion 6961 in the shape of a donut, a first arm 6696 and a second arm 6963 connected to a first housing fitting portion 6161.

A groove formed in the center of the first housing fitting portion 6161 is fitted into the weight balance installation protrusion 6136 of the first housing 6100.

The first housing fitting portion 6161 is rotatably formed with respect to the weight balance installation protrusion 6136.

The first housing fitting portion 6161 is formed to be open downward, and a spring 6970 is installed in the lower portion of the first housing fitting portion 6161.

The first arm 6962 is connected to the left side of the first housing fitting portion 6961.

The first arm 6696 is formed so that the left side thereof is protruded downward.

Due to this, the lower portion of the first arm 6696 is positioned within the weight balance insertion groove 6605 of the slider 6600 through the weight balance guide groove 6137 of the first housing 6100 after assembly.

The second arm 6963 is connected to the front side of the first housing fitting portion 6961.

The spring 6970 may be provided as a coil spring. At both ends of the spring 6970, a first bent portion 6971 and a second bent portion 6972 are formed, respectively.

The first bent portion 6971 is positioned further forward than the second bent portion 6972.

The first bent portion 6971 is in contact with the outer side surface of the second arm 6963, and the second bent portion 6972 is in contact with the outer surface of the first fastening portion 6151 which is formed in the upper portion.

Due to this, when the weight balance 6960 is rotated counterclockwise, the spring 6970 is compressed as the first bent portion 6971 is getting closer toward the second bent portion 6972.

When in the initial state, the first arm 6962 of the weight balance 6960 is positioned in the guide groove of the weight balance insertion groove 6605 of the slider 6600, so that the slider 6600 can be slid freely in the left-to-right direction.

When an impact occurs on the side of the vehicle, as illustrated in FIG. 102, the weight balance 6960 is rotated counterclockwise so that the first arm 6962 is positioned at the right side of the weight balance engaging plate 6605*a* of the slider 6600, and thereby the slider 6600 cannot be moved rightward.

Since the movement of the slider 6600 is blocked, the rear side handle unit 6250 interlocked with the slider 6600 is not moved, and since the door latch connection portion 30 connected to the rear side handle unit 6250 is not pulled, the manual latch unit is not opened.

That is, the safety of the manual latch unit is enhanced due to the weight balance 6960.

<Cover>

A cover 6990 of the weight balance 6960 is illustrated in detail in FIG. 100.

The cover 6990 is formed, on the whole, in the shape of a flat cuboid.

The lower portion of the cover 6990 is formed to be open. In the left side of the cover 6990, a first fitting portion 6991 is formed to be protruded leftward.

The first fitting portion 6991 is formed to be in contact with the right side of the first cover fitting portion 6138 of the first housing 6100.

Due to the first fitting portion 6991, the cover 6990 is not moved leftward.

In the lower portion of the first fitting portion 6991, a protruding fitting plate 6991*a* is formed.

The protruding fitting plate 6991*a* is formed to be protruded leftward further than the first fitting portion 6991, and is inserted into the first cover fitting portion 6138 of the first housing 6100.

Due to the protruding fitting plate 6991*a*, the left side of the cover 6990 is not lifted upward.

In the right side of the cover 6990, a second fitting portion 6992 is formed to be protruded rightward.

The second fitting portion 6992 is formed one at each of the front side and the rear side of the cover 6990.

The second fitting portion 6992 is formed to be hook-coupled to the inner surface of the second cover fitting portion 6139 of the first housing 6100.

Due to the second fitting portion 6992, the right side of the cover 6990 is not lifted upward.

The lower portion of the right side of the cover 6990 is in contact with the cover engaging protrusion 6131*a* of the first housing 6100, and thereby the cover 6990 is not moved rightward.

First, after inserting the protruding fitting plate 6991*a* of the cover 6990 into the first cover fitting portion 6138, the right side of the cover 6990 is lowered so that the second fitting portion 6992 is hook-coupled to the second cover fitting portion 6139, and thereby the position of the cover 6990 is fixed.

<Step Adjustment Bolt>

A step adjustment bolt 40 is illustrated in detail in FIG. 103.

The step adjustment bolt 40 can be fastened to the step adjustment boss 6803 of the first blocking plate 6800 from rear to front.

In the front side of the step adjustment boss 6803 of the left side, a step adjustment protrusion 6274 of the rear side handle unit 6250 is disposed, and in the front side of the step adjustment boss 6803 of the right side, a step adjustment plate 6314 of the extension portion 6310 is disposed.

The position of the front side handle unit 6200 is changed according to the positions of the rear side handle unit 6250 and the extension portion 6310.

When the forward protruding amount of the step adjustment bolt 40 from the step adjustment boss 6803 is adjusted, the position of the front side handle unit 6200 in the front-to-rear direction can be adjusted.

Due to this, when assembling a flush handle for a vehicle door, by adjusting the position of the front side handle unit 6200 to match the design of the vehicle door, the sense of unity between the outer surface of the vehicle door and the front surface of the front side handle unit 6200 can be improved.

Hereinafter, a method of operating a flush handle for a vehicle door according to a sixth embodiment of the present invention having the previously described configuration will be described with reference to FIGS. 104 to 106.

Figure 104:
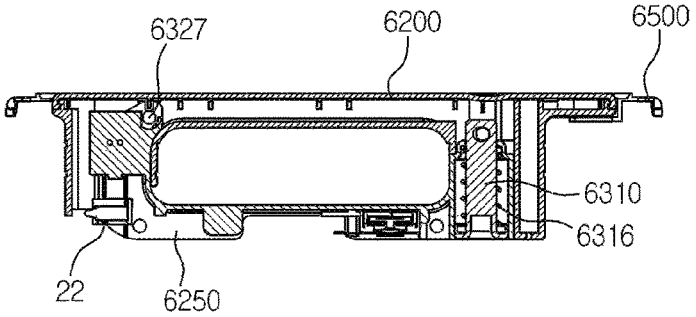
FIG. 104 is a cross-sectional view of a flush handle for a vehicle door according to a sixth preferred embodiment of the present invention in a state of being entered.
Figure 105:
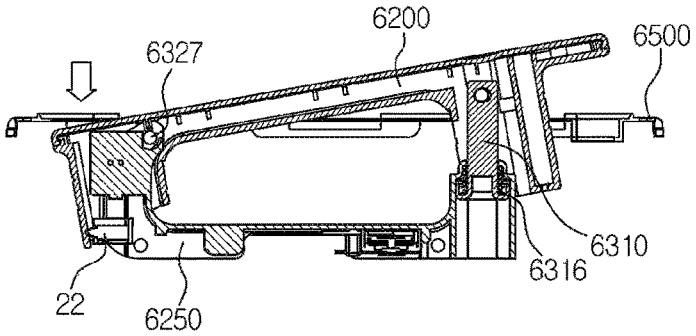
FIG. 105 is a sectional view of a flush handle for a vehicle door according to a sixth preferred embodiment of the present invention when the handle is in a state of being lifted.

As illustrated in FIG. 104, in the state where the handle unit is withdrawn, when the right side of the front side handle unit 6200 is pressed, as illustrated in FIG. 105, the front side handle unit 6200 is rotated counterclockwise centered around the pivot pin 6327.

When the front side handle unit 6200 is rotated, the extension portion 6310 connected to the front side handle unit 6200 is pulled forward and the extension portion return spring 6316 is compressed. When the force applied to the front side handle unit 6200 is removed, the extension portion return spring 6316 is tensioned and the front side handle unit 6200 is returned to its original position.

At this time, the rear side handle unit 6250 is connected to the slider 6600 by the first and second pins 6301 and 6302, so it is not moved.

This is also the same when the front side handle unit 6200 is pulled forward while the handle unit is withdrawn, as illustrated in FIG. 106.

When the rear side handle unit 6250 is withdrawn by the sliding of the slider 6600, the front side handle unit 6200 is also moved along the drawing direction accordingly, but when a user pulls the front side handle unit 6200, only the front side handle unit 6200 is rotated centered around the pivot pin 6327, and the rear side handle unit 6250 is fixed in the withdrawn position.

That is, by separating each function using a rear side handle unit 6250 connected to the slider 6600 to perform entry and withdrawal operations, and the front side handle unit 6200 to perform pulling operation, the functions of the handle unit can be stably driven without tangling with each other.

In addition, since only the front side handle unit 6200 is operated by the extension portion return spring 6316, the operating force of the extension portion return spring 6316 can be reduced.

As previously described, although it is described with reference to preferred embodiments of the present invention, those skilled in the art may implement the present invention through various modifications or variations without departing from the spirit and scope of the present invention as set forth in the claims below.

What is claimed is:

1. A flush handle for a vehicle door comprising:
a slider;
a handle unit accommodated in the slider; and
a linear motion conversion mechanism, configured to slide the handle unit in a y direction in accordance with a sliding of the slider in an x direction, or slide the slider in the x direction in accordance with a sliding of the handle unit in they direction, wherein a lengthwise direction of a vehicle is the x direction, and a widthwise direction of the vehicle is they direction,
wherein the linear motion conversion mechanism comprises:
a linear motion conversion unit, configured to slide the handle unit relative to the slider by connecting the slider and the handle unit; and
a driving unit, configured to slide the slider so that the handle unit slides relatively to the slider,
wherein the linear motion conversion unit comprises:
at least one inclined long hole, inclined with respect to the y direction, formed at the slider; and
at least one pin, configured to couple to the handle unit, and slide along the inclined long hole,
wherein the at least one inclined long hole includes a first inclined long hole and a second inclined long hole disposed in the x direction,
wherein an inclined direction of the first inclined long hole is parallel to an inclined direction of the second inclined long hole,
wherein the at least one pin includes:
a first pin configured to slide in the first inclined long hole;
and a second pin configured to slide in the second inclined long hole, and
wherein the handle unit includes:
an extension portion, coupled to the first pin, and configured to adjust a distance between the first pin and an outer surface of the handle unit.

2. The flush handle for a vehicle door according to claim 1,
wherein the driving unit comprises:
a moving nut disposed non-rotatably in the slider;
a lead screw fastened to the moving nut; and
a power delivery unit configured to deliver a rotational force to the lead screw.

3. The flush handle for a vehicle door according to claim 2, further comprising:
a slider return spring configured to return the slider.

4. The flush handle for a vehicle door according to claim 3,
wherein the slider return spring is installed between the power delivery unit and the slider.

5. The flush handle for a vehicle door according to claim 2, further comprising:
a housing in which the slider is installed,
wherein a guide portion in contact with the slider is formed in the housing, the guide portion is elongated in the x direction, and
wherein a housing insertion groove into which the guide portion is inserted is formed in the moving nut.

6. The flush handle for a vehicle door according to claim 5,
wherein a sensor configured to detect the moving nut is further installed in the housing,
wherein a protrusion that is configured so it can press the sensor is formed in the moving nut, and
wherein the protrusion is disposed outside the slider.

7. The flush handle for a vehicle door according to claim 2, further comprising:
a first housing in which the handle unit is installed; and
a second housing in which the power delivery unit is installed,
wherein the second housing is separated from the first housing.

8. The flush handle for a vehicle door according to claim 2,
wherein the power delivery unit includes:
a motor; and
an encoder capable of measuring the number of revolutions of the motor.

9. The flush handle for a vehicle door according to claim 1, further comprising:
an extension portion return spring, configured to return the extension portion, and
wherein a slot positioned in the extension portion is orthogonal to a direction between the first pin and the outer surface of the handle unit.

10. The flush handle for a vehicle door according to claim 1,
wherein the handle unit is configured to rotatable centered around the second pin, and
wherein a pivot unit configured to change a rotation axis of the handle unit is further installed in the handle unit.

11. The flush handle for a vehicle door according to claim 10, further comprising:
a housing in which the slider is installed,
wherein the pivot unit is provided with a pivot pin connected to the handle unit,
wherein a distance between the pivot pin and an outer side of the vehicle is smaller than a distance between the second pin and the outer side of the vehicle, and wherein the pivot unit is fixed to the housing by a frictional force with the housing when the handle unit is pressed from the outer side of the vehicle.

12. The flush handle for a vehicle door according to claim 11, wherein the second inclined long hole includes an entry portion formed in an inner side of the vehicle and a withdrawal portion formed in the outer side of the vehicle, and wherein the entry portion of the second inclined long hole has a shape in which the second pin is rotatable with respect to the pivot pin.

13. The flush handle for a vehicle door according to claim 11, wherein a second pin installation groove into which the second pin is inserted is formed in the handle unit, and wherein the second pin installation groove has a shape of an arc centered around the pivot pin.

14. The flush handle fora vehicle door according to claim 1, wherein the handle unit further includes a button configured to input a signal pushing the handle unit into a vehicle door, and wherein the button is configured to be exposed outside only when the handle unit is withdrawn.

15. The flush handle for a vehicle door according to claim 1, further comprising:

a housing in which the slider is installed, wherein the handle unit further includes a sensor configured to input a signal withdrawing the handle unit from a vehicle door, and wherein the sensor is configured to be pressed by the housing when the handle unit is pressed in the y direction.

16. The flush handle for a vehicle door according to claim 15, further comprising:

a plate spring coupled to an outer side of the button, wherein the plate spring is pressed by the housing.

17. The flush handle for a vehicle door according to claim 1, further comprising:

a housing in which the slider is installed, wherein a slider bumper protruded outward from the slider is installed on the slider, and wherein a gap is formed between an outer surface of the slider and an inner surface of the housing due to the slider bumper.

18. The flush handle for a vehicle door according to claim 1, wherein the handle unit includes:

a rear side handle unit configured to be slid by the linear motion conversion mechanism; and a front side handle unit coupled to the rear side handle unit by a pivot pin, and wherein the front side handle unit is rotatable centered around the pivot pin.

19. The flush handle for a vehicle door according to claim 1, wherein the inclined long hole includes a first section and a second section in which the pin passes, wherein the pin moves from the first section to the second section when the handle unit is withdrawn, and wherein a slope of the first section is more gradual than a slope of the second section.

20. The flush handle for a vehicle door according to claim 1, further comprising:

a housing in which the slider is installed, wherein a step adjustment bolt is installed in the housing, wherein the step adjustment bolt is disposed in contact with the handle unit, and wherein the handle unit is moved in the y direction when the step adjustment bolt is tightened or loosened.

21. The flush handle for a vehicle door according to claim 1, wherein a weight balance insertion groove is formed on an upper surface of the slider, wherein the weight balance insertion groove includes a guide groove formed in the x direction and an engaging groove formed to be protruded forward in an end of the guide groove, wherein a weight balance includes a first arm, wherein the first arm moves between a first position located at the end of the guide groove and a second position located at the locking groove to prevent sliding of the slider in the x direction, and wherein when an impact is applied to the vehicle door, the first arm moves to the second position.

22. The flush handle for a vehicle door according to claim 1, further comprising:

a motorized latch unit that is locked or unlocked by the sliding of the slider.

23. The flush handle for a vehicle door according to claim 22, further comprising:

a key cylinder configured to manually drive the motorized latch unit.

24. The flush handle for a vehicle door according to claim 23, further comprising:

a gear provided with a rotational force of the key cylinder, a gear rod connected to the gear and rotated by the gear, and an insert portion formed at an end of the gear rod and coupled to the motorized latch unit, wherein the insert portion has a shape of a plate, and wherein the motorized latch unit is manually opened when the insert portion rotates.

25. The flush handle for a vehicle door according to claim 1, further comprising:

a manual latch unit configured to open by the rotation of the handle unit.

26. The flush handle for a vehicle door according to claim 25, further comprising:

a lever configured to deliver a rotational force of the handle unit to the manual latch unit; and a weight balance including a spring installation portion that configured to can be moved between a first position in an initial state and a second position that configured to can block the operation of the lever, wherein when an impact is applied to the vehicle door, the spring installation portion is configured to move from the first position to the second position.

* * * * *